US009583839B2

(12) United States Patent
Liu et al.

(10) Patent No.: US 9,583,839 B2
(45) Date of Patent: Feb. 28, 2017

(54) REFLECTIVE ARRAY SURFACE AND REFLECTIVE ARRAY ANTENNA

(71) Applicant: KUANG-CHI INNOVATIVE TECHNOLOGY LTD., Shenzhen (CN)

(72) Inventors: Ruopeng Liu, Shenzhen (CN); Chunlin Ji, Shenzhen (CN); Xingkun Li, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 74 days.

(21) Appl. No.: 14/696,478

(22) Filed: Apr. 26, 2015

(65) Prior Publication Data

US 2015/0229032 A1 Aug. 13, 2015

Related U.S. Application Data

(63) Continuation of application No. PCT/CN2013/086773, filed on Nov. 8, 2013.

(30) Foreign Application Priority Data

Nov. 9, 2012 (CN) ..... 2012 1 0447464
Nov. 9, 2012 (CN) ..... 2012 1 0447599
Nov. 9, 2012 (CN) ..... 2012 1 0447607
Nov. 9, 2012 (CN) ..... 2012 1 0447684
Nov. 9, 2012 (CN) ..... 2012 1 0447826

(51) Int. Cl.
*H01Q 15/14* (2006.01)
*H01Q 3/46* (2006.01)
(Continued)

(52) U.S. Cl.
CPC ..... *H01Q 15/148* (2013.01); *H01Q 3/10* (2013.01); *H01Q 3/12* (2013.01); *H01Q 3/18* (2013.01);
(Continued)

(58) Field of Classification Search
CPC ..... H01Q 15/148
See application file for complete search history.

(56) References Cited

U.S. PATENT DOCUMENTS 4,905,014 A 2/1990 Gonzalez et al.
2009/0073073 A1 3/2009 Brown et al.
(Continued)

FOREIGN PATENT DOCUMENTS

CN 1438696 A 8/2003
CN 1658434 A 8/2005
(Continued)

*Primary Examiner* — Robert Karacsony
(74) *Attorney, Agent, or Firm* — Perkins Coie LLP

(57) ABSTRACT

The present invention provides a reflective array surface. The reflective array surface includes a functional board that is configured to perform beam modulation on an incident electromagnetic wave and a reflection layer that is disposed on one side of the functional board and is configured to reflect an electromagnetic wave, where the functional board includes two or more functional board units and the reflection layer includes reflection units, where the number of reflection units corresponds to the number of functional board units, where the functional board unit and a reflection unit corresponding to the functional board constitute a phase-shifting unit that is used for phase shifting. According to the reflective array surface in the present invention, a functional board unit and a reflection unit corresponding to the functional board unit constitute a phase-shifting unit that is used for phase shifting, which can solve a problem in the prior art that a phase-shifting effect is not exquisite enough and a beam modulation capability for an electromagnetic wave is poor, thereby affecting bandwidth and working performance of a reflective array antenna. In addition, the present invention further provides a reflective array antenna.

19 Claims, 35 Drawing Sheets

(51) Int. Cl.

| | |
|---|---|
| ***H01Q 15/23*** | (2006.01) |
| ***H01Q 15/00*** | (2006.01) |
| ***H01Q 3/10*** | (2006.01) |
| ***H01Q 3/12*** | (2006.01) |
| ***H01Q 3/18*** | (2006.01) |
| ***H01Q 3/20*** | (2006.01) |
| *H01Q 19/13* | (2006.01) |

(52) U.S. Cl.
CPC ..... *H01Q 3/20* (2013.01); *H01Q 3/46* (2013.01); *H01Q 15/006* (2013.01); *H01Q 15/0026* (2013.01); *H01Q 15/23* (2013.01); *H01Q 19/132* (2013.01)

(56) References Cited

U.S. PATENT DOCUMENTS

2010/0194657 A1 8/2010 Maruyama et al.
2013/0099990 A1* 4/2013 Bresciani ..... H01Q 3/46 343/834

FOREIGN PATENT DOCUMENTS

| | | | |
|---|---|---|---|
| CN | 2775865 | Y | 4/2006 |
| CN | 101010999 | A | 8/2007 |
| CN | 101154645 | A | 4/2008 |
| CN | 101547555 | A | 9/2009 |
| CN | 101635325 | A | 1/2010 |
| CN | 202231158 | U | 5/2012 |
| CN | 102683818 | A | 9/2012 |
| CN | 102683855 | A | 9/2012 |
| CN | 102683888 | A | 9/2012 |
| CN | 102983404 | A | 3/2013 |
| CN | 102983410 | A | 3/2013 |
| CN | 102983412 | A | 3/2013 |
| CN | 102983413 | A | 3/2013 |
| CN | 102983414 | A | 3/2013 |
| WO | WO 2011/113650 | A2 * | 9/2011 |

* cited by examiner

REFLECTIVE ARRAY SURFACE AND REFLECTIVE ARRAY ANTENNA

CROSS REFERENCE TO RELATED APPLICATIONS

This application is a continuation of PCT/CN2013/086773 filed on Nov. 8, 2013, which claims priority to Chinese patent application No. 201210447826.3 of Nov. 9, 2012; Chinese patent application No. 201210447607.5 of Nov. 9, 2012; Chinese patent application No. 201210447599.4 of Nov. 9, 2012; Chinese patent application No. 201210447464.8 of Nov. 9, 2012; and Chinese patent application No. 201210447684.0 of Nov. 9, 2012; all of which are incorporated herein by reference.

TECHNICAL FIELD

The disclosure relates to the communications field, and more specifically, to a reflective array surface and a reflective array antenna.

BACKGROUND

In an existing reflective array antenna technology, a commonest reflection focusing antenna is a parabolic antenna. A spherical wave radiated by a feed disposed on a paraboloid focus becomes, after being reflected by a paraboloid, a planar wave parallel to an antenna axis, so that a field distributed on a planar antenna aperture is an in-phase field. The parabolic antenna has advantages such as a simple structure, a high gain, strong directivity, and a wide working frequency band. However, a curved parabolic reflection surface leads to a bulky and heavy antenna, which restricts an application in a space-limited occasion, for example, a spacecraft antenna. In addition, the parabolic antenna relies on a mechanically-rotated beam scanning manner, which makes it difficult to meet a flexible requirement for a beam direction.

To overcome these defects of a traditional reflection antenna, a new type of reflective array antenna is proposed in a relevant technology. The reflective array antenna uses a phase-shifting unit, for example, a dipole or a microstrip patch having a phase-shifting feature, to form a reflective array and uses a phase-shifting feature of the phase-shifting unit to construct an equivalent paraboloid. However, an overall phase-shifting effect of the reflective array antenna is not exquisite enough and a beam modulation capability for an electromagnetic wave is poor, thereby affecting bandwidth and working performance of the reflective array antenna.

In addition, in the relevant technology, the reflective array antenna is designed for a specific working frequency band. A feed location is fixed relative to a reflective array surface. Therefore, a same reflective array surface that is designed can only work for an electromagnetic wave with a specified incident angle, for example, the reflective array surface is applied to a satellite television antenna. The reflective array surface can only receive a satellite television signal in a specific region, which cannot meet a requirement that a same type of satellite television antenna covers multiple regions.

Further, in the communications field, a radiation pattern of an electromagnetic wave used as a signal carrier in space plays a very important role in signal propagation. Generally, a pattern of an electromagnetic wave exited from a signal source cannot meet a normal requirement, and modulation needs to be performed on a radiation pattern of the electromagnetic wave. Usually, an electromagnetic wave radiation pattern is modulated by using a phase modulation method, that is, a phase of an electromagnetic wave emitted from a signal source is modulated to a required phase by using a device or an apparatus. A common method of modulating a space phase of an electromagnetic wave is: using a metal reflection surface to perform phase correction; and changing, by the metal reflection surface, an existing electromagnetic wave space phase distribution by using a different appearance design of the metal reflection surface to form a target phase distribution. This method of performing, based on a metal reflection surface, space phase correction on an electromagnetic wave features a simple structure, a wide working frequency band, and a large power capacity, but highly relies on geometrical appearance. The appearance is bulky, a requirement for a production process precision is high, and costs are relatively high.

Besides, a planar array reflection surface uses a periodically arranged phase-shifting unit array to perform phase modulation. With light weight and a small volume, the planar array reflection surface does not rely on geometrical appearance in performance, is easily conformal, and is of relatively good work environment adaptability. However, a working mechanism of the planar array reflection surface is using each independent phase-shifting unit on the reflection surface to correct an existing phase distribution to a target phase distribution. Therefore, a requirement for a maximum phase-shifting range of a phase-shifting unit is relatively high.

An existing document has clearly pointed out that an initial phase of an incident electromagnetic wave can be modulated to a target phase only when a maximum phase-shifting range of a phase-shifting unit reaches at least 360 degrees, so as to obtain an expected electromagnetic wave radiation pattern. This requirement for the maximum phase-shifting range of the phase-shifting unit greatly restricts design of the planar array reflection surface. Therefore, there is a strict restriction on substrate design and phase-shifting unit design of the planar array reflection surface, thereby increasing production costs and affecting bandwidth performance of the planar array reflection surface.

Further, in a traditional reflective array theory, it is generally required that dimensions of a phase-shifting unit should be less than ½ of a wavelength of an electromagnetic wave. In a relevant technology, it is shown that, when dimensions of a phase-shifting unit are reduced from a half-wavelength to a subwavelength (⅙ of a wavelength), a phase modulation capability of an array reflection surface formed by a single layer of phase-shifting units becomes poorer and a phase-shifting range is reduced by 200 degrees. This cannot meet a requirement mainly because a gap between phase-shifting units is less than 0.001 millimeters after dimensions of a phase-shifting unit are reduced to ⅙ of a wavelength of an electromagnetic wave, which causes a grating lobe effect, thereby affecting performance of the reflective array antenna.

In this way, a requirement for unit dimensions of a phase-shifting unit greatly restricts design of the planar array reflection surface. Therefore, there is a strict restriction on substrate design and phase-shifting unit design of the planar array reflection surface, thereby increasing production costs and affecting bandwidth performance of the planar array reflection surface.

Further, owing to advantages such as a low section plane, low costs, easy conformal performance, easy integration, easy portability, and good concealment, the reflective array antenna is widely applied in a long-distance wireless transmission system such as satellite communications and deep space exploration. A reflection surface in the reflective array antenna generally uses an entire piece of sheet metal, a metallic coating, or a metallic film to implement a reflection function. If a thickness of the sheet metal, metallic coating, or metallic film is large, antenna costs increase. If the thickness of the sheet metal, metallic coating, or metallic film is reduced to decrease costs, when the thickness reaches a certain degree, for example, 0.01 to 0.03 millimeters, a length and a width of the sheet metal, metallic coating, or metallic film are far greater than the thickness of the sheet metal, metallic coating, or metallic film. In this case, warpage may easily occur due to stress in preparation and actual applications. Once warpage occurs, not only an entire antenna surface becomes unsmooth, but also electrical performance of the reflective array antenna is seriously affected and even a signal cannot be received or sent. On one hand, a yield in a product preparation process is decreased, thereby causing a lot of waste. On the other hand, maintenance costs after a product is used are also increased.

Further, the reflective array antenna usually includes a medium slab, multiple unit structures disposed on the medium slab, and a reflection layer disposed on another side of the medium slab. In an existing reflective array antenna, a reflection layer or multiple unit structures are attached to two sides of a medium slab by means of copper etching or attached to two sides of a medium slab by means of hot pressing. When a reflective array antenna prepared in the foregoing manner is applied, the following problem exists: a medium slab and reflection layer of the reflective array antenna may generate an effect of thermal expansion and contraction under a temperature difference between day and night and a temperature difference between different regions. Because a contraction percentage of the medium slab is different from a contraction percentage of a reflection surface and thicknesses of a unit structure and the reflection layer are relatively thin, thermal expansion and contraction of the medium slab and reflection surface causes warpage on a relatively thin unit structure and/or the reflection layer. A warped unit structure and/or reflection layer affects a response of the reflective array antenna to an electromagnetic wave and also increases maintenance costs.

SUMMARY

A technical problem to be solved by embodiments of the present invention is to provide a reflective array surface. On the reflective array surface, a functional board unit and a reflection unit corresponding to the functional board unit constitute a phase-shifting unit that is used for phase shifting, which can solve a problem in the prior art that a phase-shifting effect is not exquisite enough and a beam modulation capability for an electromagnetic wave is poor, thereby affecting bandwidth and working performance of a reflective array antenna.

An embodiment of the present invention provides a reflective array surface. The reflective array surface includes a functional board that is configured to perform beam modulation on an incident electromagnetic wave and a reflection layer that is disposed on one side of the functional board and is configured to reflect an electromagnetic wave, where the functional board includes two or more functional board units and the reflection layer includes reflection units, where the number of reflection units corresponds to the number of functional board units, where the functional board unit and a reflection unit corresponding to the functional board constitute a phase-shifting unit that is used for phase shifting.

In addition, in view of a defect that an existing reflective array surface can only work for an electromagnetic wave with a specific incident angle, another technical problem to be solved by the embodiments of the present invention is to provide a reflective array surface capable of receiving an incident electromagnetic wave within a predefined angle range.

An embodiment of the present invention provides a reflective array surface, where the reflective array surface includes a functional board that is configured to perform beam modulation on an incident electromagnetic wave and a reflection layer that is disposed on one side of the functional board and is configured to reflect an electromagnetic wave, where the functional board includes two or more functional board units and the reflection layer includes reflection units, where the number of reflection units corresponds to the number of functional board units, where the functional board unit and a reflection unit corresponding to the functional board constitute a phase-shifting unit that is used for phase shifting; and the reflective array surface has a focusing capability for an incident electromagnetic wave within a predefined angle range, where the predefined angle range is formed between the incident electromagnetic wave and a normal direction of the reflective array surface.

Further, the reflective array surface has a focusing capability for an incident electromagnetic wave within an angle range of 0-70 degrees, where the angle range is formed between the incident electromagnetic wave and a normal direction of the reflective array surface.

Further, the reflective array surface has a focusing capability for an incident electromagnetic wave within an angle range of 10-60 degrees, where the angle range is formed between the incident electromagnetic wave and a normal direction of the reflective array surface.

Further, the reflective array surface has a focusing capability for an incident electromagnetic wave within an angle range of 20-50 degrees, where the angle range is formed between the incident electromagnetic wave and a normal direction of the reflective array surface.

Further, the reflective array surface has a focusing capability for an incident electromagnetic wave within an angle range of 30-40 degrees, where the angle range is formed between the incident electromagnetic wave and a normal direction of the reflective array surface.

Further, the reflective array surface has a focusing capability for an incident electromagnetic wave within an angle range of 0-20 degrees, where the angle range is formed between the incident electromagnetic wave and a normal direction of the reflective array surface.

Further, the reflective array surface has a focusing capability for an incident electromagnetic wave within an angle range of 10-30 degrees, where the angle range is formed between the incident electromagnetic wave and a normal direction of the reflective array surface.

Further, the reflective array surface has a focusing capability for an incident electromagnetic wave within an angle range of 20-40 degrees, where the angle range is formed between the incident electromagnetic wave and a normal direction of the reflective array surface.

Further, the reflective array surface has a focusing capability for an incident electromagnetic wave within an angle range of 30-50 degrees, where the angle range is formed between the incident electromagnetic wave and a normal direction of the reflective array surface.

Further, the reflective array surface has a focusing capability for an incident electromagnetic wave within an angle range of 35-55 degrees, where the angle range is formed between the incident electromagnetic wave and a normal direction of the reflective array surface.

Further, the reflective array surface has a focusing capability for an incident electromagnetic wave within an angle range of 50-70 degrees, where the angle range is formed between the incident electromagnetic wave and a normal direction of the reflective array surface.

Further, a difference value between a maximum phase-shifting amount and a minimum phase-shifting amount is less than 360 degrees for all phase-shifting units on the reflective array surface.

Further, the functional board is a one-layer structure or a multi-layer structure constituted by multiple lamellae.

Further, the functional board unit includes a substrate unit and an artificial structure unit that is disposed on one side of the substrate unit and is configured to generate an electromagnetic response to an incident electromagnetic wave.

Further, the substrate unit is made from a ceramic material, a polymer material, a ferro-electric material, a ferrite material, or a ferro-magnetic material.

Further, the polymer material is polystyrene, polypropylene, polyimide, polyethylene, polyetheretherketone, polytetrafluorethylene, or epoxy resin.

Further, the artificial structure unit is a structure that has a geometrical pattern and is constituted by a conductive material.

Further, the conductive material is metal or a nonmetallic conductive material.

Further, the metal is gold, silver, copper, gold alloy, silver alloy, copper alloy, kirsite, or aluminum alloy.

Further, the nonmetallic conductive material is conductive graphite, indium-tin-oxide, or aluminum-doped zinc oxide.

Further, the reflective array surface further includes a protection layer that is configured to cover the artificial structure unit.

Further, the protection layer is a polystyrene plastic film, a polyethylene terephthalate plastic film, or a high impact polystyrene plastic film.

Further, the functional board unit is constituted by a substrate unit and a unit hole disposed on the substrate unit.

Further, a difference value between a maximum phase-shifting amount and a minimum phase-shifting amount ranges from 0 to 300 degrees for all phase-shifting units on the reflective array surface.

Further, a difference value between a maximum phase-shifting amount and a minimum phase-shifting amount ranges from 0 to 280 degrees for all phase-shifting units on the reflective array surface.

Further, a difference value between a maximum phase-shifting amount and a minimum phase-shifting amount ranges from 0 to 250 degrees for all phase-shifting units on the reflective array surface.

Further, a difference value between a maximum phase-shifting amount and a minimum phase-shifting amount ranges from 0 to 180 degrees for all phase-shifting units on the reflective array surface.

Further, the reflection layer is attached to a surface of the one side of the functional board.

Further, the reflection layer and the functional board are disposed at a distance.

Further, the reflection layer is a metallic coating or a metallic film.

Further, the reflection layer is a metallic grid reflection layer.

Further, the metallic grid reflection layer is constituted by multiple pieces of mutually spaced sheet metal, where a shape of a single piece of sheet metal is a triangle or a polygon.

Further, the shape of the single piece of sheet metal is a square.

Further, a mutual spacing between the multiple pieces of sheet metal is less than 1/20 of a wavelength of an electromagnetic wave corresponding to a central frequency of a working frequency band of an antenna.

Further, the metallic grid reflection layer is a mesh structure that is constituted by crisscrossing multiple metallic wires and has multiple mesh holes, where a shape of a single mesh hole is a triangle or a polygon.

Further, the shape of the single mesh hole is a square.

Further, a side length of the single mesh hole is less than 1/2 of a wavelength of an electromagnetic wave corresponding to a central frequency of a working frequency band of an antenna, and a wire width of the multiple metallic wires is equal to or greater than 0.01 mm.

Further, a cross-section diagram of the substrate unit is a triangle or a polygon.

Further, the cross-section diagram of the substrate unit is an equilateral triangle, a square, a rhombus, a regular pentagon, a regular hexagon, or a regular octagon.

Further, a side length of the cross-section diagram of the substrate unit is less than 1/2 of a wavelength of an electromagnetic wave corresponding to a central frequency of a working frequency band of an antenna.

Further, a side length of the cross-section diagram of the substrate unit is less than 1/4 of a wavelength of an electromagnetic wave corresponding to a central frequency of a working frequency band of an antenna.

Further, a side length of the cross-section diagram of the substrate unit is less than 1/8 of a wavelength of an electromagnetic wave corresponding to a central frequency of a working frequency band of an antenna.

Further, a side length of the cross-section diagram of the substrate unit is less than 1/10 of a wavelength of an electromagnetic wave corresponding to a central frequency of a working frequency band of an antenna.

In addition, in view of a defect in the prior art that a maximum phase-shifting range of a phase-shifting unit is required to reach at least 360 degrees in a phase modulation process, another technical problem to be solved by the embodiments of the present invention is to provide a reflective array surface.

An embodiment of the present invention provides a reflective array surface, where the reflective array surface includes a functional board that is configured to perform beam modulation on an incident electromagnetic wave and a reflection layer that is disposed on one side of the functional board and is configured to reflect an electromagnetic wave, where the functional board includes two or more functional board units and the reflection layer includes reflection units, where the number of reflection units corresponds to the number of functional board units, where the functional board unit and a reflection unit corresponding to the functional board constitute a phase-shifting unit that is used for phase shifting; and a difference value between a maximum phase-shifting amount and a minimum phase-shifting amount is less than 360 degrees for all phase-shifting units on the reflective array surface.

Further, the number of phase-shifting units with the difference value between the maximum phase-shifting amount and the minimum phase-shifting amount less than 360 degrees in all the phase-shifting units on the reflective array surface accounts for more than 80% of the total number of phase-shifting units, and a phase-shifting amount of each phase-shifting unit is designed to implement an expected electromagnetic wave radiation pattern.

Further, the reflective array surface is configured to modulate an electromagnetic wave having a wide-beam pattern to an electromagnetic wave having a narrow-beam pattern; or modulate an electromagnetic wave having a narrow-beam pattern to an electromagnetic wave having a wide-beam pattern; or change a main beam direction of an electromagnetic wave pattern.

Further, the reflective array surface works at wave band Ku and a thickness of the substrate unit is 0.5-4 mm; or the reflective array surface works at wave band X and a thickness of the substrate unit is 0.7-6.5 mm; or the reflective array surface works at wave band C and a thickness of the substrate unit is 1-12 mm.

In addition, still another technical problem to be solved by the embodiments of the present invention is a defect in the prior art that warpage easily occurs on a reflective array antenna.

An embodiment of the present invention provides a reflective array surface, where the reflective array surface includes a functional board that is configured to perform beam modulation on an incident electromagnetic wave and a reflection layer that is disposed on one side of the functional board and is configured to reflect an electromagnetic wave, where the functional board includes two or more functional board units and the reflection layer includes reflection units, where the number of reflection units corresponds to the number of functional board units, where the functional board unit and a reflection unit corresponding to the functional board constitute a phase-shifting unit that is used for phase shifting; the functional board includes a substrate and an artificial structure layer that is disposed on one side of the substrate and has an electromagnetic response to an electromagnetic wave, where the reflection layer is disposed on the other side of the substrate; and at least one stress buffer layer is disposed between the substrate and the artificial structure layer and/or between the substrate and the reflection layer.

Further, tensile strength of the stress buffer layer is less than tensile strength of the substrate, and an elongation at break of the stress buffer layer is greater than an elongation at break of the artificial structure layer and an elongation at break of the reflection layer.

Further, the stress buffer layer is made from a thermoplastic resin material or a modified material of the thermoplastic resin material.

Further, the thermoplastic resin material is polyethylene, polypropylene, polystyrene, polyetheretherketone, polyvinyl chloride, polyamide, polyimide, polyester, teflon, or thermoplastic silicone.

Further, the stress buffer layer is a thermoplastic elastomer.

Further, the thermoplastic elastomer includes rubber, thermoplastic polyurethane, a styrenic thermoplastic elastomer, a polyolefin thermoplastic elastomer, a thermoplastic elastomer based on halogenated polyolefin, a polyether ester thermoplastic elastomer, a polyamide thermoplastic elastomer, and an ionomer thermoplastic elastomer.

Further, the stress buffer layer is constituted by natural hot-melt adhesive or synthetic hot-melt adhesive.

Further, the synthetic hot-melt adhesive is an ethylene-vinylacetate copolymer, polyethylene, polypropylene, polyamide, polyester, or polyurethane.

Further, the stress buffer layer is constituted by pressure-sensitive adhesive.

Further, a stress buffer layer is disposed between the substrate and the artificial structure layer, and the substrate is tightly laminated with the reflection layer; or the substrate is tightly laminated with the artificial structure layer, and a stress buffer layer is disposed between the substrate and the reflection layer; or a stress buffer layer is separately disposed between the substrate and the artificial structure layer and between the substrate and the reflection layer.

In addition, a technical problem to be solved by the embodiments of the present invention is a defect in the prior art that no signal can be sent and received due to warpage on a reflection surface.

An embodiment of the present invention provides a reflective array surface, where the reflective array surface includes a functional board that is configured to perform beam modulation on an incident electromagnetic wave and a reflection layer that is disposed on one side of the functional board and is configured to reflect an electromagnetic wave, where the functional board includes two or more functional board units and the reflection layer includes reflection units, where the number of reflection units corresponds to the number of functional board units, where the functional board unit and a reflection unit corresponding to the functional board constitute a phase-shifting unit that used for phase shifting; and the reflection layer is attached to a surface of the one side of the functional board, and the reflection layer is a metallic layer with an anti-warpage pattern, where the anti-warpage pattern can suppress warpage of the reflection layer relative to the functional board.

Further, the reflection layer is a metallic layer with an electric conduction characteristic or a non-electric conduction characteristic.

Further, the reflection layer is a metallic layer with a slit groove-shaped anti-warpage pattern.

Further, the reflection layer is a metallic layer with a hole-shaped anti-warpage pattern.

Further, the hole-shaped anti-warpage pattern includes a circular hole-shaped anti-warpage pattern, an oval hole-shaped anti-warpage pattern, a polygonous hole-shaped anti-warpage pattern, and a triangular hole-shaped anti-warpage pattern.

Further, the reflective array surface is configured to modulate an electromagnetic wave having a wide-beam pattern to an electromagnetic wave having a narrow-beam pattern; or modulate an electromagnetic wave having a narrow-beam pattern to an electromagnetic wave having a wide-beam pattern; or change a main beam direction of an electromagnetic wave pattern.

Further, the reflective array surface works at wave band Ku and a thickness of a substrate unit is 0.5-4 mm; or the reflective array surface works at wave band X and a thickness of a substrate unit is 0.7-6.5 mm; or the reflective array surface works at wave band C and a thickness of a substrate unit is 1-12 mm.

According to the reflective array surface in the present invention, a phase-shifting amount of each phase-shifting unit on the reflective array surface is designed to implement a focusing capability of the reflective array surface for an incident electromagnetic wave within a predefined angle range, so that the reflective array surface can have multiple focuses, that is, can focus a received electromagnetic wave at a different latitude, and therefore the reflective array surface may be used in a different region within a certain latitude range.

In addition, an embodiment of the present invention further provides a reflective array antenna. The reflective array antenna includes the foregoing reflective array surface.

Further, the reflective array antenna further includes a feed, where the feed can move relative to the reflective array surface, so as to perform beam scanning.

Further, the reflective array antenna further comprises a feed, where both a symmetry axis of the reflective array surface and a central axis of the feed are within a first plane, where the reflective array surface may rotate relative to an antenna mounting surface, and the feed can perform beam scanning within the first plane to receive a focused electromagnetic wave.

Further, the reflective array antenna further includes a servo system, where the servo system is configured to control the feed to move relative to the reflective array surface, so as to perform beam scanning.

Further, the reflective array antenna further includes a servo system, where the servo system is configured to control the reflective array surface to rotate relative to the antenna mounting surface and is configured to control the feed to move within the first plane to perform beam scanning.

Further, the reflective array antenna further includes the feed and a mounting rack that is configured to support the feed and the reflective array surface, where the mounting rack includes a rotary mechanism that is configured to enable the reflective array surface to rotate relative to the antenna mounting surface and a beam scanning mechanism that is configured to enable the feed to perform beam scanning within the first plane.

Further, the rotary mechanism includes a through-hole disposed at a center of an antenna array surface and a rotation axis disposed in the through-hole, where one end of the rotation axis is inserted into the antenna mounting surface.

Further, the beam scanning mechanism includes a bearing rod, where one end of the bearing rod is fixedly connected to a rear side of the reflective array surface, a feed clamping part that is connected to the feed and is flexibly connected to the other end of the bearing rod, and a fastener that can fasten the bearing rod on the antenna mounting surface, where at least one sliding groove is disposed on one end of the bearing rod that is connected to the feed clamping part, along an axial direction, a regulating groove intersected with the sliding groove is disposed on the feed clamping part, and at least one adjusting bolt passes through the regulating groove and the sliding groove in sequence, so as to tightly lock and fix a relative location of the feed clamping part and the bearing rod.

Further, the feed clamping part is a U-shaped spring plate, the feed is inserted into an arc-shaped region of the U-shaped spring plate, and a set screw passes through two extension arms of the U-shaped spring plate and squeezes the two extension arms to clamp and fix the feed.

Further, the fastener includes a presser disposed on an outer surface of the bearing rod and screws that respectively pass through two ends of the presser to enter the antenna mounting surface.

Further, the reflective array surface is parallel to the antenna mounting surface, where the antenna mounting surface is a vertical surface, a horizontal surface, or a skewed surface.

Further, the vertical surface is a vertical wall.

Further, the horizontal surface is level ground or a horizontal roof.

Further, the skewed surface is inclined ground, an inclined roof, or an inclined wall.

Further, the reflective array antenna is a transmit antenna, a receive antenna, or a transceiver antenna.

Further, the reflective array antenna is a satellite television receiving antenna, a satellite communications antenna, a microwave antenna, or a radar antenna.

In addition, in view of a defect in the prior art that dimensions of a phase-shifting unit must be greater than 1/6 of a wavelength of an electromagnetic wave in a phase modulation process, still another technical problem to be solved by the embodiments of the present invention is to provide a reflective array antenna.

An embodiment of the present invention provides a reflective array antenna, including: a functional board, configured to perform beam modulation on an incident electromagnetic wave, where the functional board includes two or more functional board units that have a phase-shifting function, where the functional board unit includes a substrate unit and at least one artificial structure unit that is disposed on one side of the substrate unit and generates an electromagnetic response to an incident electromagnetic wave; and a reflection layer, configured to reflect an electromagnetic wave and disposed on one side that is of the functional board and is opposite to the artificial structure unit, where a distance between geometrical centers of two neighboring functional board units is less than 1/7 of a wavelength of an incident electromagnetic wave.

Further, a distance between geometrical centers of two neighboring functional board units is the same.

According to the reflective array antenna in the present invention, a same reflective array antenna can receive, by means of rotation of a reflective array surface and beam scanning of a feed within a first plane, an incident electromagnetic wave within a predefined angle range, so that the reflective array antenna may be applied in multiple types of occasions, for example, applied to a satellite television antenna. A same type of satellite television antenna can cover one latitude range, so that the antenna can work normally within the latitude range. A relatively wide latitude region can be covered by using several limited types of satellite television antennas, and universality is strong. In addition, that the feed performs beam scanning within the first plane may also be controlled by using a servo system, which makes it easier to implement automation of pointing the antenna to a satellite.

In addition, the present invention further provides a communication-in-motion antenna, where the communication-in-motion antenna includes a servo system and the foregoing reflective array antenna.

Further, the servo system is configured to control a feed to move relative to a reflective array surface, so as to perform beam scanning.

Further, the servo system is configured to control a reflective array surface to rotate relative to an antenna mounting surface and is configured to control a feed to move within a first plane to perform beam scanning.

Further, a mobile carrier of the communication-in-motion antenna is a car, a ship, an airplane, or a train.

Further, the antenna mounting surface is a top surface of a car or a top surface of a front cabinet cover of a car.

Further, the antenna mounting surface is a top surface of a control room of a ship or a hull side of a ship.

Further, the antenna mounting surface is a top surface of an airframe of an airplane, an airframe side of an airplane, or a top surface of an airfoil of an airplane.

Further, the antenna mounting surface is a top surface of a train or a side of a train.

According to the communication-in-motion antenna in the present invention, a same reflective array antenna can receive, by means of rotation of a reflective array surface and beam scanning of a feed within a first plane, an incident electromagnetic wave within a predefined angle range, and a same type of antenna can cover one latitude range, so that the communication-in-motion antenna can work normally within the latitude range. Moreover, a required servo system is of a simple structure and can be easily controlled, which makes it easy to control costs. In addition, the reflective array surface is attached onto an antenna mounting surface. Therefore, relative to a traditional communication-in-motion antenna, a volume and weight of the entire communication-in-motion antenna may be decreased. The communication-in-motion antenna may be widely applied to a mobile carrier such as a car, a ship, an airplane, and a train.

Moreover, according to the reflective array surface modulating an electromagnetic wave radiation pattern and the antenna in the present invention, a difference value between a maximum phase-shifting amount and a minimum phase-shifting amount is less than 360 degrees for all phase-shifting units on the reflective array surface. An expected electromagnetic wave radiation pattern is implemented by designing a phase-shifting amount of each phase-shifting unit on the reflective array surface. For a reflective array antenna in the prior art, it is clearly pointed out that an expected electromagnetic wave radiation pattern of an antenna can be obtained only when a maximum phase-shifting range of a phase-shifting unit of the antenna reaches at least 360 degrees. That is, up to now, in the technical field, technicians generally consider that an expected electromagnetic wave radiation pattern of an antenna can be obtained only when a maximum phase-shifting range of a phase-shifting unit of the antenna reaches at least 360 degrees, which leads people to consider that an expected electromagnetic wave radiation pattern of an antenna cannot be obtained when a maximum phase-shifting range of an phase-shifting unit of the antenna is less than 360 degrees. This is a technical prejudice that always exists in the technical field. The antenna in the present invention exactly solves the technical prejudice.

Moreover, according to the reflective array antenna in the present invention, a distance between geometrical centers of neighboring functional board units in the reflective array antenna is less than 1/7 of a wavelength of an incident electromagnetic wave. Then a required exit phase of the reflective array antenna is implemented by designing dimensions and/or a structure of an artificial structure unit disposed on a substrate unit of the reflective array antenna. In the prior art, it is clearly pointed out that, when dimensions of a phase-shifting unit (equivalent to the distance between the geometrical centers of the neighboring functional board units in the present invention) reduce from a half-wavelength to 1/6 of a wavelength of an incident electromagnetic wave, a phase modulation capability of an array reflection surface formed by a single layer of phase-shifting units becomes poor and cannot meet a requirement. In the present invention, a requirement can be met by reducing a distance between geometrical centers of neighboring functional board units to 1/7 of a wavelength of an incident electromagnetic wave and by using only one functional layer. Moreover, bandwidth is wider than bandwidth in the prior art, a thickness is thinner, a phase modulation amplitude is smoother, and stability is better.

Moreover, in the present invention, an anti-warpage pattern of a reflection layer is designed, so that the reflection layer not only can reflect an electromagnetic wave within a working frequency band of a reflective array surface or a reflection antenna, but also has an anti-warpage function. An overall coverage rate of the reflection layer is reduced by designing the reflection layer, thereby releasing stress between a functional board and the reflection layer. This avoids occurrence of warpage.

Moreover, in the present invention, a stress buffer layer is disposed between a substrate and an artificial structure layer and/or between the substrate and a reflection layer. The stress buffer layer can reduce a surface smoothness change resulting from a different coefficient of thermal expansion between different materials, so that the reflection layer and/or the artificial structure layer are on a relatively smooth plane, thereby reducing occurrence of warpage and decreasing a product defective rate and maintenance costs.

BRIEF DESCRIPTION OF DRAWINGS

The following further details the present invention with reference to accompanying drawings and embodiments. In the accompanying drawings.

EMBODIMENTS

Figure 1:
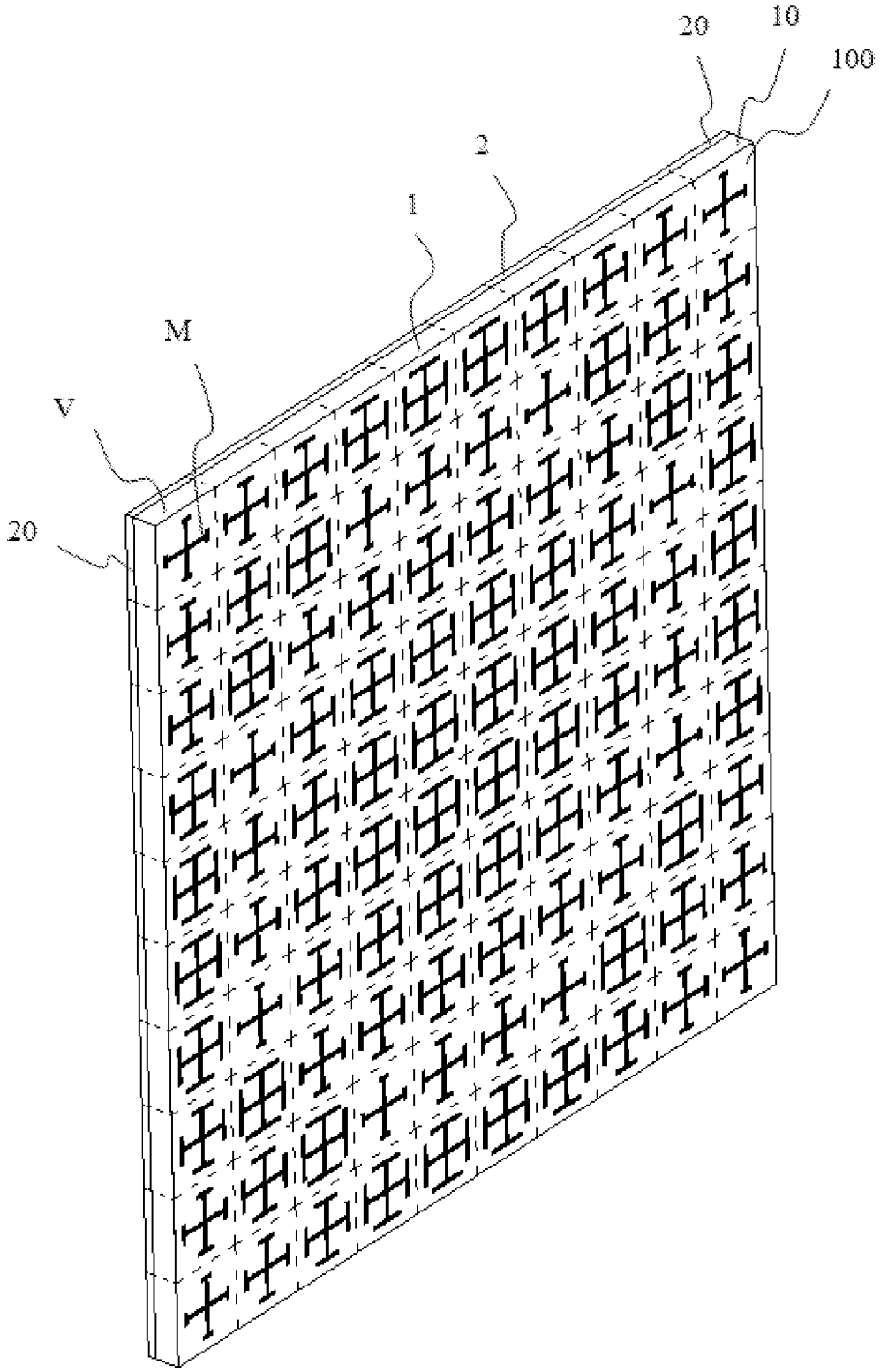
FIG. 1 is a schematic three-dimensional structural diagram of a reflective array surface according to an exemplary implementation manner of the present invention.

As shown in FIG. 1, the reflective array surface RS according to the present invention includes a functional board 1 that is configured to perform beam modulation on an incident electromagnetic wave and a reflection layer 2 that is disposed on one side of the functional board 1 and is configured to reflect an electromagnetic wave, where the functional board 1 includes two or more functional board units 10 and the reflection layer 2 includes reflection units 20, where the number of reflection units 20 corresponds to the number of functional board units 10, where the functional board unit 10 and a reflection unit 20 corresponding to the functional board unit 10 constitute a phase-shifting unit 100 that is used for phase shifting. According to such a phase-shifting design scheme, an overall phase-shifting effect of the reflective array surface is not exquisite enough and a beam modulation capability for an electromagnetic wave is poor, thereby affecting bandwidth and working performance of the reflective array antenna.

Moreover, a phase-shifting amount of each phase-shifting unit 100 on the reflective array surface RS is designed, so that the reflective array surface RS has a focusing capability for an incident electromagnetic wave within a predefined angle range, where the predefined angle range is formed between the incident electromagnetic wave and a normal direction of the reflective array surface. Therefore, the reflective array surface can have multiple focuses and can be applied in a different environment or region.

The following describes the reflective array surface with reference to the reflective array antenna in the present invention. It should be understood that an application scope of the reflective array surface in the present invention is not limited to a reflective array antenna and can also be another occasion in which multi-focus reflection focusing needs to be used.

Figure 25:
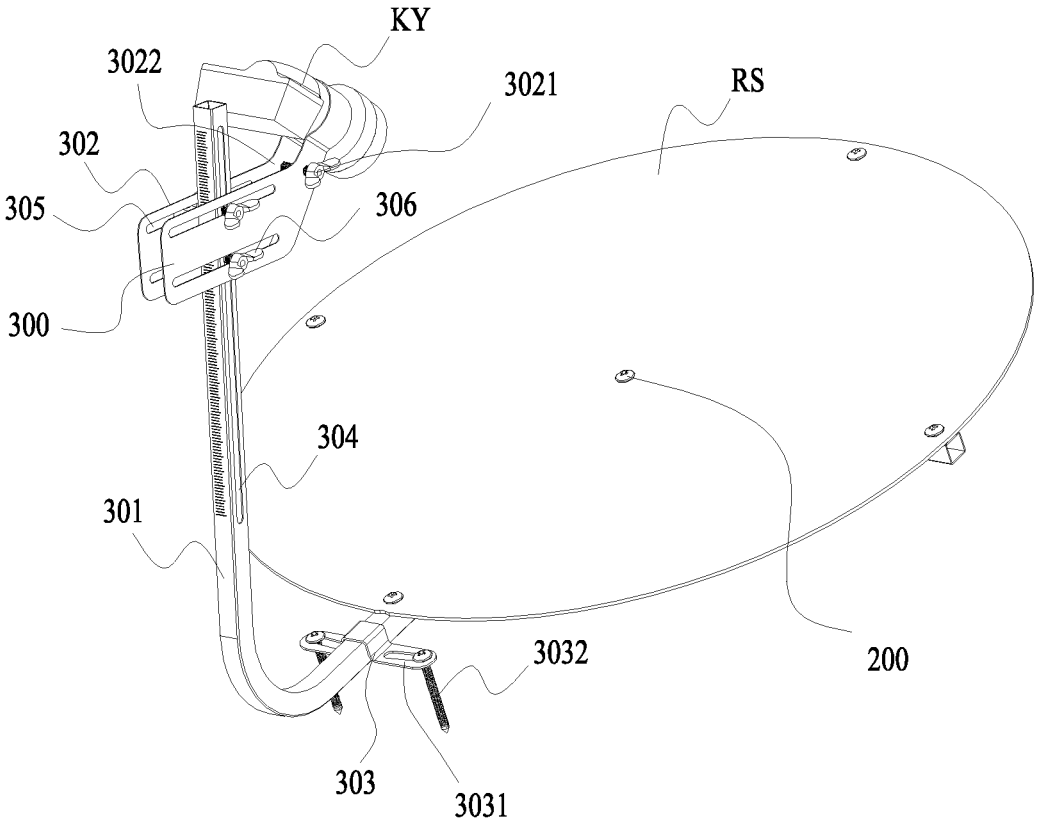
FIG. 25 is a schematic structural diagram of a reflective array antenna having a form of mounting rack.
Figure 26:
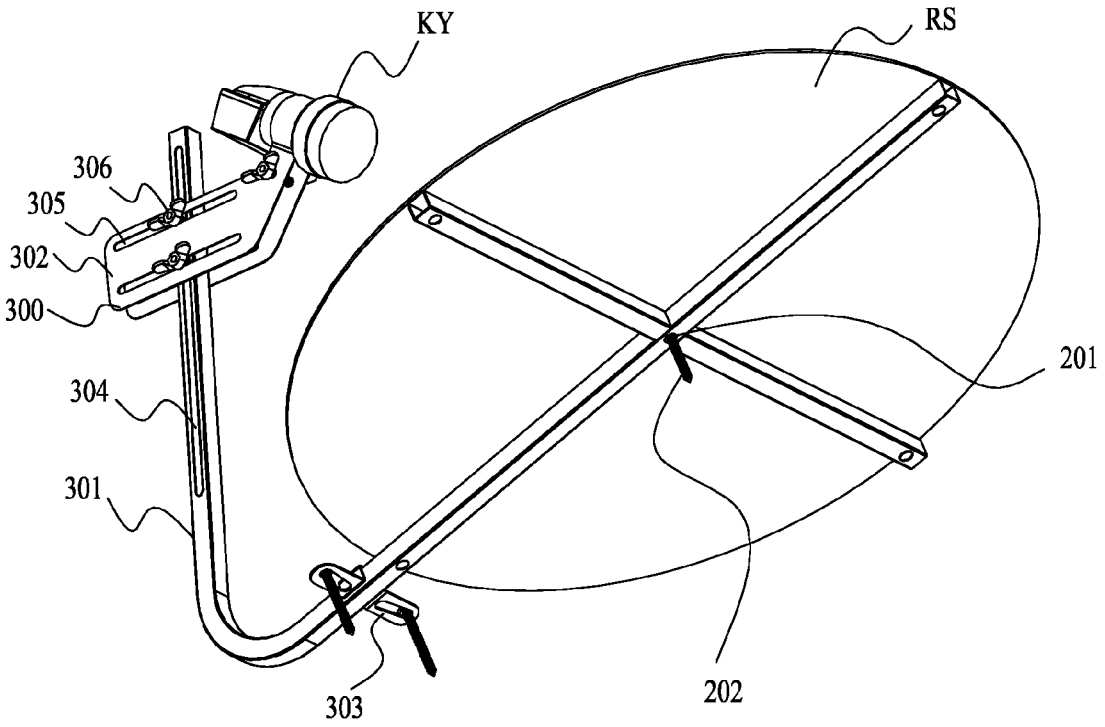
FIG. 26 is another view of FIG. 25.

As shown in FIG. 25 and FIG. 26, a reflective array antenna provided by an embodiment of the present invention includes a feed KY and a reflective array surface RS, where the feed KY can move relative to the reflective array surface RS, so as to perform beam scanning.

In one embodiment of the present invention, the reflective array surface RS is fixed, and the feed KY can three-dimensionally move relative to the reflective array surface RS, so as to perform beam scanning.

In one exemplary embodiment of the present invention, both a symmetry axis of the reflective array surface RS and a central axis of the feed are within a first plane, where the reflective array surface RS may rotate relative to an antenna mounting surface, the reflective array surface RS has a focusing capability for an incident electromagnetic wave within a predefined angle range, and the feed KY can perform beam scanning within the first plane to receive a focused electromagnetic wave. In the embodiment, for example, the feed may be a corrugated horn. The symmetry axis of the reflective array surface RS refers to a phase-shifting distribution symmetry axis of the reflective array surface RS, that is, phase-shifting amounts distributed on two parts that are of the reflective array surface and are located on both sides of the symmetry axis are the same. The foregoing predefined angle range, for example, may be 0-70 degrees, that is, the reflective array surface has a focusing capability for an incident electromagnetic wave within an angle range of 0-70 degrees, where the angle range is formed between the incident electromagnetic wave and a normal direction of the reflective array surface; the predefined angle range may also be 10-60 degrees, that is, the reflective array surface has a focusing capability for an incident electromagnetic wave within an angle range of 10-60 degrees, where the angle range is formed between the incident electromagnetic wave and a normal direction of the reflective array surface; the predefined angle range may also be 20-50 degrees, that is, the reflective array surface has a focusing capability for an incident electromagnetic wave within an angle range of 20-50 degrees, where the angle range is formed between the incident electromagnetic wave and a normal direction of the reflective array surface; or the predefined angle range may also be 30-40 degrees, that is, the reflective array surface has a focusing capability for an incident electromagnetic wave within an angle range of 30-40 degrees, where the angle range is formed between the incident electromagnetic wave and a normal direction of the reflective array surface.

Referring to FIG. 1, FIG. 1 is a schematic three-dimensional structural diagram of a reflective array surface according to one exemplary implementation manner of the present invention. In FIG. 1, the reflective array surface includes a functional board 1 that is configured to perform beam modulation on an incident electromagnetic wave and a reflection layer 2 that is disposed on one side of the functional board 1 and is configured to reflect an electromagnetic wave.

In the embodiment, the functional board 1 includes two or more functional board units 10, the reflection layer 2 includes reflection units 20, where the number of reflection units 20 corresponds to the number of functional board units 10, and the functional board unit 10 and a reflection unit 20 corresponding to the functional board unit 10 constitute a phase-shifting unit 100 that is used for phase shifting. It may be understood that the reflective array surface may be formed by putting multiple independent phase-shifting units 100 together, or may be constituted by one entire functional board 1 and one entire reflection layer 2.

An incident electromagnetic wave entering the phase-shifting unit 100 is reflected by the reflection unit 20 after passing through the functional board unit 10. A reflected electromagnetic wave exits after passing through the functional board unit 10 again. An absolute value of a difference value between an exit phase and an incident phase is a phase-shifting amount. In the embodiment, a phase-shifting amount of each phase-shifting unit on the reflective array surface is symmetrically distributed along a symmetry axis of the reflective array surface.

The number of functional board units 10 is set according to a requirement, and may be two or more, for example, may be two, where the two functional board units 10 are side by side, in a 2×2 array, a 10×10 array, a 100×100 array, a 1000×1000 array, a 10000×10000 array, or the like.

In the present invention, preferably, a difference value between a maximum phase-shifting amount and a minimum phase-shifting amount is less than 360 degrees for all phase-shifting units on the reflective array surface, and a phase-shifting amount of each phase-shifting unit 100 on the reflective array surface is designed to implement a focusing capability of the reflective array surface for an incident electromagnetic wave within a predefined angle range. The reflective array surface herein is one of devices modulating an electromagnetic wave radiation pattern, and can implement the focusing capability of the reflective array surface for the incident electromagnetic wave within the predefined angle range. Certainly, another expected electromagnetic wave radiation pattern may be further obtained by designing a phase-shifting amount of each phase-shifting unit on the reflective array surface, which, what's more, can be implemented in a case that the difference value between the maximum phase-shifting amount and the minimum phase-shifting amount is less than 360 degrees for all phase-shifting units 100 on the reflective array surface.

Partial phase-shifting units have a too large phase-shifting amount; and as a result, not all phase-shifting units of the device have a difference value of less than 360 degrees between a phase-shifting amount and the minimum phase-shifting amount. However, when the number of phase-shifting units with the difference value between the phase-shifting amount and the minimum phase-shifting amount less than 360 degrees in all the phase-shifting units accounts for more than 80% of the total number of phase-shifting units, an effect in this case is basically the same as an effect when the difference value between the phase-shifting amount and the minimum phase-shifting amount is less than 360 degrees for all the phase-shifting units.

Certainly, the difference value between the maximum phase-shifting amount and the minimum phase-shifting amount may also be greater than 360 degrees for all phase-shifting units 100 on the reflective array surface. A phase-shifting amount distribution on the reflective array surface RS may also be obtained by using a method recorded in an existing document, so as to implement a focusing capability of the reflective array surface for an incident electromagnetic wave within a predefined angle range.

An electromagnetic wave is reflected by the reflection layer 2 after passing through the functional board unit 10. A reflected electromagnetic wave exits after passing through the functional board unit 10 again. A distance between geometrical centers of any two neighboring functional board units 10 in the reflective array antenna is less than 1/7 of a wavelength of an incident electromagnetic wave. This overcomes a defect in the prior art that dimensions of a phase-shifting unit must be greater than 1/6 of a wavelength of an electromagnetic wave in a phase modulation process. Optionally, in the embodiment of the present invention, a distance between geometrical centers of any two neighboring functional board units 10 is less than 1/8 of a wavelength of an incident electromagnetic wave. More preferably, a distance between geometrical centers of any two neighboring functional board units 10 is less than 1/10 of a wavelength of an incident electromagnetic wave. For example, the distance between the geometrical centers of the any two neighboring functional board units 10 may be 1/7, 1/8, 1/9, 1/10, or the like of the wavelength of the incident electromagnetic wave.

Figure 22:
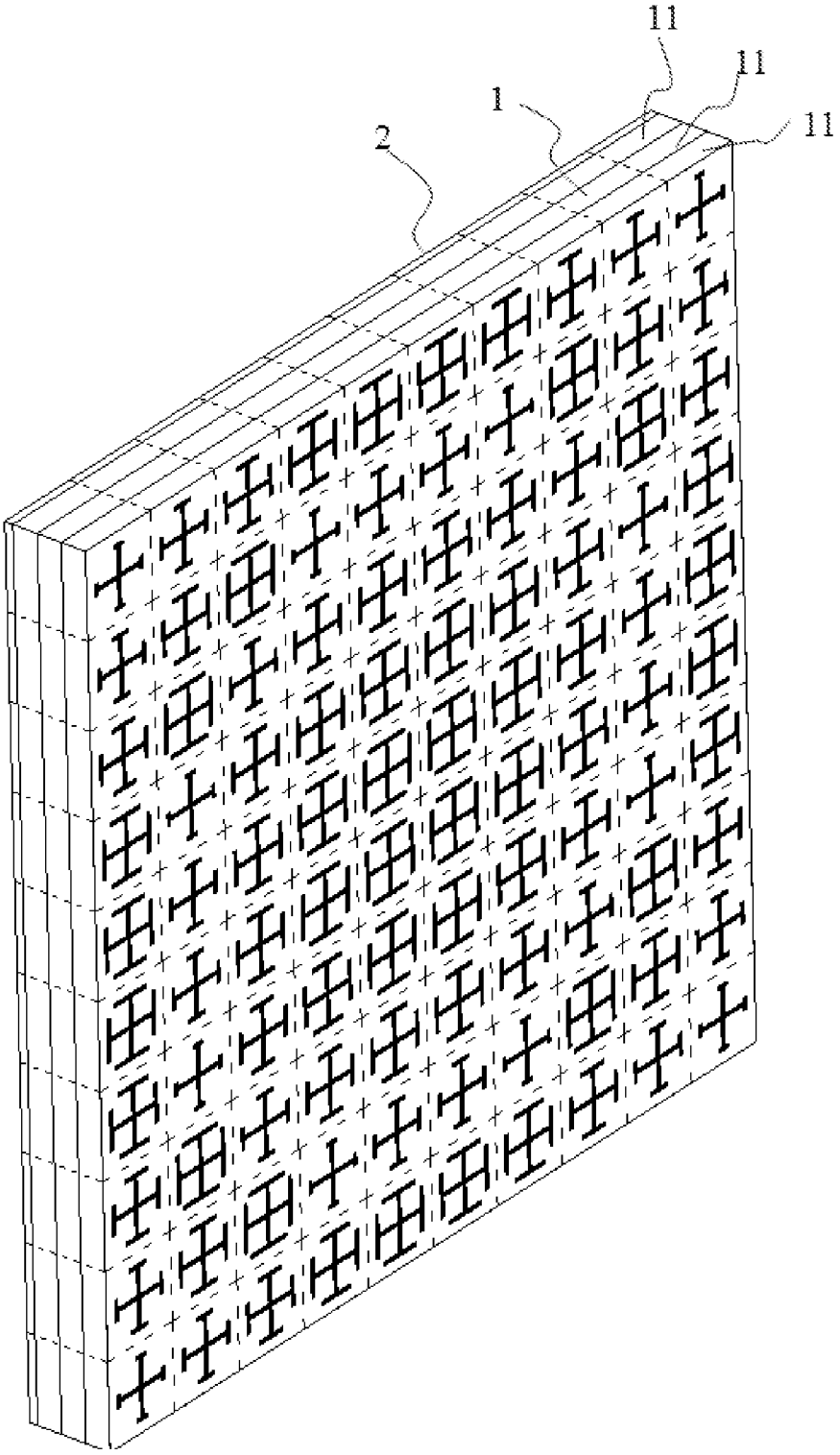
FIG. 22 is a schematic structural diagram of a reflective array antenna having multiple layers of functional boards according to the present invention.

The functional board of the reflective array surface in the present invention may be a one-layer structure shown in FIG. 1 or a multi-layer structure constituted by multiple lamellae. The multiple lamellae may be bonded by using glue, or may be connected in a mechanical manner, for example, connected by using a bolt or connected by using a fastener. FIG. 22 shows a functional board 1 with a multi-layer structure. The functional board 1 includes three lamellae 11. Certainly, FIG. 22 is only for exemplary description. The functional board 1 in the present invention may also be a two-layer structure constituted by two lamellae or a multi-layer structure constituted by more than four lamellae. As shown in FIG. 22, a stress buffer layer between the reflection layer and the functional board is not shown (whether to dispose the stress buffer layer may be determined according to a requirement).

A phase-shifting amount of a single phase-shifting unit may be obtained through measurement by using the following method:

periodically arranging, in space, a phase-shifting unit to be tested to form a large enough combination, where the large enough combination refers to that dimensions (a length and a width) of a formed periodic combination are far greater than dimensions of the phase-shifting unit to be tested, for example, the formed periodic combination includes at least 100 phase-shifting units to be tested; and emitting a planar wave into the periodic combination at a vertical angle, using a near-field scanning device to scan a phase distribution in a near-field electric field, and substituting a scanning result into an array theory formula according to an exit phase:

$$\phi = -\frac{2\pi}{\lambda} a \sin\theta;$$

A phase-shifting amount Ø of the tested phase-shifting unit may be obtained.

In the foregoing formula, θ is an exit phase; λ is a wavelength of an incident electromagnetic wave; and a is dimensions of a phase-shifting unit, where the dimensions of the phase-shifting unit refer to a side length of a picture formed by projecting the phase-shifting unit onto the reflection layer, that is, a distance between geometrical centers of two neighboring functional board units.

Likewise, a phase-shifting amount distribution on the reflective array surface may be obtained by measuring all phase-shifting units on the reflective array surface.

Figure 3:
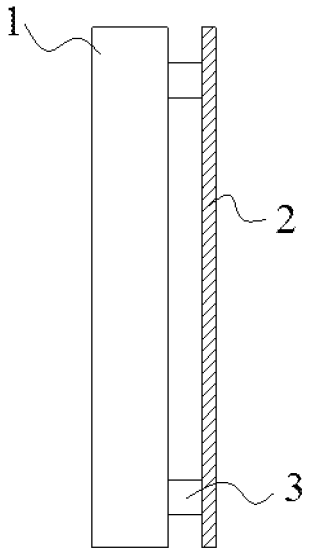
FIG. 3 is a schematic side view of a reflective array surface according to another exemplary implementation manner of the present invention.

The reflection layer 2 in the present invention may be tightly attached to a surface of the one side of the functional board 1, as shown in FIG. 1, for example, the reflection layer 2 is tightly attached to the surface of the one side of the functional board 1 in multiple common connection manners, such as bonding by using glue and mechanical connection. The reflection layer 2 and the functional board 1 may also be disposed at a certain distance, as shown in FIG. 3. FIG. 3 is a schematic side view of a reflective array surface according to another exemplary implementation manner of the present invention. A size of the spacing distance may be set according to an actual requirement. The reflection layer 2 and the functional board 1 may be connected by using a support kit 3, or may be connected by padding foam, rubber, or the like between the reflection layer 2 and the functional board 1.

The reflection layer 2 may be an entire piece of sheet metal or a metallic grid reflection layer, or may be a metallic coating coated on the one side of the functional board 1 or a metallic film covered on the one side of the functional board 1. For the sheet metal, the metallic coating, the metallic film, or the metallic grid reflection layer, a metallic material, such as cooper, aluminum, or iron, may be selected for use.

Optionally, in the embodiment of the present invention, the reflection layer 2 may be a metallic layer with an anti-warpage pattern, where the anti-warpage pattern can suppress warpage of the reflection layer relative to the functional board. For example, the reflection layer 2 is a metallic layer with a slit groove-shaped anti-warpage pattern. The reflection layer may also be a metallic layer with a hole-shaped anti-warpage pattern. The hole-shaped anti-warpage pattern herein includes but is not limited to a circular hole-shaped anti-warpage pattern, an oval hole-shaped anti-warpage pattern, a polygonous hole-shaped anti-warpage pattern, a regular polygon hole-shaped anti-warpage pattern, and a triangular hole-shaped anti-warpage pattern. An exemplary design of the reflection layer 2 is that the reflection layer 2 is a metallic grid reflection layer with a metallic grid anti-warpage pattern.

A metal coverage rate of the reflection layer 2 is reduced by designing the anti-warpage pattern of the reflection layer 2, thereby releasing stress between the functional board 1 and the reflection layer 2. This avoids occurrence of warpage.

Figure 4:
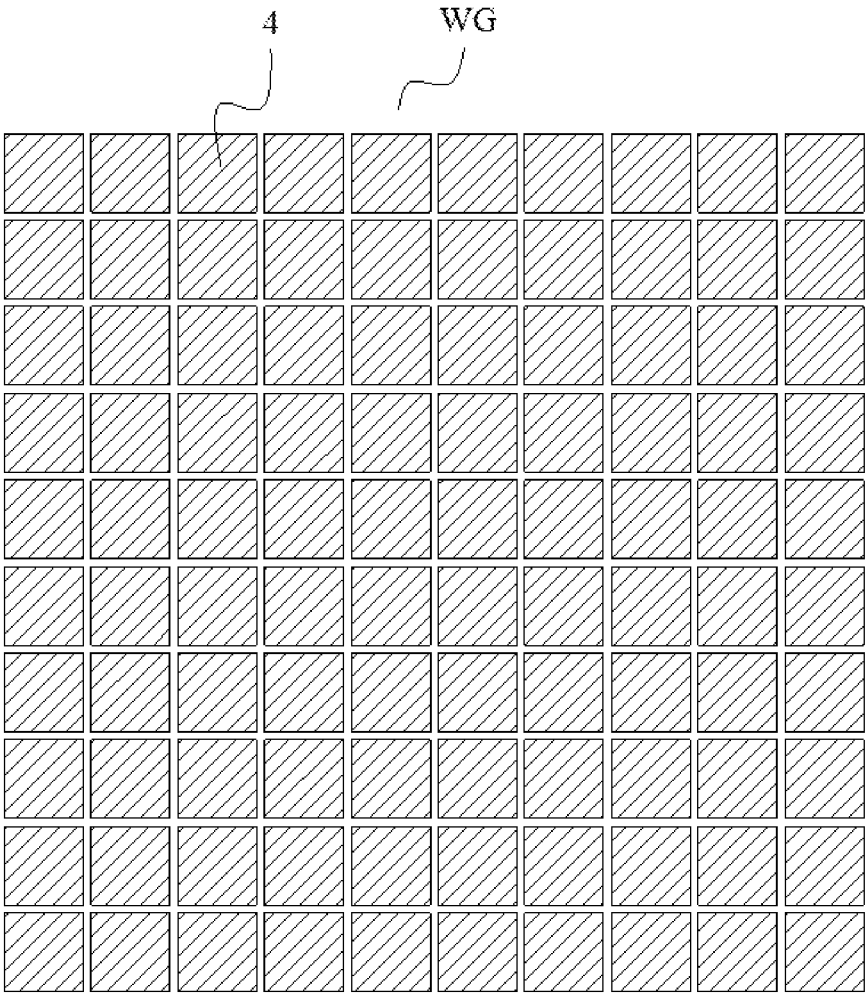
FIG. 4 is a schematic structural diagram of a reflection layer according to an exemplary implementation manner.
Figure 21:
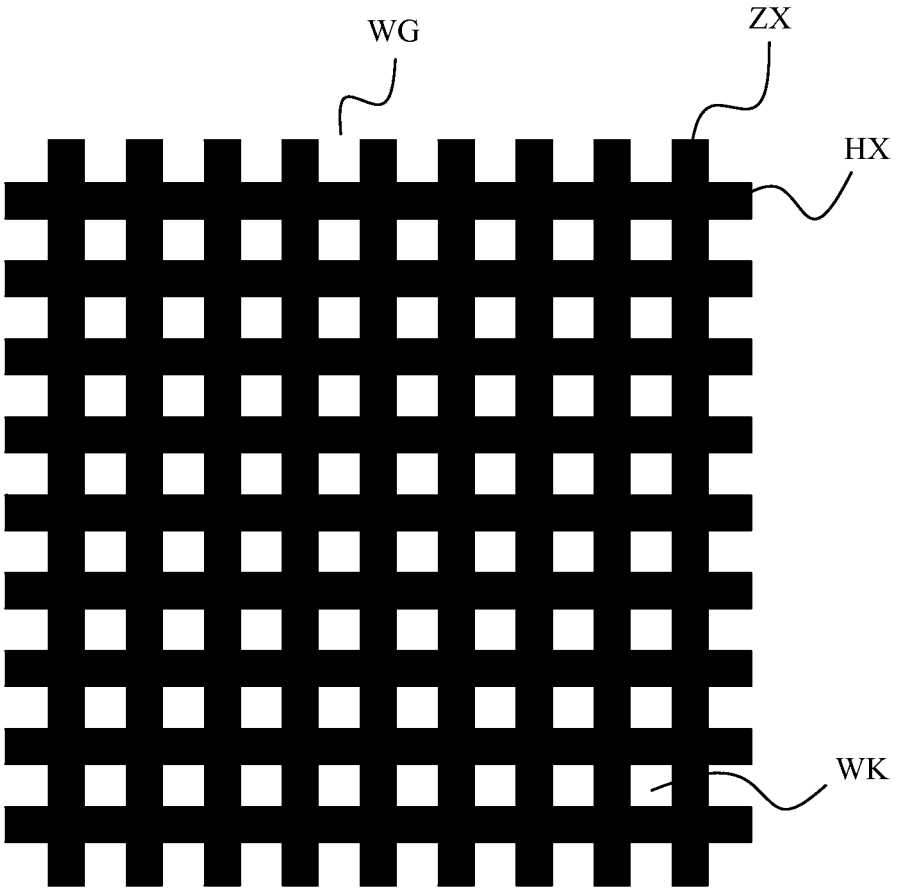
FIG. 21 is a schematic structural diagram of a metallic grid reflection layer with a lattice structure.

From a perspective of electric conduction, the reflection layer 2 in the embodiment of the present invention may be a metallic layer with an electric conduction characteristic, or may be a metallic layer with a non-electric conduction characteristic. The following provides multiple examples of the reflection layer. Both the metallic layer with a slit groove-shaped anti-warpage pattern and the metallic layer with a hole-shaped anti-warpage pattern are electrically conductive. Therefore, FIG. 33 to FIG. 38 are a metallic layer with an electric conduction characteristic separately. A metallic grid reflection layer shown in FIG. 4 is a metallic layer with a non-electric conduction characteristic. A metallic grid reflection layer shown in FIG. 21 is a metallic layer with an electric conduction characteristic. Electric conduction herein means that metal is connected on a metallic layer. If metal is not connected on a metallic layer, the metallic layer is not electrically conducive, as shown in FIG. 4. A concept of electric conduction is a known concept in a circuit design field, and therefore is not detailed herein again.

When an entire piece of sheet metal, a metallic coating, or a metallic film is used as the reflection layer, generally, a thickness of the sheet metal, metallic coating, or metallic film is relatively thin, about 0.01-0.03 millimeters, and a length and a width of the metallic layer, metallic coating, or metallic film are far greater than the thickness of the sheet metal, metallic coating, or metallic film. Therefore, warpage may easily occur due to stress in preparation and actual applications. On one hand, a yield in a product preparation process is decreased, thereby causing a lot of waste. On the other hand, maintenance costs after a product is used are also increased.

In the present invention, the reflection layer 2 preferably uses a metallic grid reflection layer. The metallic grid reflection layer is constituted by multiple pieces of mutually spaced sheet metal, and a difference between a length value and a thickness value and a difference between a width value and the thickness value are reduced for each piece of sheet metal, thereby reducing product stress and avoiding warpage of the reflection layer. However, a slit exists between the multiple pieces of sheet metal. Therefore, if a width of the slit is too wide, a grating lobe effect is generated when an electromagnetic wave is reflected by a grid reflection board, thereby affecting performance of the reflective array surface; if a width of the slit is too narrow, the difference between the length value and the thickness value and the difference between the width value and the thickness value increase for each piece of sheet metal, which is not conducive to stress releasing. Preferably, a mutual spacing between the multiple pieces of sheet metal is less than 1/20 of a wavelength of an electromagnetic wave corresponding to a central frequency of a working frequency band of the reflective array surface.

In the present invention, a shape of a single piece of sheet metal is a triangle or a polygon.

In one exemplary embodiment, as shown in FIG. 4, the metallic grid reflection layer WG is constituted by multiple pieces of mutually spaced sheet metal 4. A shape of a single piece of sheet metal is a square.

Figure 39:
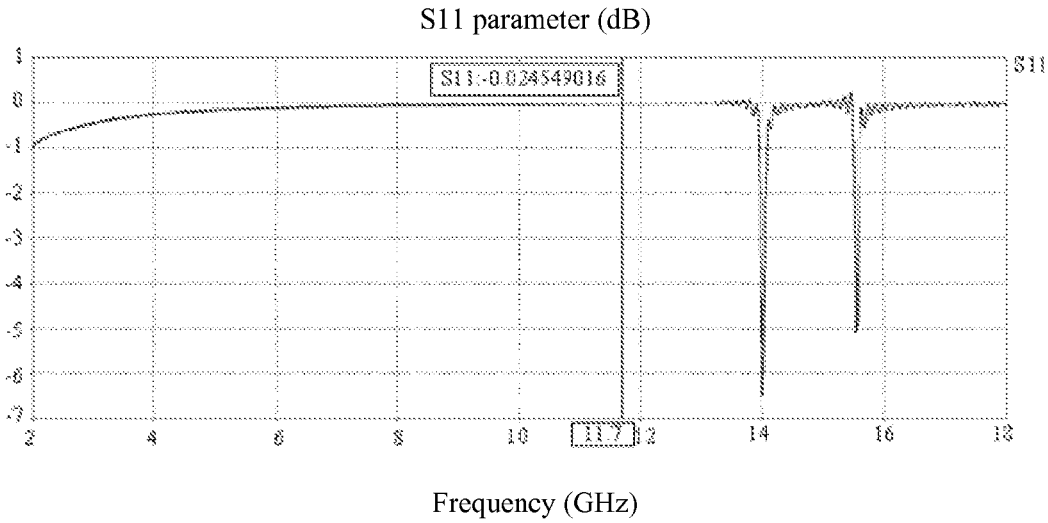
FIG. 39 and FIG. 40 are schematic diagrams showing an S11 parameter of a reflection layer of a reflective array antenna, where the reflection layer is a metallic grid reflection layer constituted by sheet metal.
Figure 40:
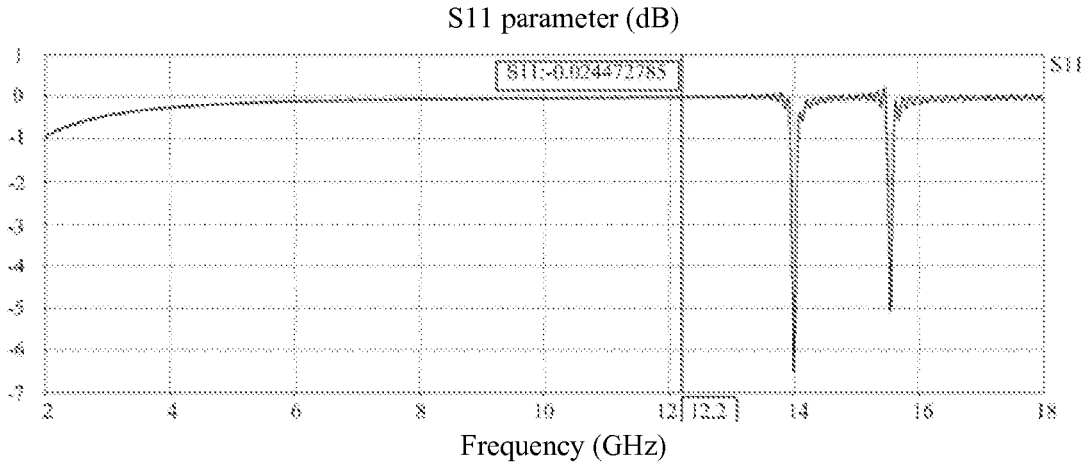

Simulation is performed on the reflection layer in the reflective array antenna, where the reflection layer is the metallic grid reflection layer WG shown in FIG. 4. A side length of a piece of square sheet metal is 19 mm and a width of a slit between two pieces of sheet metal is 0.5 mm. A simulation diagram of a corresponding reflection coefficient S11 is shown in FIG. 39 and FIG. 40. Within a working frequency band range of 11.7-12.2 GHz, when a frequency is 11.7 GHz, S11=0.0245 dB; and when a frequency is 12.2 GHz, S11=0.0245 dB.

Figure 43:
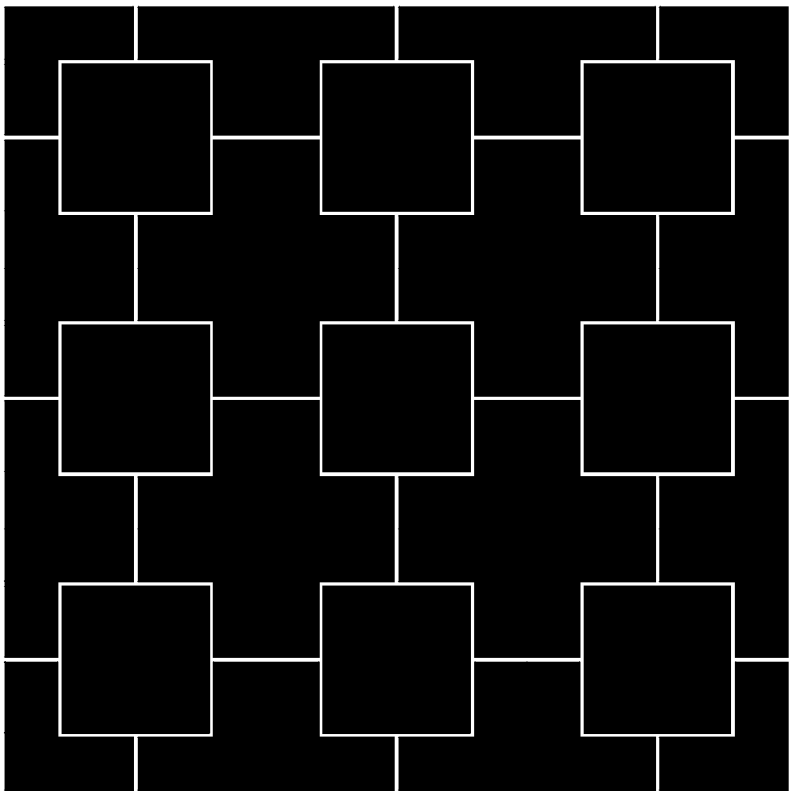
FIG. 43 is a schematic diagram of a metallic layer with a slit groove-shaped anti-warpage pattern.

FIG. 43 shows a reflection layer with different sheet metal, where a part displayed in black is metal and a blank part is a disposed groove. As shown in the figure, square sheet metal and cross sheet metal are included, and a slit is between sheet metal. Actually, the reflection layer may also be considered as a reflection layer with a slit groove-shaped anti-warpage pattern. A quadrangular groove shown in FIG. 43 is disposed on an entire piece of sheet metal, and a straight-line groove is disposed between midpoints of neighboring parallel edges of neighboring square grooves, which constitutes a reflection layer design scheme in the figure.

Figure 44:
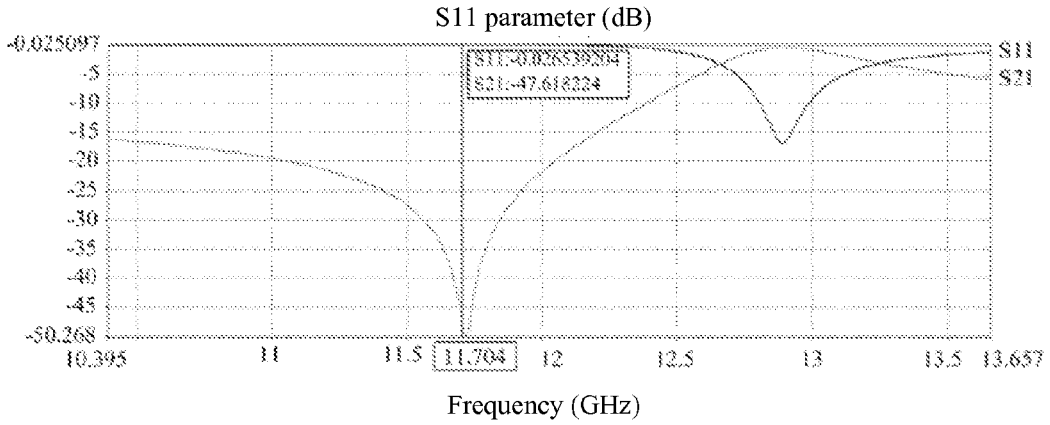
FIG. 44 and FIG. 45 are schematic diagrams showing an S parameter of a reflection layer of a reflective array antenna, where the reflection layer is shown in FIG. 43.
Figure 45:
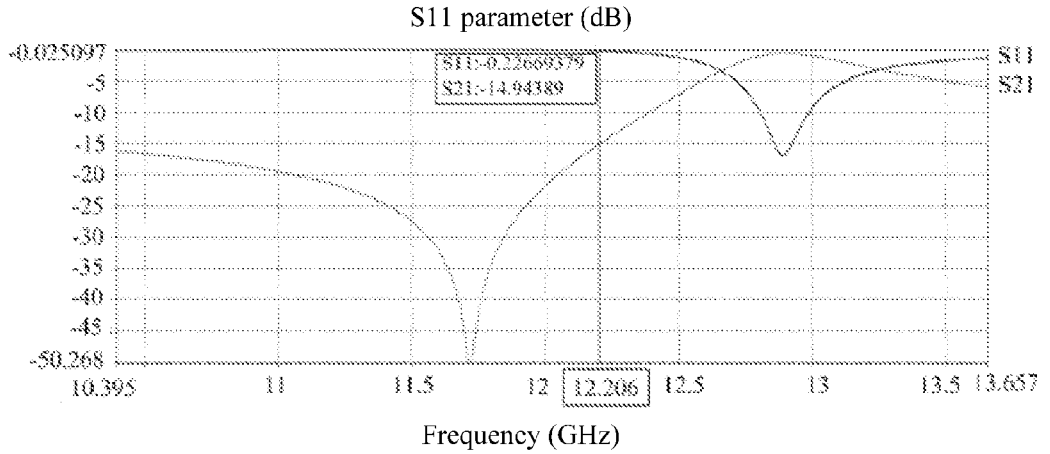

Simulation is performed on the reflection layer in the reflective array antenna, where the reflection layer is a reflection layer with a pattern shown in FIG. 43. A side length of a piece of square sheet metal is 6.9 mm, a width of a slit between a piece of square sheet metal and a neighboring piece of cross sheet metal is 0.2 mm. A width of a slit between two neighboring pieces of cross sheet metal is 0.2 mm, and a length of the slit is 1.75 mm. A simulation diagram of a corresponding reflection coefficient S11 is shown in FIG. 44 and FIG. 45. Within a working frequency band range of 11.7-12.2 GHz, when a frequency is 11.7 GHz, S11=0.0265 dB; and when a frequency is 12.2 GHz, S11=0.022669 dB.

In another exemplary embodiment, as shown in FIG. 21, the metallic grid reflection layer WG is a mesh structure that is constituted by crisscrossing multiple metallic wires and has multiple mesh holes. The multiple metallic wires in the figure are divided into vertical metallic wires ZX and horizontal metallic wires HX. Multiple mesh holes WK are formed between the vertical metallic wire ZX and the horizontal metallic wire HX. A shape of a single mesh hole WK may be a triangle or a polygon. Moreover, shapes of all mesh holes WK may be the same or may be different.

In the embodiment shown in FIG. 21, preferably, the shapes of all mesh holes WK are a square, and a wire width of the vertical metallic wire ZX is the same as a wire width of the horizontal metallic wire HX. A side length of the single mesh hole is less than ½ of a wavelength, and a wire width of the multiple metallic wires is equal to or greater than 0.01 mm. Preferably, the side length of the single mesh hole ranges from 0.01 mm to ½ of a wavelength of an electromagnetic wave corresponding to a central frequency of a working frequency band of an antenna, and the wire width of the multiple metallic wires ranges from 0.01 mm to five multiples of the wavelength of the electromagnetic wave corresponding to the central frequency of the working frequency band of the antenna.

Figure 41:
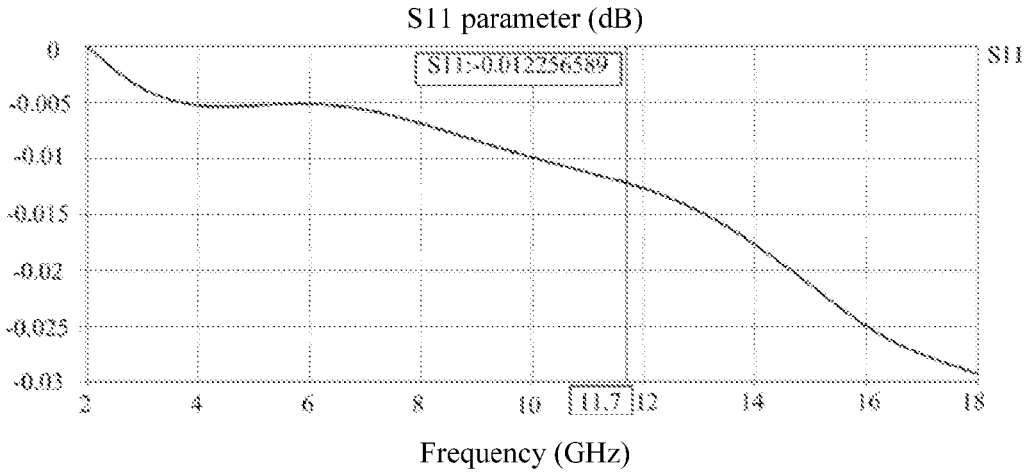
FIG. 41 and FIG. 42 are schematic diagrams showing an S11 parameter of a reflection layer of a reflective array antenna, where the reflection layer is a metallic grid reflection layer with multiple square mesh holes.
Figure 42:
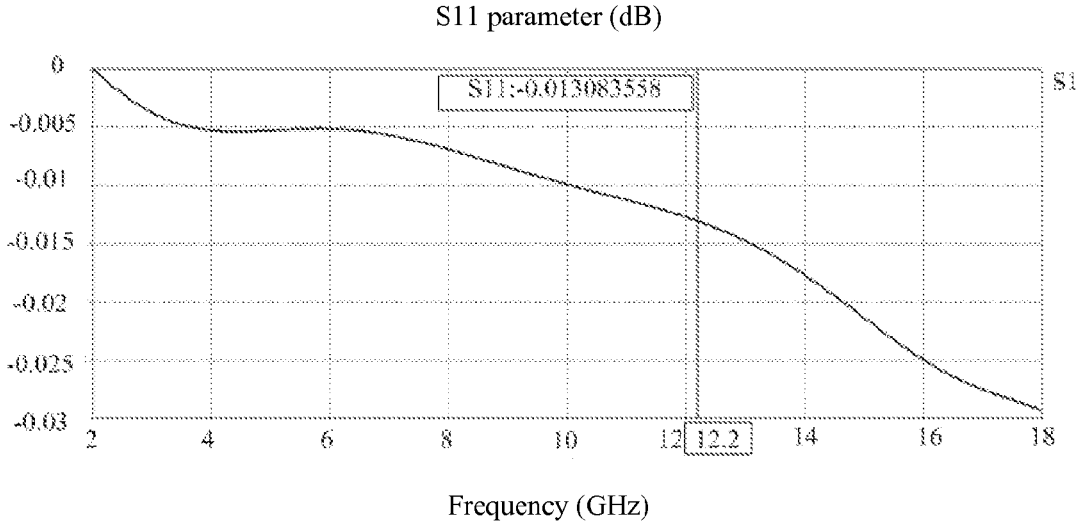

Simulation is performed on the reflection layer in the reflective array antenna, where the reflection layer is the metallic grid reflection layer WG shown in FIG. 21. A side length of a square mesh hole is 1 mm and a wire width of a metallic wire is 0.8 mm. A simulation diagram of a corresponding reflection coefficient S11 is shown in FIG. 41 and FIG. 42. Within a working frequency band range of 11.7-12.2 GHz, when a frequency is 11.7 GHz, S11=0.01226 dB; and when a frequency is 12.2 GHz, S11=0.01308 dB.

The foregoing simulation results show that, when the reflection layer design scheme in the present invention is used, a reflection coefficient S11 is almost close to zero, that is, an electromagnetic wave can be basically totally reflected, so that not only a warpage problem is solved but also electrical performance and reflection performance are not affected.

For a reflective array antenna with a side length of 450 mm, the following compares warpage states of a reflection layer fully cladded by copper, a reflection layer shown in FIG. 4, a reflection layer shown in FIG. 21, and a reflection layer shown in FIG. 43. A warpage rate corresponding to the reflection layer fully cladded by copper is 3.2%, that is, a maximum deformation amount of an edge of the reflective array antenna is 14.4 mm. A warpage rate corresponding to a square plate shown in FIG. 4 is 2.6%, that is, a maximum deformation amount of an edge of the reflective array antenna is 11.7 mm. A warpage rate corresponding to the reflection layer shown in FIG. 43 is 2.4%, where the reflection layer is constituted by different sheet metal and has a slit with a certain width, that is, a maximum deformation amount of an edge of the reflective array antenna is 10.8 mm. A warpage rate corresponding to a structure shown in FIG. 21 is 0.81%, where the structure is constituted by multiple metallic wires and has a square mesh hole, that is, a maximum deformation amount of an edge of the reflective array antenna is 3.65 mm. It may be seen that a larger metal coverage rate corresponds to a higher warpage rate. Therefore, a reflection layer pattern is reasonably designed to reduce a metal coverage rate as much as possible in a case that electrical performance and a reflection requirement of the antenna are met. In this way, a warpage phenomenon is reduced and even eliminated.

Figure 33:
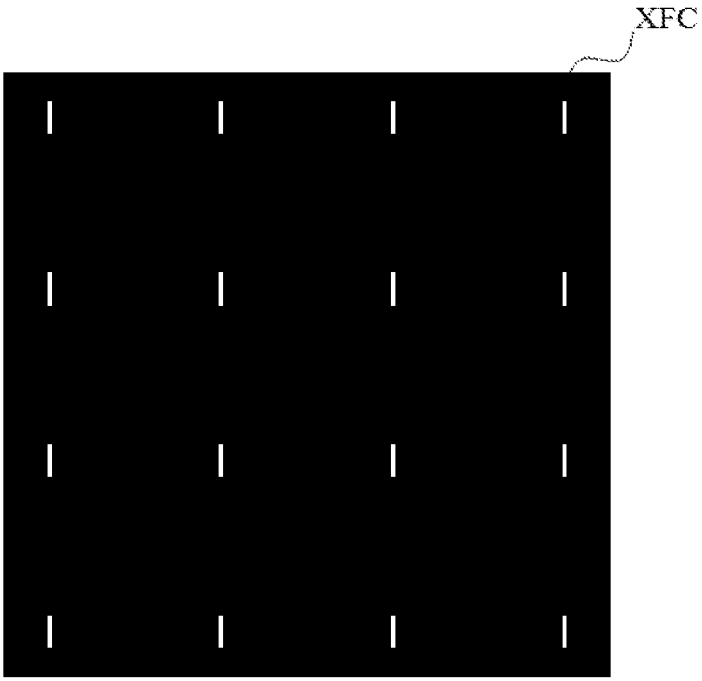
FIG. 33 and FIG. 34 are schematic diagrams of a reflection layer with a slit groove-shaped anti-warpage pattern.
Figure 34:
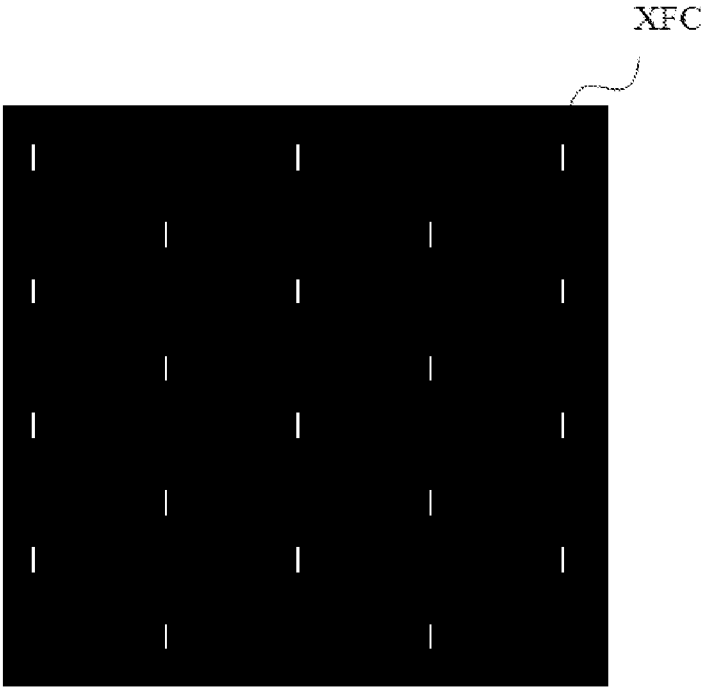

FIG. 33 and FIG. 34 show a design in which the reflection layer 2 is a metallic layer with a slit groove-shaped anti-warpage pattern. Multiple slit grooves XFC, shown in FIG. 33 and FIG. 34, are designed on an entire piece of sheet metal or on a metallic coating. The slit grooves XFC are arranged in an array manner. A black part in the figure is metal and a blank location is a slit groove. In this way, an anti-warpage purpose is also achieved under a precondition that electrical performance and reflection performance of the reflective array antenna are met. Certainly, a slit groove-shaped anti-warpage pattern with another form and layout may be designed according to the idea as long as required reflection performance and electrical performance of the antenna are met.

Figure 35:
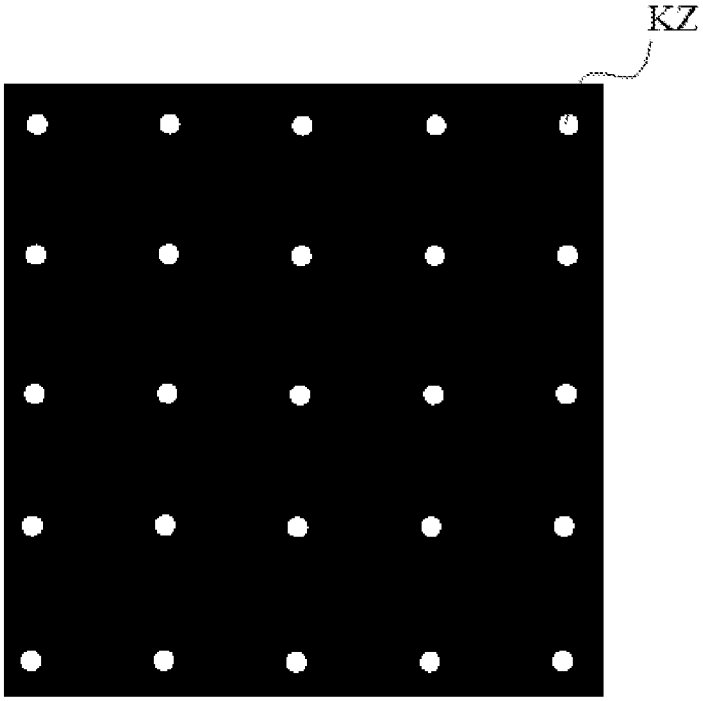
FIG. 35 to FIG. 38 are schematic diagrams of a metallic layer with a hole-shaped anti-warpage pattern.
Figure 36:
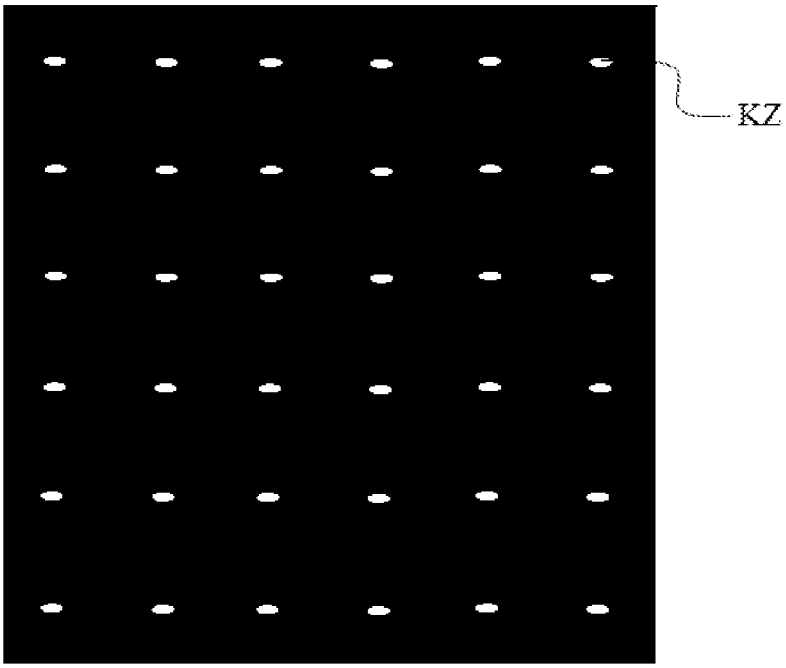
Figure 37:
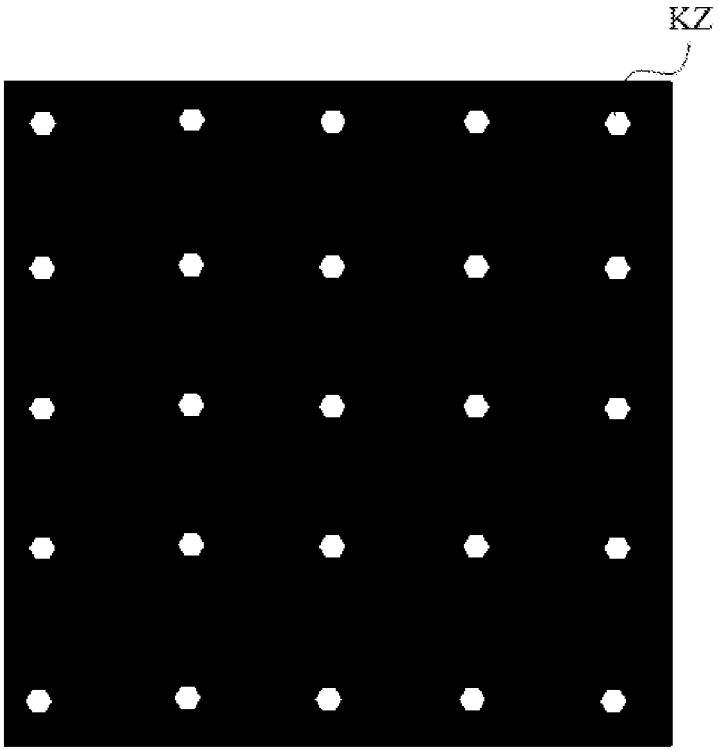
Figure 38:
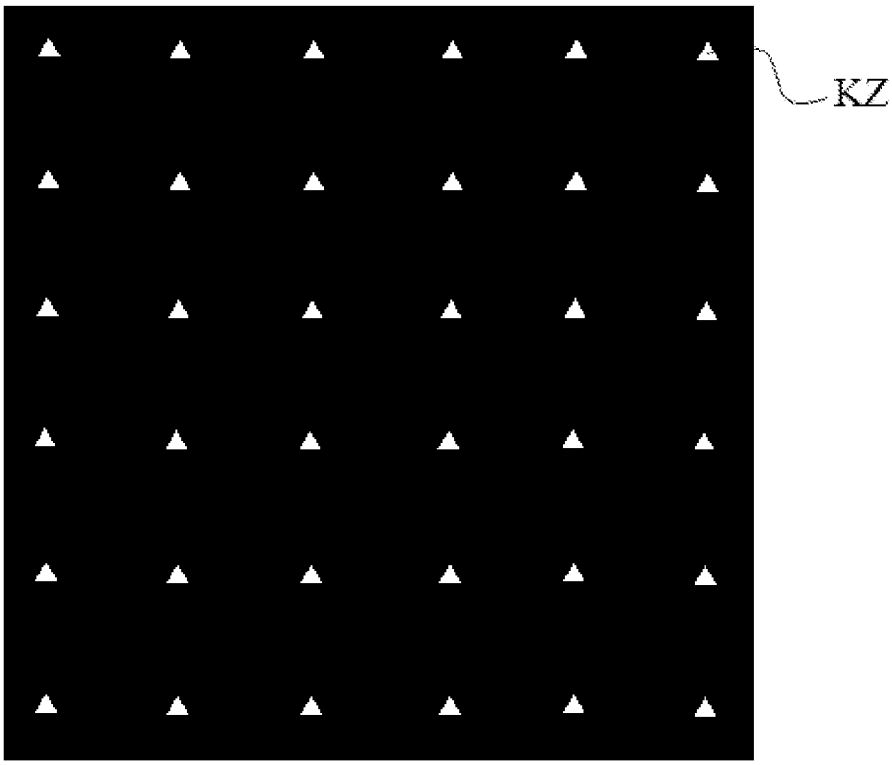

The reflection layer 2 may also be a metallic layer with a hole-shaped anti-warpage pattern. FIG. 35 to FIG. 38 show a design in which the reflection layer 2 is a metallic layer with a hole-shaped anti-warpage pattern. The hole-shaped anti-warpage pattern includes a circular hole-shaped anti-warpage pattern KZ (as shown in FIG. 35), an oval hole-shaped anti-warpage pattern KZ (as shown in FIG. 36), a polygonous hole-shaped anti-warpage pattern KZ (a regular hexagon is used as an example, as shown in FIG. 37), and a triangular hole-shaped anti-warpage pattern KZ (a regular triangle is used as an example, as shown in FIG. 38). The quantity, layout, and size of slits and holes are not limited in the present invention, as long as electrical performance and a reflection requirement of the antenna can be met.

In the foregoing reflection layer description, a metallic material is used as a reflection layer material. However, it should be known that the reflection layer in the present invention is configured to reflect an electromagnetic wave. Therefore, any material capable of reflecting an electromagnetic wave is an optional material for the reflection layer in the present invention. An anti-warpage pattern of the reflection layer is designed, so that the reflective array surface and the reflection layer of the reflective array antenna in the present invention not only can reflect an electromagnetic wave within a working frequency band of a reflection antenna, but also have an anti-warpage function. An overall coverage rate of the reflection layer is reduced by designing the reflection layer, thereby releasing stress between a functional board and the reflection layer. This avoids occurrence of warpage. An antenna generally receives or sends a signal. An antenna with a required function may be obtained by designing a phase-shifting amount distribution on an antenna according to a required radiation pattern.

To ensure a smooth surface of the reflective array surface, reduce occurrence of warpage, and decrease a product defective rate and maintenance costs, at least one stress buffer layer may be further disposed between a substrate and an artificial structure layer and/or between the substrate and the reflection layer. The foregoing described functional board is an entirety of the substrate and the artificial structure layer that is disposed on one side of the substrate and has an electromagnetic response to an electromagnetic wave. The reflection layer is disposed on the other side of the substrate. Herein, the stress buffer layer may be disposed between the substrate S and the artificial structure layer. The stress buffer layer may also be disposed between the functional board and the reflection layer (that is, between the substrate and the reflection layer).

Figure 46:
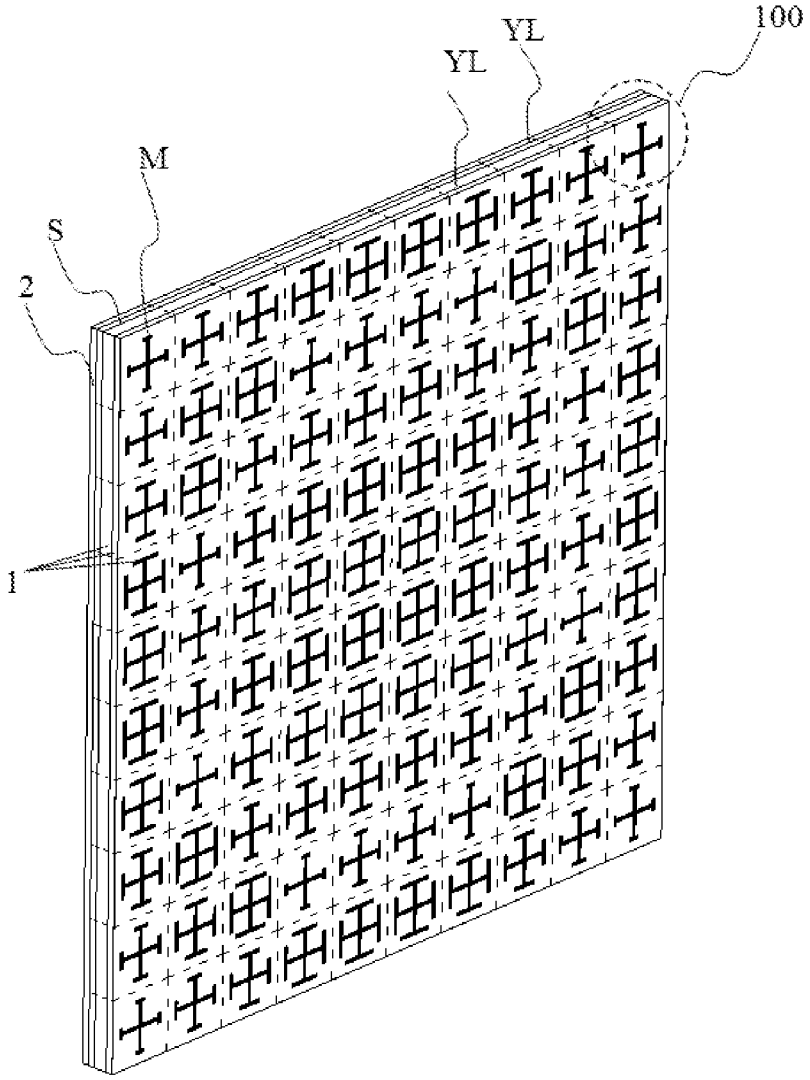
FIG. 46 is an optional schematic three-dimensional structural diagram of a reflective array antenna according to an embodiment of the present invention.
Figure 47:
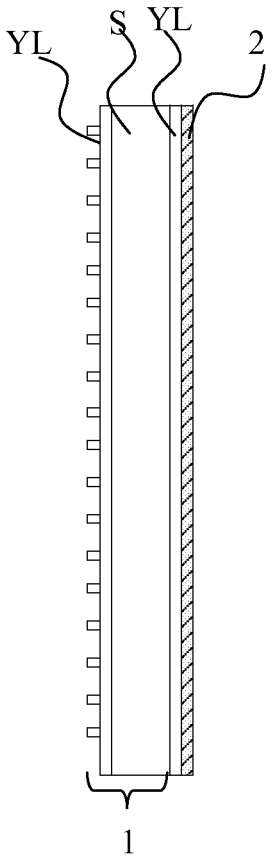
FIG. 47 is a sectional view of a reflective array antenna shown in FIG. 46.

FIG. 46 and FIG. 47 are a schematic three-dimensional structural diagram and a sectional view of a reflective array surface/a reflective array antenna according to one exemplary implementation manner of the present invention respectively. As an exemplary example, the reflective array surface/the reflective array antenna includes a substrate S, an artificial structure layer that is disposed on one side of the substrate S and has an electromagnetic response to an electromagnetic wave, and a reflection layer 2 that is disposed on the other side of the substrate S and is configured to reflect an electromagnetic wave. At least one stress buffer layer YL is disposed between the substrate S and the artificial structure layer, and at least one stress buffer layer YL is disposed between the substrate and the reflection layer. One stress buffer layer is shown in the figure, which is intended to be exemplary description rather than limiting. Multiple stress buffer layers may also be superposed together. In FIG. 47, for ease of exemplary description, a small block of protrusion is used to indicate an artificial structure unit M. At least one or more artificial structure units M are arranged on the artificial structure layer. The stress buffer layer YL may be disposed between the substrate S and the artificial structure layer and between the substrate and the reflection layer separately; or the stress buffer layer may be disposed only between the substrate S and the artificial structure layer or between the substrate and the reflection layer, that is, the stress buffer layer is disposed between the substrate and the artificial structure layer and the substrate is tightly laminated with the reflection layer, or the substrate is tightly laminated with the artificial structure layer and the stress buffer layer is disposed between the substrate and the reflection layer. The present invention poses no limitation thereon. The stress buffer layer YL between the substrate S and the artificial structure layer and the stress buffer layer YL between the substrate 2 and the reflection layer 2 may use a same or a different material.

In one exemplary embodiment of the present invention, tensile strength of the stress buffer layer YL is less than tensile strength of the substrate S, and an elongation at break of the stress buffer layer YL is greater than an elongation at break of the artificial structure layer and an elongation at break of the reflection layer 2. When the foregoing condition is met, the stress buffer layer may be made from a thermoplastic resin material or a modified material of the thermoplastic resin material. The thermoplastic resin material is polyethylene, polypropylene, polystyrene, polyetheretherketone, polyvinyl chloride, polyamide, polyimide, polyester, teflon, ABS (acrylonitrile butadiene styrene, Acrylonitrile Butadiene Styrene), or thermoplastic silicone.

Preferably, the stress buffer layer may be a thermoplastic elastomer. The thermoplastic elastomer includes rubber, thermoplastic polyurethane, a styrenic thermoplastic elastomer, a polyolefin thermoplastic elastomer, a thermoplastic elastomer based on halogenated polyolefin, a polyether ester thermoplastic elastomer, a polyamide thermoplastic elastomer, and an ionomer thermoplastic elastomer.

Preferably, the stress buffer layer is constituted by hot-melt adhesive. The hot-melt adhesive may be natural hot-melt adhesive or synthetic hot-melt adhesive. The synthetic hot-melt adhesive is an ethylene-vinylacetate copolymer (ethylene-vinyl acetate copolymer, hereinafter referred to as EVA), polyvinyl chloride (PVC), polyethylene, polypropylene, polypropylene, polyamide, polyester, or polyurethane.

Preferably, the stress buffer layer is constituted by pressure-sensitive adhesive.

In an exemplary embodiment, the substrate is made from polystyrene (PS), the stress buffer layer YL is disposed between the substrate S and the artificial structure layer and between the substrate S and the reflection layer 2 separately, a material of the stress buffer layer YL is made from the thermoplastic elastomer, hot-melt adhesive, or pressure-sensitive adhesive. In general, a metallic material, for example, copper, is preferably selected for the artificial structure layer and the reflection layer. An elongation at break of copper is 5%. An elongation at break of a PS substrate is less than 1% and tensile strength is 40 MPa. An elongation at break of selected hot-melt adhesive is 100% and tensile strength is 5 MP.

If a difference between a thermal expansion coefficient of a selected substrate and a thermal expansion coefficient of metal selected for the artificial structure layer or reflection layer is too large, a requirement for the stress buffer layer is higher and a corresponding elongation at break is higher.

Figure 49:
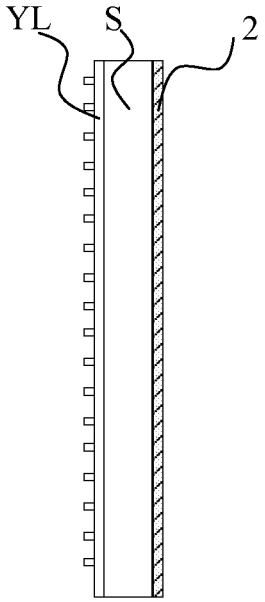
FIG. 49 is a sectional view of a reflective array antenna with another structure according to an embodiment of the present invention.

For ease of description, in a case that the reflective array surface or reflective array antenna is disposed with a stress buffer layer, the substrate S, the artificial structure layer, and the stress buffer layer YL between the substrate S and the reflection layer 2 are called a functional board 1 as a whole. The stress buffer layer YL may also not be disposed between the substrate S and the reflection layer 2, and the stress buffer layer YL is disposed only between the substrate S and the artificial structure layer, as shown in FIG. 49. For the solving a warpage problem by designing a reflection layer, details have been described above. In FIG. 49, for ease of exemplary description, a small block of protrusion is used to indicate an artificial structure unit M. At least one or more artificial structure units M are arranged on the artificial structure layer.

Figure 48:
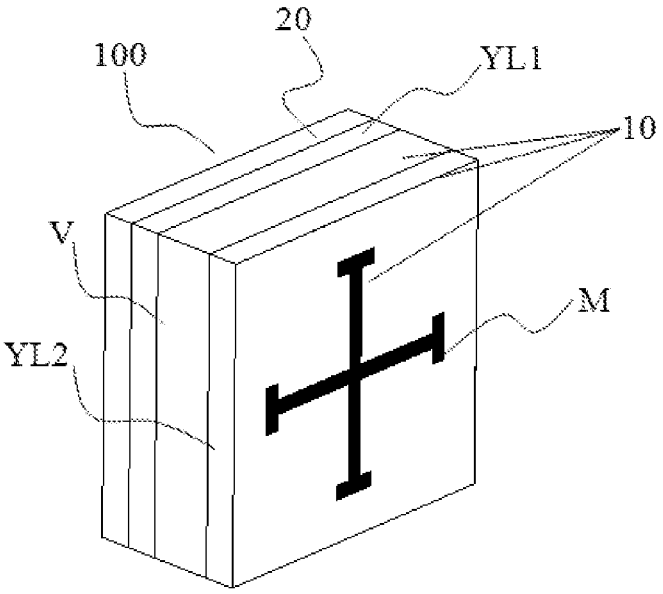
FIG. 48 is a schematic structural diagram of a form of phase-shifting unit.

In a case that the reflective array surface or reflective array antenna is disposed with a stress buffer layer, it may be known according to FIG. 46 and FIG. 48 that the functional board 1 includes two or more functional board units 10 and the reflection layer 2 includes reflection units 20, where the number of reflection units 20 corresponds to the number of functional board units 10. The functional board unit 10, the reflection unit 20 corresponding to the functional board unit 10, and partial YL1 of a corresponding stress buffer layer disposed between the functional board unit 10 and the reflection unit 20 together constitute a phase-shifting unit 100 that is used for phase shifting. It may be understood that the reflective array antenna may be formed by putting multiple independent phase-shifting units 100 together, or may be constituted by one entire functional board 1 and one entire reflection layer 2.

Figure 23:
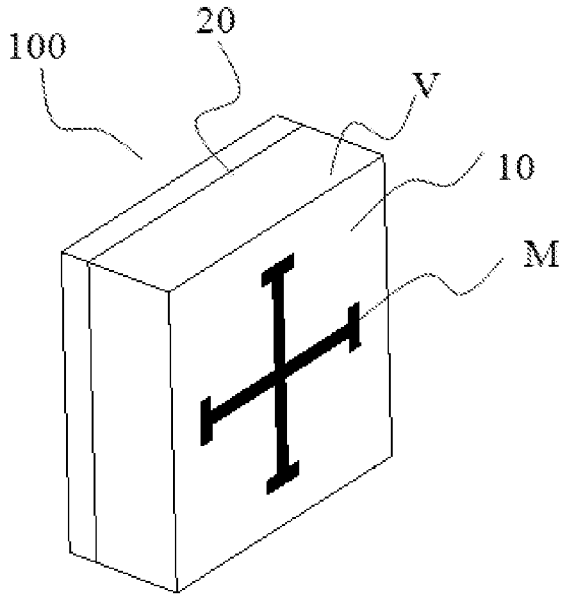
FIG. 23 is a schematic structural diagram of a form of phase-shifting unit.

The functional board unit in the present invention may be implemented by using the following two schemes:

A first scheme is that, as shown in FIG. 1, the functional board unit 10 includes a substrate unit V and an artificial structure unit M that is disposed on one side of the substrate unit V and is configured to generate an electromagnetic response to an incident electromagnetic wave. The artificial structure unit M may be directly attached to a surface of the substrate unit V, as shown in FIG. 23.

Certainly, the artificial structure unit M and a surface of the substrate unit V may also be disposed at a distance, for example, the artificial structure unit M may be supported on the substrate unit by using a pole.

Figure 2:
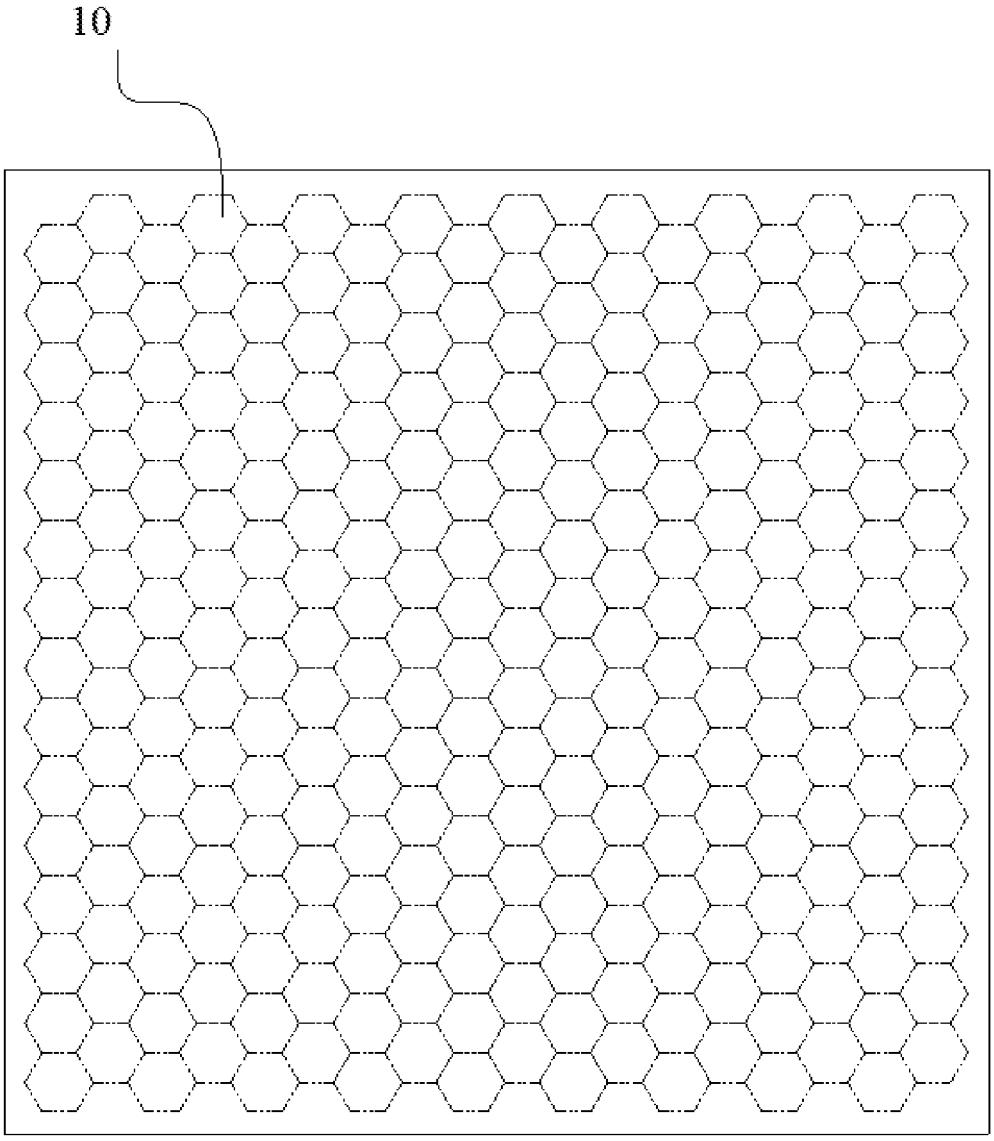
FIG. 2 is a schematic front view of a functional board constituted by multiple substrate units whose cross-section diagram is a regular hexagon.

A cross-section diagram of the substrate unit V may be in multiple forms. A relatively typical cross-section diagram of the substrate unit may be a triangle or a polygon. Preferably, the cross-section diagram of the substrate unit is an equilateral triangle, a square, a rhombus, a regular pentagon, a regular hexagon, or a regular octagon. FIG. 1 shows a substrate unit whose cross-section is a square. FIG. 2 is a schematic front view of a functional board 1 constituted by multiple substrate units whose cross-section diagram is a regular hexagon. The cross-section diagram of the substrate unit is preferably an equilateral triangle, a square, a rhombus, a regular pentagon, a regular hexagon, or a regular octagon, and a side length of the cross-section diagram of the substrate unit is less than ½ of a wavelength of an electromagnetic wave corresponding to a central frequency of a working frequency band of the reflective array surface. Preferably, a side length of the cross-section diagram of the substrate unit is less than ¼ of a wavelength of an electromagnetic wave corresponding to a central frequency of a working frequency band of the reflective array surface. More preferably, a side length of the cross-section diagram of the substrate unit is less than ⅛ of a wavelength of an electromagnetic wave corresponding to a central frequency of a working frequency band of the reflective array surface. More preferably, a side length of the cross-section diagram of the substrate unit is less than 1/10 of a wavelength of an electromagnetic wave corresponding to a central frequency of a working frequency band of the reflective array surface.

A substrate unit may be made from a ceramic material, a polymer material, a ferro-electric material, a ferrite material, or a ferro-magnetic material. The polymer material is polystyrene, polypropylene, polyimide, polyethylene, polyetheretherketone, polytetrafluorethylene, or epoxy resin.

An artificial structure unit may be a structure that is constituted by a conductive material and has a geometrical pattern. The conductive material is metal or a nonmetallic conductive material. The metal is gold, silver, copper, gold alloy, silver alloy, copper alloy, kirsite, or aluminum alloy. The nonmetallic conductive material is conductive graphite, indium-tin-oxide, or aluminum-doped zinc oxide. The artificial structure unit may be processed in multiple manners, and may be attached onto the substrate unit by means of etching, electroplating, diamond etching, photoetching, electroetching, or ion etching.

The artificial structure unit M can generate an electromagnetic response to an incident electromagnetic wave. The electromagnetic response herein may be an electric field response, may be a magnetic field response, or may include both an electric field response and a magnetic field response.

To protect the artificial structure unit, in another embodiment of the present invention, the artificial structure unit may be further covered with a protection layer. The protection layer may be a polystyrene (PS) plastic film, a polyethylene terephthalate (PET) plastic film, or a high impact polystyrene (HIPS) plastic film.

Figure 24:
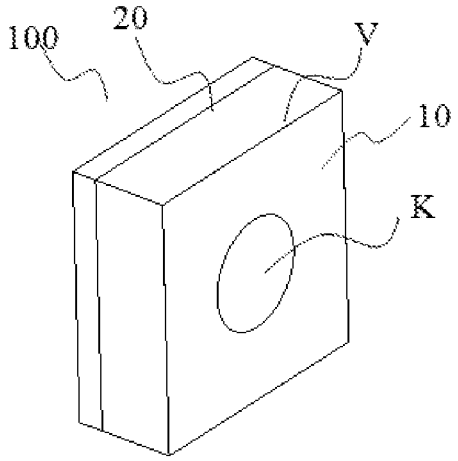
FIG. 24 is a schematic structural diagram of another form of phase-shifting unit.

A second scheme is that the functional board unit 10 is constituted by a substrate unit V and a unit hole K disposed on the substrate unit V. The unit hole may have a regular cross-section, or may have an irregular cross-section. The unit hole may be a through-hole or may be a blind hole. A phase-shifting amount of a phase-shifting unit is controlled according to a different shape and volume of the unit hole. A phase-shifting unit constituted by the functional board unit in this scheme is shown in FIG. 24.

A specific shape of the reflective array surface (one of devices modulating an electromagnetic wave radiation pattern) in the present invention may be designed according to an actual application scenario. Therefore, the functional board 1 and the reflection layer 2 may be in a planar shape, or may be in a curved surface shape according to an actual requirement.

In one embodiment of the present invention, as shown in FIG. 25 and FIG. 26, the reflective array antenna further includes a mounting rack that is configured to support the feed KY and the reflective array surface RS, where the mounting rack includes a rotary mechanism that is configured to enable the reflective array surface RS to rotate relative to an antenna mounting surface and a beam scanning mechanism that is configured to enable the feed KY to perform beam scanning within the first plane. Beam scanning in the specification refers to movement of the feed within the first plane. The scanning ends (the feed stops moving) when an electromagnetic wave received by the feed is optimal or is nearly optimal.

In one embodiment of the present invention, as shown in FIG. 25 and FIG. 26, the rotary mechanism 200 includes a through-hole 201 disposed at a center of an antenna array surface RS and a rotation axis 202 disposed in the through-hole 201, where one end of the rotation axis 202 is inserted into an antenna mounting surface. The rotation axis 202 may be an optical axis or may be a bolt or a screw. The through-hole 201 and the rotary axis 202 support clearance fit, so that the reflective array surface RS may rotate relative to the mounting surface.

In one embodiment of the present invention, as shown in FIG. 25 and FIG. 26, the beam scanning mechanism 300 includes a bearing rod 301, where one end of the bearing rod 301 is fixedly connected to a rear side of the reflective array surface RS, a feed clamping part 302 that is connected to the feed KY and is flexibly connected to the other end of the bearing rod 301, and a fastener 303 that can fasten the bearing rod 301 on the antenna mounting surface, where at least one sliding groove 304 is disposed on one end of the bearing rod 301 that is connected to the feed clamping part 302, along an axial direction, a regulating groove 305 intersected with the sliding groove 304 is disposed on the feed clamping part 302, and at least one adjusting bolt 306 passes through the regulating groove 305 and the sliding groove 304 in sequence, so as to tightly lock and fix a relative location of the feed clamping part 302 and the bearing rod 301. By the aid of the sliding groove 304, the regulating groove 305, and the adjusting bolt 306, the feed may move within the first plane, so that the feed performs beam scanning within the first plane, thereby receiving an electromagnetic wave within a predefined angle range.

As one embodiment, the feed clamping part 302 is a U-shaped spring plate, the feed KY is inserted into an arc-shaped region of the U-shaped spring plate, and a set screw 3021 passes through two extension arms 3022 of the U-shaped spring plate and squeezes the two extension arms to clamp and fix the feed KY.

As one embodiment, the fastener 303 includes a presser 3031 disposed on an outer surface of the bearing rod 301 and screws 3032 that respectively pass through two ends of the presser 3031 to enter the antenna mounting surface.

Figure 27:
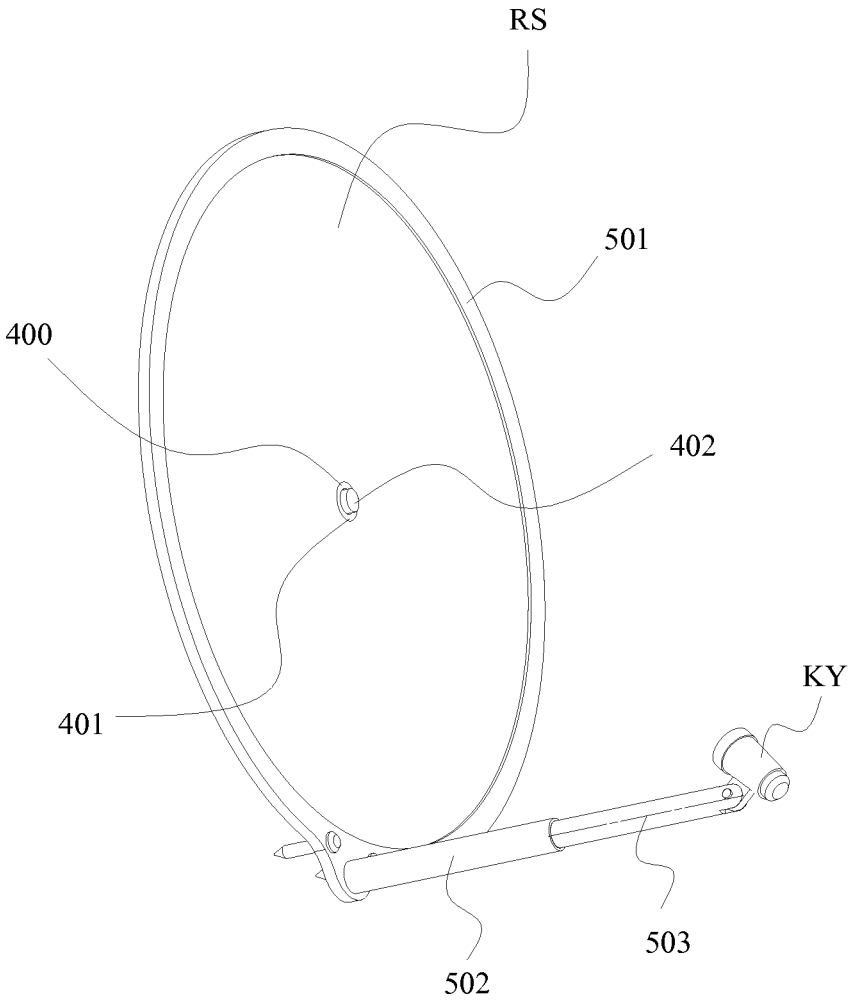
FIG. 27 is a schematic structural diagram of a reflective array antenna having another form of mounting rack.
Figure 28:
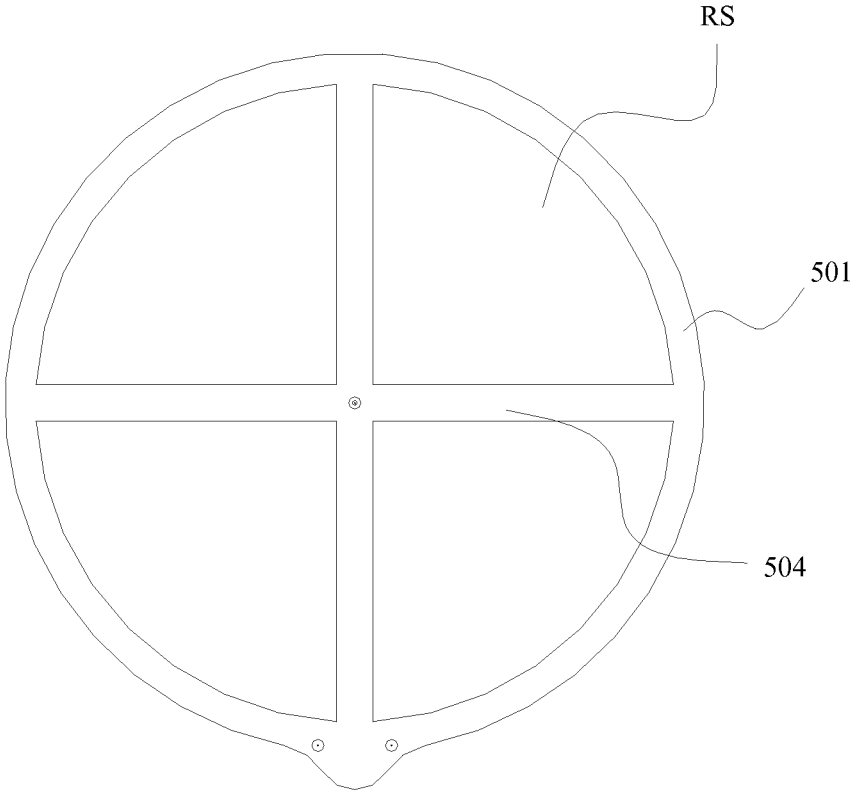
FIG. 28 is another view of FIG. 27.

In another embodiment of the present invention, as shown in FIG. 27 and FIG. 28, the rotary mechanism 400 includes a through-hole 401 disposed at a center of an antenna array surface RS and a rotation axis 402 disposed in the through-hole 401, where one end of the rotation axis 402 is inserted into an antenna mounting surface. The rotation axis 402 may be an optical axis or may be a bolt or a screw. The through-hole 401 and the rotary axis 402 support clearance fit, so that the reflective array surface RS may rotate relative to the mounting surface.

In another embodiment of the present invention, as shown in FIG. 27 and FIG. 28, the beam scanning mechanism 500 includes a fastening rack 501 that is configured to fasten the reflective array surface and a feed bearing rod that is fixedly connected to the fastening rack 501. The feed bearing rod includes a hollow rod 50 and a retractable rod 503 that is disposed in the hollow rod 502 and may move in a straight line relative to the hollow rod, where the retractable rod 503 and the feed KY are hinged at the end of the retractable rod 503. A mounting hole is disposed at a lower end of the fastening rack 501. By the aid of a connecting piece such as a bolt and a screw, the reflective array surface may be fastened onto the antenna mounting surface. FIG. 28 is a schematic structure diagram of a rear side of a reflective array surface. It may be seen that the fastening rack 501 further has a cross structure reinforcer 504.

By the aid of sliding of the retractable rod relative to the hollow rod and rotation of the feed relative to the retractable rod, the feed may move within the first plane, so that the feed performs beam scanning within the first plane, thereby receiving an electromagnetic wave within a predefined angle range.

Certainly, the rotary mechanism of the mounting rack is not limited to forms shown in FIG. 25 and FIG. 27. A person of ordinary skill in the mechanical field may figure out many mechanisms to enable the reflective array surface to rotate relative to the antenna mounting surface, for example, by using a combination of a bearing and a shaft.

Likewise, the beam scanning mechanism of the mounting rack is not either limited to the forms shown in FIG. 25 and FIG. 27. A person of ordinary skill in the mechanical field may figure out many mechanisms to enable the feed to perform beam scanning within the first plane, for example, by using a multi-connecting rod structure or a structure similar to a retractable rod of a desk lamp.

In addition, in another embodiment of the present invention, a servo system is used to control the reflective array surface to rotate relative to the antenna mounting surface and control the feed to move within the first plane to perform beam scanning. The rotation of the reflective array surface and the movement of the feed may be considered as two controllable dimensionalities. A trajectory corresponding to the foregoing two dimensionalities may be obtained according to a parameter such as a longitude where a satellite is located, a local longitude and latitude of a receiving point, an included angle between an electromagnetic wave that is sent by the satellite and is received by the reflective array surface and a normal direction of the reflective array surface (hereinafter referred to as an offset angle of the reflective array surface), an azimuth of the antenna mounting surface (that is, an included angle between projection of a normal of the antenna mounting surface on a horizontal plane and the due south), and an included angle between the antenna mounting surface and the horizontal plane, so as to implement automatic pointing of the antenna to the satellite. In the embodiment, there is no special requirement for the servo system as long as the servo system can control the reflective array surface to rotate relative to the antenna mounting surface and the feed to perform beam scanning within the first plane, so as to implement pointing to the satellite. A person skilled in the art can easily design a servo system having the foregoing function. Therefore, in the present invention, a specific structure of the servo system is not detailed again.

The reflective array surface RS in the present invention is parallel to the antenna mounting surface. According to a different mounting environment, the antenna mounting surface may be a vertical surface (vertical to a horizontal surface), a horizontal surface, or a skewed surface (neither vertical nor parallel to a horizontal surface).

In the present invention, the vertical surface is a vertical wall, that is, the reflective array surface of the antenna is attached to the vertical wall for mounting, for example, a vertical wall facing the south.

In the present invention, the horizontal surface is level ground or a horizontal roof, that is, the reflective array surface of the antenna is attached to the level ground or the horizontal roof for mounting.

In the present invention, the skewed surface is inclined ground, an inclined roof, or an inclined wall, that is, the reflective array surface of the antenna is attached to the inclined ground, inclined roof, or inclined wall for mounting.

To enable the reflective array surface to have a focusing capability for an incident electromagnetic wave within a predefined angle range, a phase-shifting amount corresponding to each phase-shifting unit is first designed, where the phase-shifting amount is required for an electromagnetic wave with a specific incident angle to focus after the electromagnetic wave passing through the reflective array surface, that is, a phase-shifting amount distribution on the reflective array surface needs to be obtained or designed; and then the foregoing angle range is determined by rotating the reflective array surface and enabling the feed to perform scanning within the first plane. That is, a reflective array surface designed according to a specific incident angle can have a focusing capability for all incident electromagnetic waves within a corresponding angle range.

The phase-shifting amount distribution on the reflective array surface may be designed by using a method recorded in *Research on Microstrip Reflective array antennas*, a dissertation prepared by Doctor Li Hua, or may be designed by using the following one design method in the present invention.

The method is as follows:

S1. Set a phase-shifting amount variation range of each phase-shifting unit, construct phase-shifting amount vector space $\Theta$ of n phase-shifting units, and set a parameter specification corresponding to an expected electromagnetic wave radiation pattern. The parameter herein refers to a main beam direction and the like.

S2. Sample the phase-shifting amount vector space $\Theta$ to generate sample vector space $\Theta_0$ of m ($m<n$) phase-shifting units. The sampling herein may be a common sampling method, for example, random sampling or systematic sampling.

S3. According to the sample vector space, calculate a phase-shifting amount for n-m phase-shifting units by using an interpolation method to generate new phase-shifting amount vector space $\Theta_i$ of the n phase-shifting units, where the interpolation method may be a Gauss process interpolation method, a spline interpolation method, or the like.

S4. Calculate a parameter specification corresponding to $\Theta_i$, determine whether the calculated parameter specification meets a preset requirement. If yes, $\Theta_i$ is phase-shifting amount vector space that meets a requirement; if not, use a preset optimization algorithm to generate new sample vector space, use the interpolation method to generate new phase-shifting amount vector space $\Theta_{i+1}$, and circularly execute step S4 until the preset requirement is met. The preset optimization algorithm may be a simulated annealing algorithm, a genetic algorithm, a tabu search algorithm, or the like. The preset requirement may include, for example, a threshold and precision range of the parameter specification.

A desired phase-shifting amount distribution of each phase-shifting unit may be obtained by using the foregoing method. According to the phase-shifting amount distribution, a specific design is determined with reference to a technical solution type that needs to be used. For example, a phase-shifting amount distribution that is on the reflective array surface and is required to implement a pattern with a specific main beam direction may be obtained by using the foregoing method. According to an antenna reversibility characteristic, the main beam direction herein actually refers to an incident angle of an electromagnetic wave. Then the foregoing angle range is determined by continuously rotating the reflective array surface and enabling the feed to perform beam scanning within the first plane. That is, according to a reflective array surface designed according to a specific incident angle, a reflective array surface antenna that can perform focusing within one angle range may be designed. For example, if a functional board unit that is constituted by a substrate unit and an artificial structure unit is used to implement modulation of an incident electromagnetic wave pattern, it is required to find out a correspondence between a shape of an artificial structure unit that can meet a phase-shifting amount distribution and dimension information of the artificial structure unit. If a functional board unit that is constituted by a substrate unit and a unit hole is used to implement modulation of an incident electromagnetic wave pattern, it is required to find out a correspondence between a shape of a hole that can meet a phase-shifting amount distribution and dimension information of the hole.

If a functional board unit that is constituted by a substrate unit and an artificial structure unit is used, a shape and geometric dimensions of an artificial structure unit on each phase-shifting unit may be reasonably designed, and a phase-shifting amount of each phase-shifting unit on the reflective array surface is designed, thereby implementing focusing of an incident electromagnetic wave after the incident electromagnetic wave passes through the reflective array surface.

A curve showing that a phase-shifting amount of a phase-shifting unit varies with growth of a geometrical shape of an artificial structure unit may be obtained by specifying a working frequency band of the antenna, determining physical dimensions, a material, and an electromagnetic parameter of a substrate unit and a material, thickness, and topological structure of an artificial structure unit, and using simulation software such as CST, MATLAB, and COMSOL. That is, a continuously changed correspondence between the phase-shifting unit and the phase-shifting amount may be obtained, that is, a maximum phase-shifting amount and a minimum phase-shifting amount of the phase-shifting unit in this form are obtained.

In the embodiment, a structure design of a phase-shifting unit may be obtained by means of computer simulation (CST simulation). Specific steps are as follows:

(1) Determine a material of a substrate unit. The material of the substrate unit may be, for example, FR-4, F4b, or PS.

(2) Determine a shape and physical dimensions of the substrate unit. For example, the substrate unit may be a quadrangular slice whose cross-section diagram is a square. The physical dimensions of the substrate unit are obtained according to a central frequency of the working frequency band of the antenna. A wavelength of the central frequency is obtained according to the central frequency, and then a numeric value less than ½ of the wavelength is used as a side length of the cross-section diagram of the substrate unit, for example, the side length of the cross-section diagram of the substrate unit is 1/10 of a wavelength of an electromagnetic wave corresponding to the central frequency of the working frequency band of the antenna. A thickness of the substrate unit varies according to the working frequency band of the antenna. For example, when the reflective array surface or the antenna works at wave band Ku, the thickness of the substrate unit may be 0.5-4 mm; when the reflective array surface or the antenna works at wave band X, the thickness of the substrate unit may be 0.7-6.5 mm; and when the reflective array surface or the antenna works at wave band C, the thickness of the substrate unit may be 1-12 mm. For example, at wave band Ku, the thickness of the substrate unit may be 1 mm, 2 mm, or the like.

(3) Determine a material, thickness, and topological structure of an artificial structure unit. For example, the material of the artificial structure unit is copper. The topological structure of the artificial structure unit may be a planar snowflake-shaped artificial structure unit shown in FIG. 5. The planar snowflake-shaped artificial structure unit has a first metallic wire J1 and a second metallic wire J2 that are mutually perpendicular and bisected. A length of the first metallic wire J1 is the same as a length of the second metallic wire J2. Two ends of the first metallic wire J1 are respectively connected to two first metallic branches F1 of a same length and the two ends of the first metallic wire J1 are respectively connected to a midpoint of the two first metallic branches F1. Two ends of the second metallic wire J2 are respectively connected to two second metallic branches F2 of a same length and the two ends of the second metallic wire J2 are respectively connected to a midpoint of the two second metallic branches F2. A length of the first metallic branch F1 is equal to a length of the second metallic branch F2. The topological structure herein refers to a basic shape of growth of a geometrical shape of the artificial structure unit. The thickness of the artificial structure unit may be 0.005-1 mm, for example, 0.018 mm.

(4) Determine a structure growth parameter of the geometrical shape of the artificial structure unit, where the structure growth parameter is expressed by S herein. For example, a structure growth parameter S of a geometrical shape of a planar snowflake-shaped artificial structure unit shown in FIG. 5 may include a wire width W of an artificial structure unit, a length a of a first metallic wire J1, and a length b of a first metallic branch F1.

Figure 5:
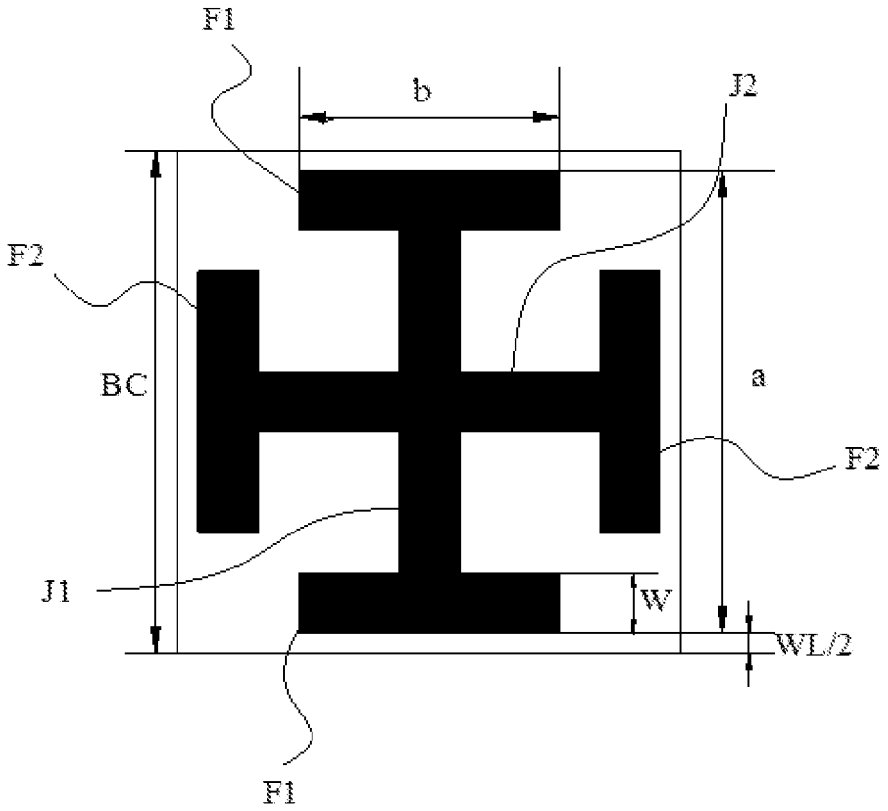
FIG. 5 is a schematic diagram of a phase-shifting unit constituted by a planar snowflake-shaped artificial structure unit.

(5) Determine a growth restriction condition of the geometrical shape of the artificial structure unit. For example, a growth restriction condition of the geometrical shape of the planar snowflake-shaped artificial structure unit shown in FIG. 5 includes a minimum spacing WL between artificial structure units (as shown in FIG. 5, a distance between a side of an artificial structure unit and a side of a substrate unit is WL/2), a wire width W of an artificial structure unit, and a minimum spacing between a first metallic branch and a second metallic branch, where the minimum spacing may be consistent with the minimum spacing WL between the artificial structure units. Due to a restriction of a processing technique, WL is generally equal to or greater than 0.1 mm; and likewise, the wire width W generally also needs to be equal to or greater than 0.1 mm. During first simulation, WL may be 0.1 mm, and W may be a certain value (the wire width of the artificial structure is even), for example, 0.14 mm or 0.3 mm. In this case, the structure growth parameter of the geometrical shape of the artificial structure unit only includes two variables: a and b, where it is assumed that structure growth parameter S=a+b. For the geometrical shape of the artificial structure unit being in a growth manner shown in FIG. 8 and FIG. 9, a continuous phase-shifting amount variation range corresponding to a specific central frequency (for example, 11.95 GHZ) may be obtained.

An artificial structure unit shown in FIG. 5 is used as an example. Specifically, growth of a geometrical shape of the artificial structure unit includes two phases (a basic shape of the growth of the geometrical shape is the artificial structure unit shown in FIG. 5).

Figure 8:
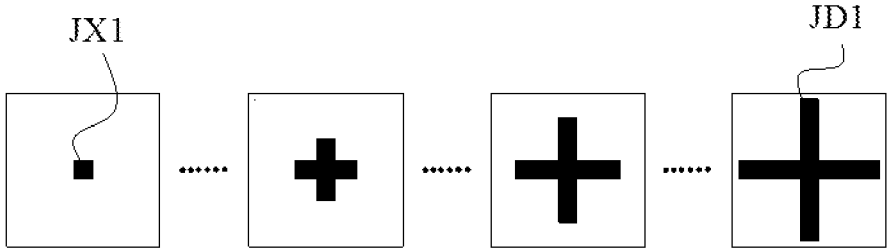
FIG. 8 is a first growth phase of a geometrical shape of a planar snowflake-shaped artificial structure unit.

First stage: According to a growth restriction condition, change value a from a minimum value to a maximum value in a case that value b keeps unchanged. In this case, b=0 and S=a. An artificial structure unit in the growth process is of a "cross" shape (except when a is the minimum value). The minimum value of a is a wire width W and the maximum value of a is (BC-WL). Therefore, in the first phase, growth of the geometrical shape of the artificial structure unit is shown in FIG. 8, that is, a maximum "cross" geometrical shape JD1 is gradually generated from a square JX1 with a side length of W.

Figure 9:
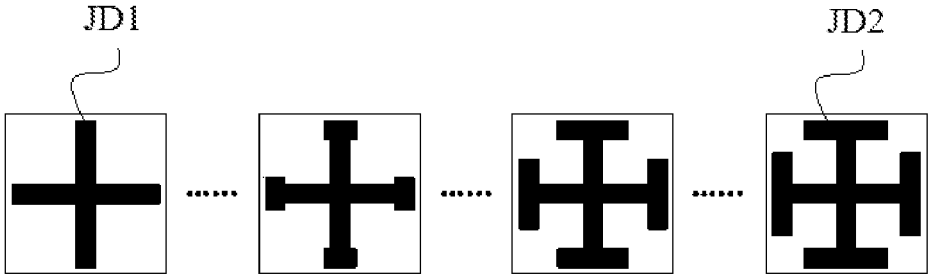
FIG. 9 is a second growth phase of a geometrical shape of a planar snowflake-shaped artificial structure unit.

Second stage: According to the growth restriction condition, when a increases to the maximum value, a keeps unchanged. In this case, b is continuously increased to the maximum value from the minimum value. In this case, b is not equal to 0 and S=a+b. An artificial structure unit in the growth process is planar and snowflake-shaped. The minimum value of b is the wire width W and the maximum value of b is (BC−WL−2W). Therefore, in the second stage, growth of the geometrical shape of the artificial structure unit is shown in FIG. 9, that is, a maximum planar snowflake-shaped geometrical shape JD2 is gradually generated from the maximum "cross" geometrical shape JD1. The maximum planar snowflake-shaped geometrical shape JD2 herein means that a length b of a first metallic branch J1 and a length b of a second metallic branch J2 cannot be extended any longer; and otherwise, the first metallic branch and the second metallic branch are intersected.

Figure 12:
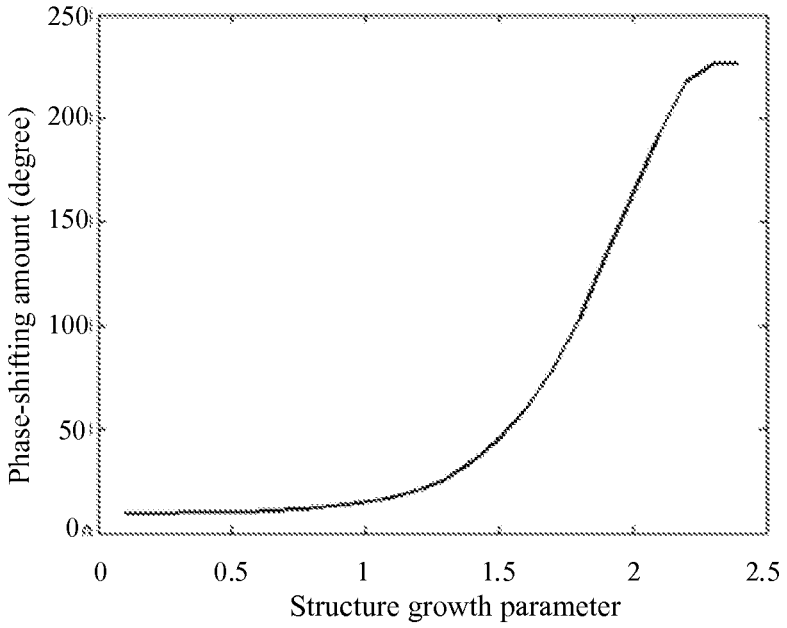
FIG. 12 is a curve diagram showing that a phase-shifting amount of a phase-shifting unit constituted by an artificial structure unit shown in FIG. 5 varies with a structure growth parameter S.
Figure 29:
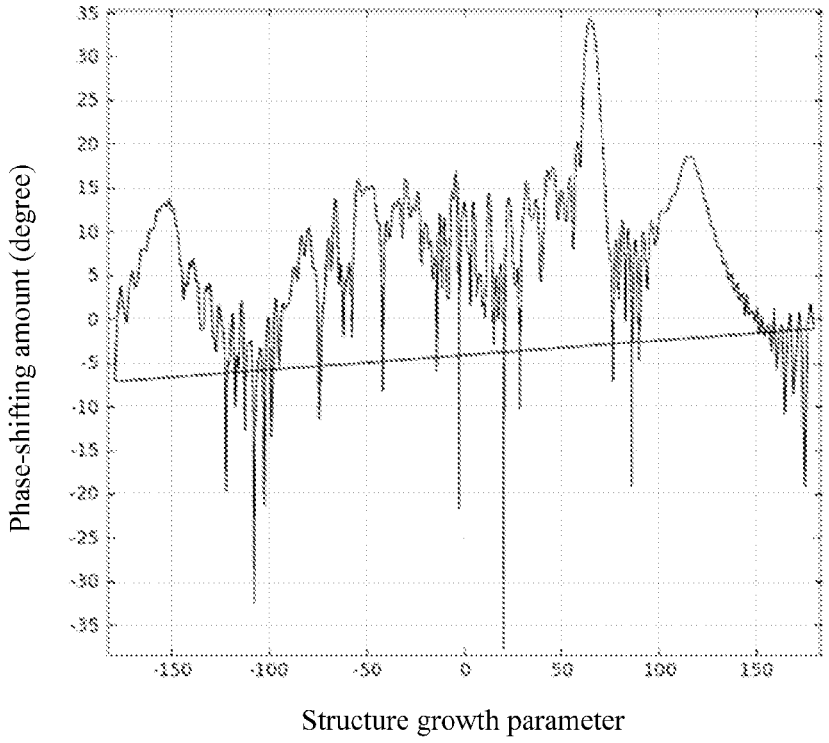
FIG. 29 is a curve diagram showing that a phase-shifting amount of a phase-shifting unit with another structure and constituted by an artificial structure unit shown in FIG. 5 varies with a structure growth parameter S.

The foregoing method is applied to perform simulation on phase-shifting units separately constituted by three types of artificial structure units:

(1) FIG. 5 shows a phase-shifting unit constituted by a planar snowflake-shaped artificial structure unit. In a first structure of the phase-shifting unit, a material of a substrate unit V is polystyrene (PS), where a permittivity of the polystyrene is 2.7 and loss angle tangent of the polystyrene is 0.0009. Physical dimensions of the substrate unit V are that a thickness is 2 mm and a cross-section diagram is a square with a side length of 2.7 mm. A material of the artificial structure unit is copper and a thickness of the artificial structure unit is 0.018 mm. A material of a reflection unit is copper and a thickness of the reflection unit is 0.018 mm. Herein, a structure growth parameter S is the sum of a length a of a first metallic wire J1 and a length b of a first metallic branch F1. For a growth manner of the phase-shifting unit having the artificial structure unit with the structure, reference is made to FIG. 8 and FIG. 9. FIG. 12 shows that a phase-shifting amount of the phase-shifting unit having the artificial structure unit varies with the structure growth parameter S. It may be seen from the figure that the phase-shifting amount of the phase-shifting unit continuously changes as the parameter S continuously increases. A phase-shifting amount variation range of the phase-shifting unit is roughly 10-230 degrees, and a difference value between a maximum phase-shifting amount of the phase-shifting unit and a minimum phase-shifting amount of the phase-shifting unit is about 220 degrees, less than 360 degrees. In a second structure of the phase-shifting unit, only the cross-section diagram of the substrate unit V is changed to a square with a side length of 8.2 mm and other parameters keeps unchanged. FIG. 29 shows that a phase-shifting amount of the phase-shifting unit having the artificial structure unit with the structure varies with the structure growth parameter S. It may be seen from the figure that the phase-shifting amount of the phase-shifting unit continuously changes as the parameter S continuously increases. A phase-shifting amount variation range of the phase-shifting unit is roughly 275-525 degrees, and a difference value between a maximum phase-shifting amount of the phase-shifting unit and a minimum phase-shifting amount of the phase-shifting unit is about 250 degrees, still less than 360 degrees.

Figure 10:
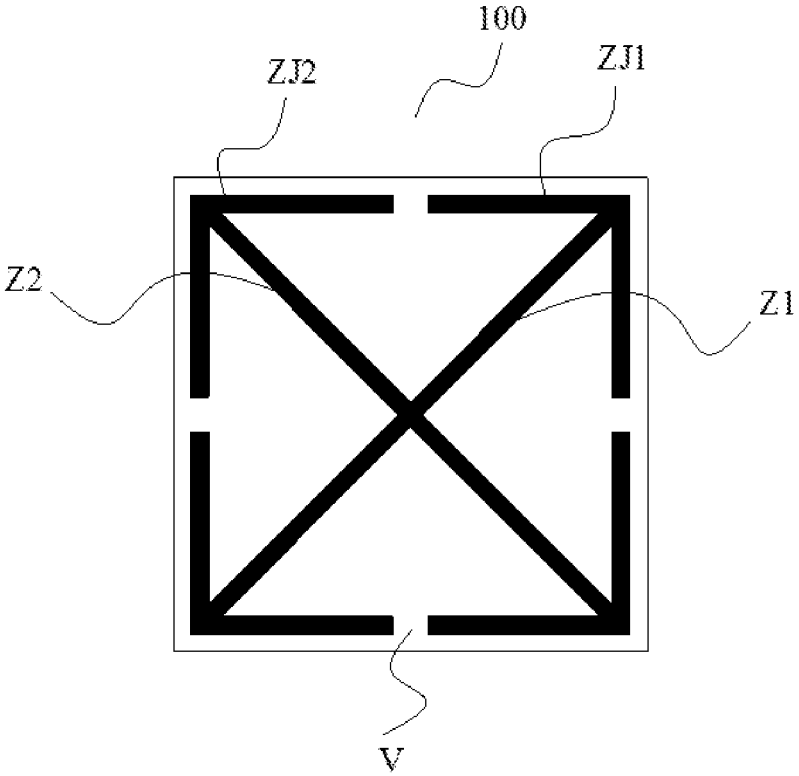
FIG. 10 is a schematic diagram of a phase-shifting unit constituted by an artificial structure unit with another structure according to the present invention.
Figure 13:
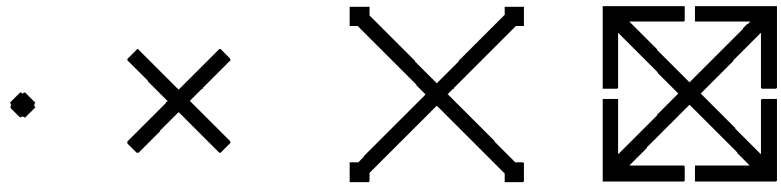
FIG. 13 is a schematic diagram showing a growth manner of an artificial structure unit shown in FIG. 10.
Figure 14:
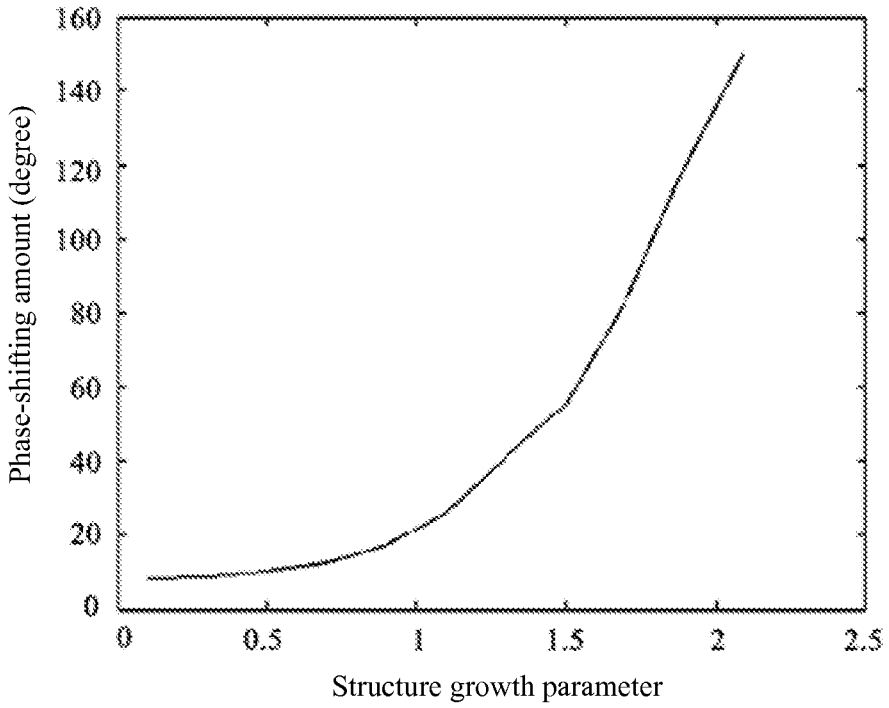
FIG. 14 is a curve diagram showing that a phase-shifting amount of a phase-shifting unit constituted by an artificial structure unit shown in FIG. 10 varies with a structure growth parameter S.

(2) FIG. 10 shows a phase-shifting unit constituted by another form of artificial structure unit. The artificial structure unit has a first main line Z1 and a second main line Z2 that are mutually perpendicular and bisected. The first main line Z1 has a same shape and same dimensions as the second main line Z2. Two ends of the first main line Z1 are respectively connected to two same first right-angle knuckle lines ZJ1 and the two ends of the first main line Z1 are respectively connected to a corner of the two first right-angle knuckle lines ZJ1. Two ends of the second main line Z2 are respectively connected to two second right-angle knuckle lines ZJ2 and the two ends of the second main line Z2 are respectively connected to a corner of the two second right-angle knuckle lines ZJ2. The first right-angle knuckle line ZJ1 has a same shape and same dimensions as the second right-angle knuckle line ZJ2. Two legs of angle of the first right-angle knuckle line ZJ1 and second right-angle knuckle line ZJ2 are respectively parallel to two sides of a square substrate unit. The first main line Z1 and the second main line Z2 are angle bisectors of the first right-angle knuckle line ZJ1 and second right-angle knuckle line ZJ2. In the phase-shifting unit, a material of the substrate unit V is polystyrene (PS), where a permittivity of the polystyrene is 2.7 and loss angle tangent of the polystyrene is 0.0009. Physical dimensions of the substrate unit are that a thickness is 2 mm and a cross-section diagram is a square with a side length of 2 mm. A material of the artificial structure unit is copper and a thickness of the artificial structure unit is 0.018 mm. A material of a reflection unit is copper and a thickness of the reflection unit is 0.018 mm. Herein, a structure growth parameter S is the sum of a length of the first main wire and a length of the first right-angle knuckle line. For a growth manner of the artificial structure unit on the phase-shifting unit, reference is made to FIG. 13. FIG. 14 shows that a phase-shifting amount of the phase-shifting unit having the artificial structure unit varies with the structure growth parameter S. It may be seen from the figure that the phase-shifting amount of the phase-shifting unit continuously changes as the parameter S continuously increases. A phase-shifting amount variation range of the phase-shifting unit is roughly 10-150 degrees, and a difference value between a maximum phase-shifting amount of the phase-shifting unit and a minimum phase-shifting amount of the phase-shifting unit is about 140 degrees, less than 360 degrees.

Figure 11:
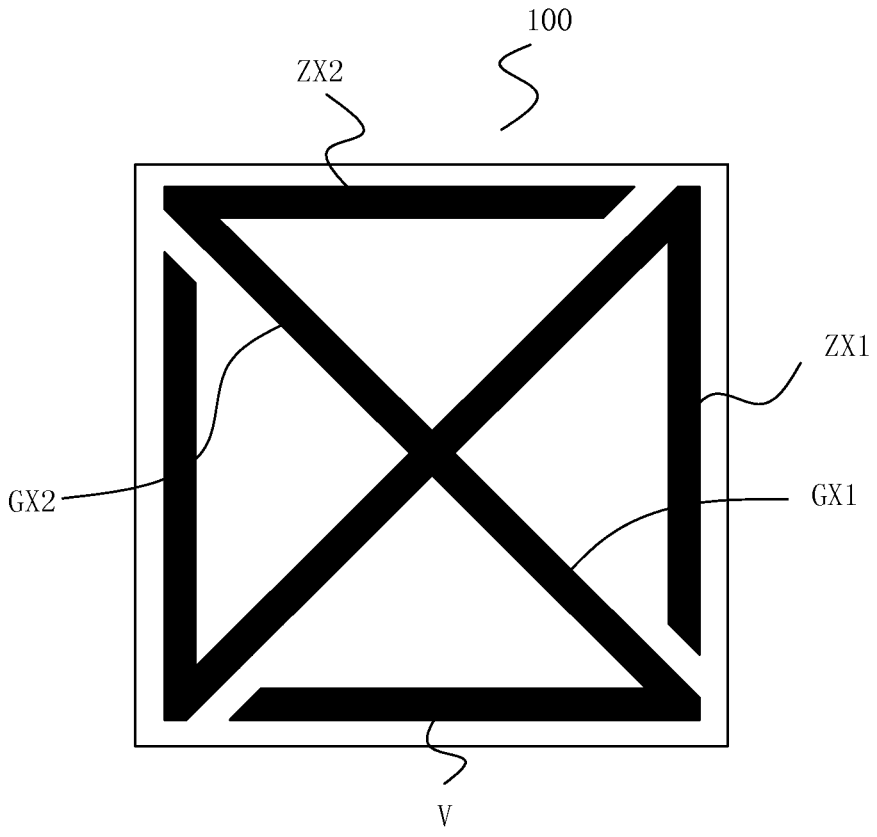
FIG. 11 is a schematic diagram of a phase-shifting unit constituted by an artificial structure unit with another structure according to the present invention.
Figure 15:
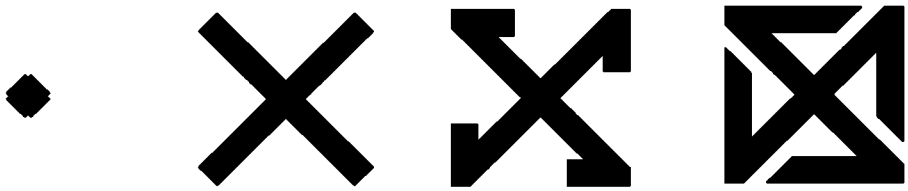
FIG. 15 is a schematic diagram showing a growth manner of an artificial structure unit shown in FIG. 11.
Figure 16:
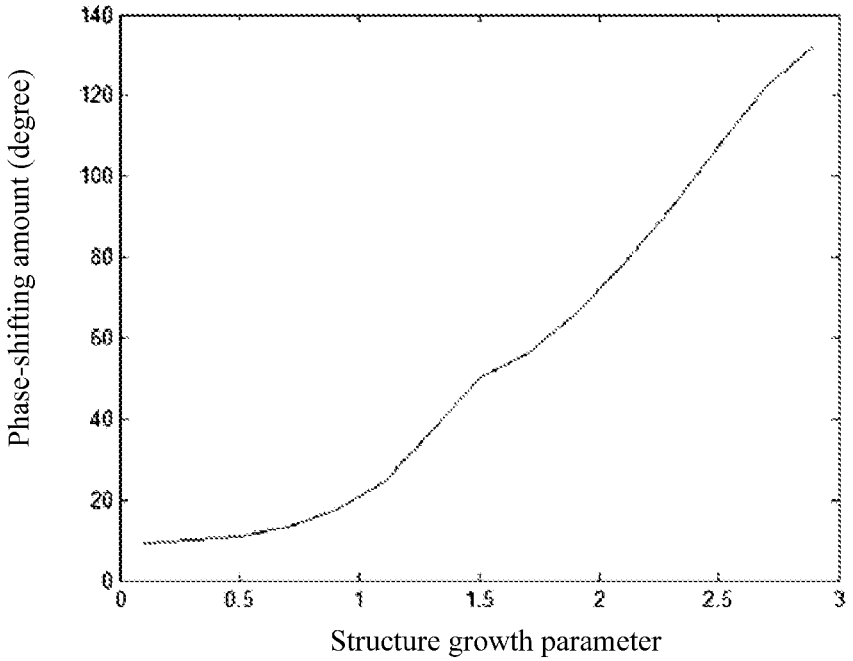
FIG. 16 is a curve diagram showing that a phase-shifting amount of a phase-shifting unit constituted by an artificial structure unit shown in FIG. 11 varies with a structure growth parameter S.

(3) FIG. 11 shows a phase-shifting unit constituted by another form of artificial structure unit. The artificial structure unit has a first main line GX1 and a second main line GX2 that are mutually perpendicular and bisected. The first main line GX1 has a same shape and same dimensions as the second main line GX2. Two ends of the first main line GX1 are respectively connected to two first straight lines ZX1 that are extended along a reverse direction. Two ends of the second main line GX2 are respectively connected to two second straight lines ZX2 that are extended along a reverse direction. The first straight line ZX1 has a same shape and same dimensions as the second straight line ZX2. The first straight line ZX1 and the second straight line ZX2 are respectively parallel two sides of a square substrate unit V. An included angle between the first straight line ZX1 and the first main line GX1 is 45 degrees, and an included angle between the second straight line ZX2 and the second main line GX2 is 45 degrees. In the phase-shifting unit, a material of the substrate unit V is polystyrene (PS), where a permittivity of the polystyrene is 2.7 and loss angle tangent of the polystyrene is 0.0009. Physical dimensions of the substrate unit V are that a thickness is 2 mm and a cross-section diagram is a square with a side length of 2 mm. A material of the artificial structure unit is copper and a thickness of the artificial structure unit is 0.018 mm. A material of a reflection unit is copper and a thickness of the reflection unit is 0.018 mm. Herein, a structure growth parameter S is the sum of a length of the first main line and a length of the first straight line. For a growth manner of the artificial structure unit on the phase-shifting unit, reference is made to FIG. 15. FIG. 16 shows that a phase-shifting amount of the phase-shifting unit having the artificial structure unit varies with the structure growth parameter S. It may be seen from the figure that the phase-shifting amount of the phase-shifting unit continuously changes as the parameter S continuously increases. A phase-shifting amount variation range of the phase-shifting unit is roughly 10-130 degrees, and a difference value between a maximum phase-shifting amount of the phase-shifting unit and a minimum phase-shifting amount of the phase-shifting unit is about 120 degrees, less than 360 degrees.

In addition, the planar snowflake-shaped artificial structure unit shown in FIG. 5 may have another deformation.

Figure 6:
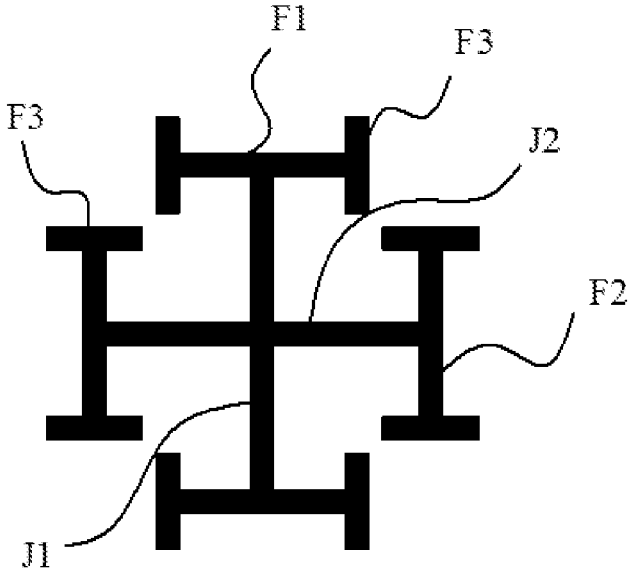
FIG. 6 is a derived structure of an artificial structure unit shown in FIG. 5.

FIG. 6 is a derived structure of an artificial structure unit shown in FIG. 5. Two ends of each first metallic branch F1 and two ends of each second metallic branch F2 are connected to completely same third metallic branches F3. Moreover, a midpoint of a corresponding third metallic branch F3 is separately connected to an endpoint of a first metallic branch F1 and an endpoint of a second metallic branch F2. By analogy, another form of artificial structure unit may be derived in the present invention. FIG. 6 only shows a basic shape of growth of a geometrical shape of the artificial structure unit.

Figure 7:
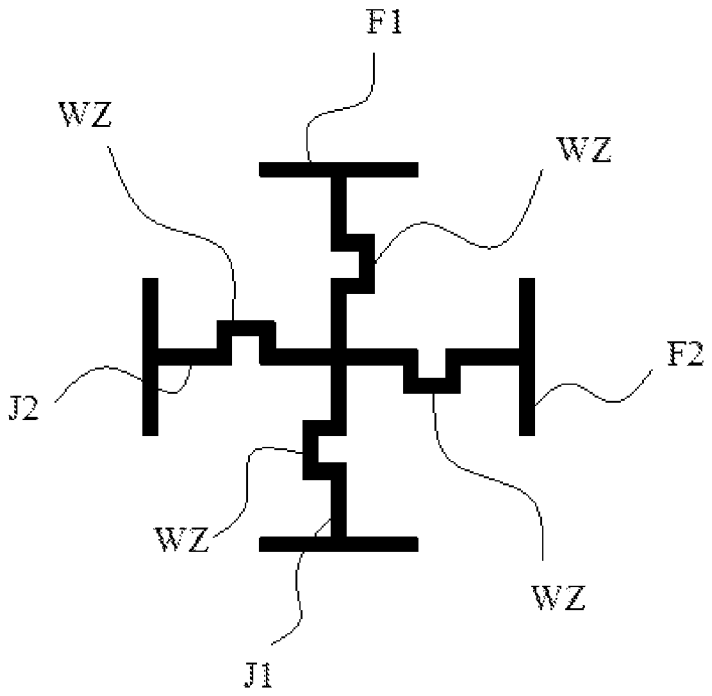
FIG. 7 is a deformed structure of an artificial structure unit shown in FIG. 5.

FIG. 7 is a deformed structure of a planar snowflake-shaped artificial structure unit shown in FIG. 5. For an artificial structure unit with this structure, a first metallic wire J1 and a second metallic J2 are not straight lines but meander lines. The first metallic wire J1 and the second metallic wire J2 are separately disposed with two bending parts WZ, but the first metallic wire J1 and the second metallic wire J2 are still perpendicularly bisected. An orientation of the bending part and a relative location of the bending part on the first metallic wire and the second metallic wire are set, so that a figure that the artificial structure unit shown in FIG. 7 rotates to any direction by 90 degrees around an axis perpendicular to a crossover point of the first metallic wire and the second metallic wire coincides with an original figure. In addition, another deformation may also be available, for example, the first metallic wire J1 and the second metallic wire J2 are separately disposed with multiple bending parts WZ. FIG. 7 only shows a basic shape of growth of a geometrical shape of the artificial structure unit.

Figure 17A:
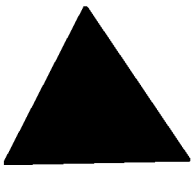
FIG. 17*a* is a schematic diagram of a triangular sheet metal-shaped artificial structure unit.
Figure 17B:
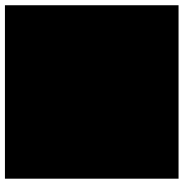
FIG. 17*b* is a schematic diagram of a square sheet metal-shaped artificial structure unit.
Figure 17C:
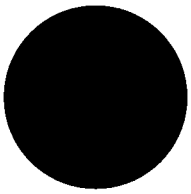
FIG. 17*c* is a schematic diagram of a circular sheet metal-shaped artificial structure unit.
Figure 17D:
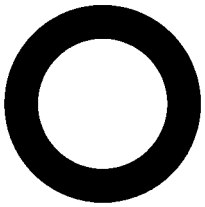
FIG. 17*d* is a schematic diagram of a circular metallic ring-shaped artificial structure unit.
Figure 17E:
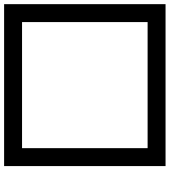
FIG. 17*e* is a schematic diagram of a quadrangular metallic ring-shaped artificial structure unit.

In addition to the artificial structure units with the foregoing three types of topological structures, the present invention may further provide an artificial structure unit with another topological structure, for example, triangular sheet metal shown in FIG. 17*a*, square sheet metal shown in FIG. 17*b*, circular sheet metal shown in FIG. 17*c*, circular metallic ring shown in FIG. 17*d*, and quadrangular metallic ring shown in FIG. 17*e*. A curve may also be obtained by using the foregoing method, where the curve indicates that a phase-shifting amount of a phase-shifting unit having the foregoing artificial structure unit varies with the structure growth parameter S.

If the phase-shifting amount range, which is obtained in the foregoing growth process, of the phase-shifting unit includes a desired phase-shifting amount range (that is, both a required maximum phase-shifting amount and a required minimum phase-shifting amount can be obtained), a design requirement is met. If the phase-shifting amount variation range, which is obtained in the foregoing growth process, of the phase-shifting unit does not meet a design requirement, for example, the maximum phase-shifting amount is too small or the minimum phase-shifting amount is too large, WL and W are modified and simulation is performed again until a desired phase-shifting amount variation range is obtained.

According to an expected electromagnetic wave radiation pattern, a phase-shifting amount distribution on a reflective array surface is obtained through calculation. Dimension and distribution information of an artificial structure unit corresponding to the phase-shifting amount distribution is obtained by using the foregoing artificial structure unit growth method, and the functional board in the present invention can be obtained. A reflection layer is disposed on one side of the functional board, so that the reflective array surface (one of devices modulating an electromagnetic wave radiation pattern) in the present invention is formed, and the expected electromagnetic wave radiation pattern may be implemented.

For example, according to an expected focusing requirement, a phase-shifting amount distribution on a reflective array surface is obtained through calculation. Dimension and distribution information of an artificial structure unit corresponding to the phase-shifting amount distribution is obtained by using the foregoing artificial structure unit growth method, and the functional board in the present invention can be obtained. A reflection layer is disposed on one side of the functional board, so that the reflective array surface in the present invention is formed. The reflective array surface can implement focusing of an incident electromagnetic wave after the incident electromagnetic wave passing through the reflective array surface.

The following describes three applications of the reflective array surface (one of devices modulating an electromagnetic wave radiation pattern) in the present invention. It should be understood that the present invention is not limited to the three applications.

(1) Modulating an Electromagnetic Wave Having a Wide-Beam Pattern to an Electromagnetic Wave Having a Narrow-Beam Pattern To achieve a purpose of modulating an electromagnetic wave radiation pattern, it is first required to find out a phase-shifting amount corresponding to each phase-shifting unit on the reflective array surface in the present invention, that is, a phase-shifting amount distribution on the device needs to be obtained or designed.

Figure 30:
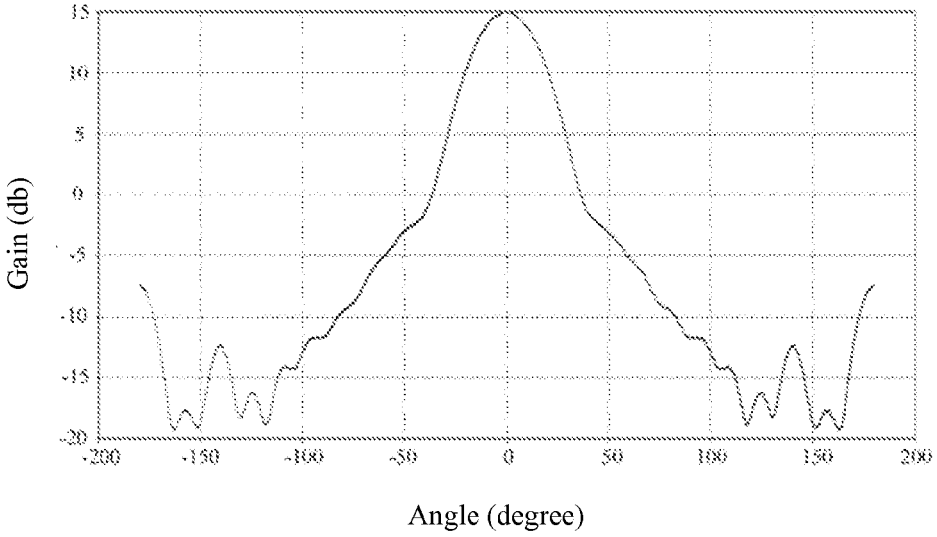
FIG. 30 is a primary feed pattern.

In this example, in a wide-beam primary feed pattern, a beam width of a primary feed is 31.8 degrees. An objective is to modulate the wide-beam pattern to a narrow-beam pattern and control the beam width within 4 degrees. The primary feed pattern is shown in FIG. 30.

In this example, the phase-shifting unit is designed as a quadrangular slice whose cross-section diagram is a square, where a side length of the square does not exceed 2.7 mm. All phase-shifting units of the device are arranged in a square grid. On a 450 mm×450 mm flat plate, 27556 (166×166) phase-shifting units may be arranged. With reference to the method of designing a phase-shifting amount of each phase-shifting unit, in step S1, a phase-shifting amount variation range is set, the phase-shifting amount of each phase-shifting unit is used as one adjustable parameter, and a beam width is used as a target function.

Therefore, an optimization issue is as follows:

$$\min_{\Theta \in R} T(\theta_1, \theta_2, \ldots, \theta_n)$$

where, $\Theta=[\theta_1, \theta_2, \ldots, \theta_n]$ is vector space including all adjustable parameters, and in this example, is a phase-shifting amount vector of n phase-shifting units. is solution space (that is, the set phase-shifting amount variation range). In this example, n=27556, and the adjustable parameter is very huge. In this case, an extremely complicated high-dimensionality optimization issue is to find out a phase-shifting amount distribution of phase-shifting units that has a narrowest beam width and implements an optimal electromagnetic wave radiation pattern. An optimization dimensionality may be decreased from 27556 dimensionalities to about 1000 dimensionalities with reference to a space-filling design method and a space interpolation method. A specific process is as follows:

In step S2, one piece of sample vector space $\Theta_0=[\theta_{10}, \theta_{20}, \ldots, \theta_{m0}]$ is generated, where m=1000 phase-shifting units.

In step S3, according to the sample vector space $\Theta_0$ of the 1000 phase-shifting units, a phase-shifting amount of n-m phase-shifting units is calculated by using any one of interpolation methods, such as Gauss process interpolation and spline interpolation, to generate new phase-shifting amount vector space of the n phase-shifting units according to the following formula:

$$\Theta_i[\theta_1, \theta_2, \ldots, \theta_m, \theta_{m+1}, \theta_{m+2}, \ldots, \theta_n]$$

In step S4, computer simulation is used to calculate a beam width $T(\Theta_i)$, where $T(\Theta_i)$ is obtained by modulating a given pattern according to $\Theta_i$, and one piece of new sample vector space is generated according to a preset optimization method (such as a simulated annealing algorithm, a genetic algorithm, and a tabu search algorithm), where it is assumed that i=i+1. Interpolation is performed according to the new sample vector space to generate new phase-shifting amount vector space $\Theta_{i+1}$. Step S4 is circularly executed until a preset requirement is met.

After the phase-shifting amount distribution is obtained, shape and layout information of an artificial structure unit on each phase-shifting unit is obtained by using the foregoing described artificial structure unit growth method. Specifically, a required phase-shifting amount variation range of a phase-shifting unit is obtained by using growth of the planar snowflake-shaped artificial structure shown in FIG. 5.

Figure 31:
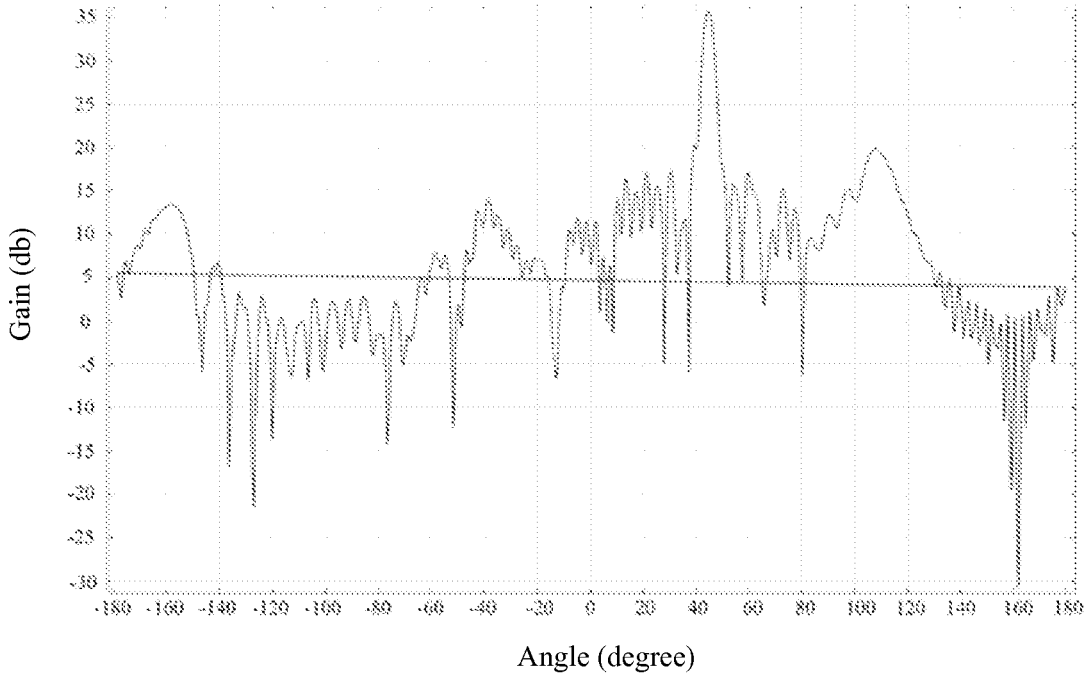
FIG. 31 is a narrow-beam pattern obtained after a wide-beam pattern is modulated by a reflective array surface according to the present invention.

A primary feed shown in FIG. 30 is added to the obtained device and a simulation test is performed, so as to obtain a pattern of the device, as shown in FIG. 31. A beam width of the device is 3.16 degrees. This implements the modulation of the electromagnetic wave having a wide-beam pattern to the electromagnetic wave having a narrow-beam pattern.

(2) Modulating an Electromagnetic Wave Having a Narrow-Beam Pattern to an Electromagnetic Wave Having a Wide-Beam Pattern A device that modulates an electromagnetic wave having a narrow-beam beam pattern to an electromagnetic wave having a wide-beam pattern may also be designed by using the foregoing method. In fact, modulating an electromagnetic wave having a narrow-beam pattern to an electromagnetic wave having a wide-beam pattern is a process reverse to the foregoing modulating an electromagnetic wave having a wide-beam pattern to an electromagnetic wave having a narrow-beam pattern. The modulating an electromagnetic wave having a wide-beam pattern to an electromagnetic wave having a narrow-beam pattern may be considered as transmitting, and the modulating an electromagnetic wave having a narrow-beam pattern to an electromagnetic wave having a wide-beam pattern may be considered as receiving.

(3) Changing a Main Beam Direction of an Electromagnetic Wave Pattern.

A device that changes a main beam direction of an electromagnetic wave pattern may also be designed by using the foregoing method. In step S1, a phase-shifting amount variation range is set, a phase-shifting amount of each phase-shifting unit is used as one adjustable parameter, and a beam width and a main beam direction are used as a parameter specification. A radiation pattern of a primary feed is shown in FIG. 30. A main beam direction of the primary feed is 0 degree and a beam width is 3.16 degrees. An objective is to change the main beam direction to 45 degrees and control the beam width within 4 degrees.

Figure 32:
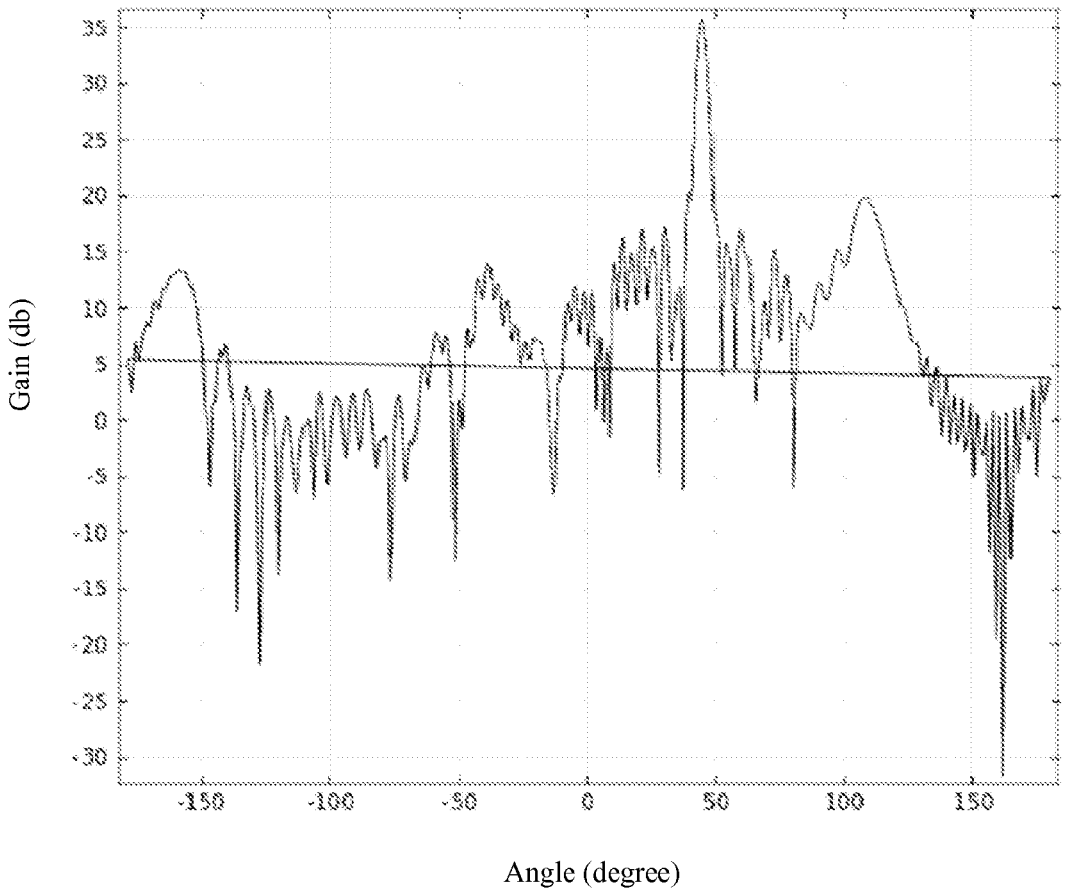
FIG. 32 is a pattern in which a main beam direction of an electromagnetic wave is changed by a reflective array surface according to the present invention.

A primary feed shown in FIG. 30 is added to the obtained device and a simulation test is performed, so as to obtain a pattern of the device, as shown in FIG. 32. A main bean direction of the device is 45 degrees and a beam width is 3.7 degrees. This implements the objective of changing the main beam direction to 45 degrees and controlling the beam width within 4 degrees.

Electromagnetic interference may be avoided by changing the main beam direction of the electromagnetic wave pattern. For example, on a ship, if lots of electromagnetic waves are directly reflected to a control room through a deck, serious interference is generated to an electronic equipment in the control room, thereby affecting navigation safety. In this case, if the foregoing device is disposed on the deck, a main beam direction of an interfering electromagnetic wave is changed, so that a majority of electromagnetic waves are reflected to another place, thereby improving an anti-electromagnetic interference capability of the electronic equipment in the control room.

The reflective array antenna in the present invention may be a transmit antenna, a receive antenna, or a transceiver antenna.

The following describes the present invention in detail by using a satellite receiving antenna, which receives a signal emitted by ChinaSat-9, as an example. It should be understood that the reflective array antenna in the present invention is not limited to a satellite receiving antenna, and may also be a satellite communication antenna, a microwave antenna, a radar antenna, or another type of antenna.

Embodiment 1

Figure 18:
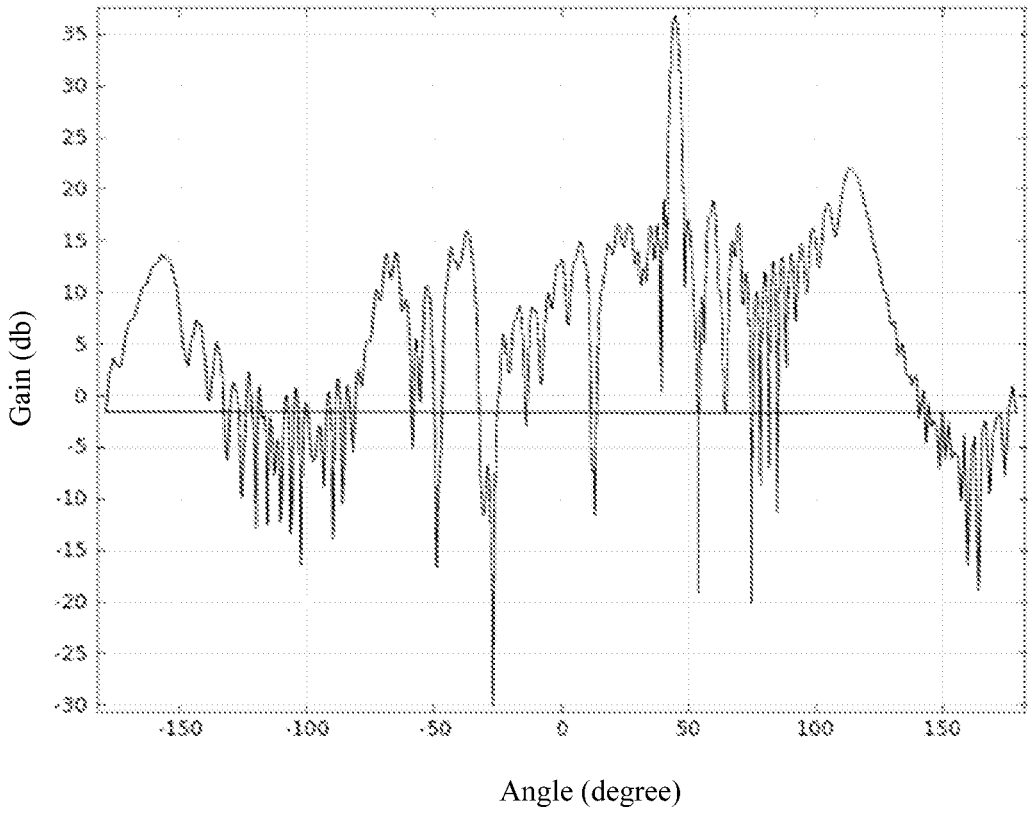
FIG. 18 is a far field pattern of using a reflective array antenna with an offset angle of 45 degrees as a transmit antenna.

An included angle α between an electromagnetic wave that is sent by a satellite and is received by a reflective array surface and a normal direction of the reflective array surface is 45 degrees, where a is hereinafter referred to as an offset angle. The reflective array surface is a circular thin plate with a diameter of 500 mm. An artificial structure unit shown in FIG. 5 is arranged on the reflective array surface. FIG. 18 is a far field pattern of using a reflective array antenna with an offset angle of 45 degrees as a transmit antenna. It may be seen that a main beam direction of the reflective array antenna is 45 degrees. According to a principle of antenna reversibility, an electromagnetic wave with an incident angle of 45 degrees can also be focused at a feed.

An actual test shows that, when the offset angle ranges from 30 to 50 degrees, performance of the antenna still keeps good; and when the offset angle is beyond the range, there is still a signal but signal quality is poor. That is, in the embodiment, the reflective array surface has a focusing capability for an incident electromagnetic wave within an angle range of 30 to 50 degrees, where the angle range is formed between the incident electromagnetic wave and the normal direction of the reflective array surface.

According to a different application occasion, the satellite receiving antenna in Embodiment 1 may have three types of working environments.

(1) On a Wall

That is, a mounting surface of the reflective array surface is a vertical wall and the reflective array surface is parallel to the vertical wall. ChinaSat-9 is used as an example. The antenna is applied in three provinces in Northeast China, the northern region of Hebei Province, and the northeast of Inner Mongolia. The antenna may be mounted for use, as long as the offset angle ranges from 30 to 50 degrees.

A mounting manner of a wall-mounted antenna is as follows:

Step 1: According to azimuth A and elevation angle E information of a region where a satellite is located, select a wall for mounting. Generally, a top view of a house is a rectangle. When a difference between an azimuth A' of a wall and an azimuth A of the satellite (|A'−A|) is ≥90°, an antenna mounted on the wall cannot receive a satellite signal. Therefore, among four walls, there is one and only one wall whose azimuth A' is between A−45° and A+45°. The wall is an optimal wall for mounting a wall-mounted antenna. A smaller offset angle leads to a better antenna effect. The azimuth A' of the wall is defined as follows: an angle of clockwise rotating, from the due north, to a normal direction of the wall, for example, an azimuth of a wall in the due south is 180° and an azimuth of a wall in the due west is 270°.

The foregoing azimuth A and elevation E information may be obtained through calculation, or may be acquired by querying a table. A calculation manner is:

A formula for calculating an azimuth A is as follows:

$$A = tg^{-1}\frac{th(lon)}{\sin(lat)};$$

A formula for calculating an evaluation E is as follows:

$$E = tg^{-1}\left[\frac{\cos(lon)\times\cos(lat)-\frac{r}{R}}{\sqrt{1-(\cos(lon)\cos(lat))^2}}\right];$$

Parameters used in the foregoing two formulas are:

lon=longitude where an earth station is located—orbital longitude of a satellite;

lat=latitude where an earth station is located;

r=6378 km (radius of the earth);

R=42218 km (radius of a satellite orbit);

Step 2: Calculate an offset angle of the antenna. For a wall whose azimuth is A', a formula for calculating an offset angle of an antenna is as follows:

$$\alpha=\cos^{-1}(\cos(A-A')*\cos(E));$$

Step 3: Calculate an included angle γ between a symmetry axis of a reflective array surface and a plumb line, that is, calculate an angle by which the reflective array surface needs to rotate relative to the plumb line during mounting. When γ is a positive value, after counter-clockwise rotating by an angle of γ, the plumb line coincides with the symmetry axis of the reflective array surface. When γ is a negative value, after clockwise rotating by an angle of −γ, the plumb line coincides with the symmetry axis of the reflective array surface. A formula for calculating an included angle γ is as follows:

$$\gamma=tg^{-1}(\sin(A-A')\cos(E)/\sin(E));$$

During actual mounting, according to a calculated included angle γ, a user may use a tool such as a plumb and a protractor to adjust an azimuth of the antenna by rotating a rotary mechanism relative to a vertical wall, so that the symmetry axis of the reflective array surface points to the satellite. According to a calculated offset angle α, a location of a feed may be obtained. The location of the feed is adjusted by using a beam scanning mechanism, so that the feed may be at a focus of the reflective array surface.

(2) On a Ground Tile

The satellite receiving antenna may be tiled on ground (that is, a ground tile-mounted satellite receiving antenna). The satellite receiving antenna is specific to level ground (or another horizontal plane) in a region. The satellite receiving antenna may fixedly receive a signal from one satellite as long as the reflective array surface is tiled on the level ground and an azimuth is adjusted. A panel antenna tiled on ground effectively solves a wind resistance problem caused by a traditional pot antenna, requires no bracket, saves resources and space, and is easy to mount and use.

ChinaSat-9 is used as an example. The ground tile-mounted satellite receiving antenna is applied in the southern China, southern regions of the Yangtze river. Essentially, the ground tile-mounted satellite receiving antenna is the same as a wall-mounted satellite receiving antenna. A conversion relationship between a pitch angle of a ground tile-mounted satellite receiving antenna and a pitch angle of a wall-mounted satellite receiving antenna is that the pitch angle of the ground tile-mounted satellite receiving antenna is 90 degrees minus an offset angle. Therefore, in another word, an applicable pitch angle range of the antenna is 40-60°.

An azimuth of the ground tile-mounted satellite receiving antenna is directly pointed during mounting, and the pitching is implemented by adjusting a feed location. A mounting manner is relatively simple.

(3) On an Inclined Plane

That is, an antenna mounting surface is neither perpendicular nor parallel to a horizontal surface. The antenna may be placed on an inclined plane. For an initial location, refer to the ground tile-mounted satellite receiving antenna. A conversion relationship between a pitch angle of a ground tile-mounted satellite receiving antenna and a pitch angle of an inclined plane-mounted satellite receiving antenna is: pitch angle=90°−offset angle. Therefore, an applicable pitch angle range is 40°-60°. The inclined plane herein has an inclined angle, where it is assumed that the inclined angle is k. Therefore, it is required to perform compensation on the inclined angle. As a result, a pitch angle of a place where the inclined plane is located is k+E. If k+E ranges from 40° to 60°, this type of antenna may be used. Moreover, on the inclined plane, the antenna may rotate within an application scope, so as to point to a satellite.

Embodiment 2

Figure 19:
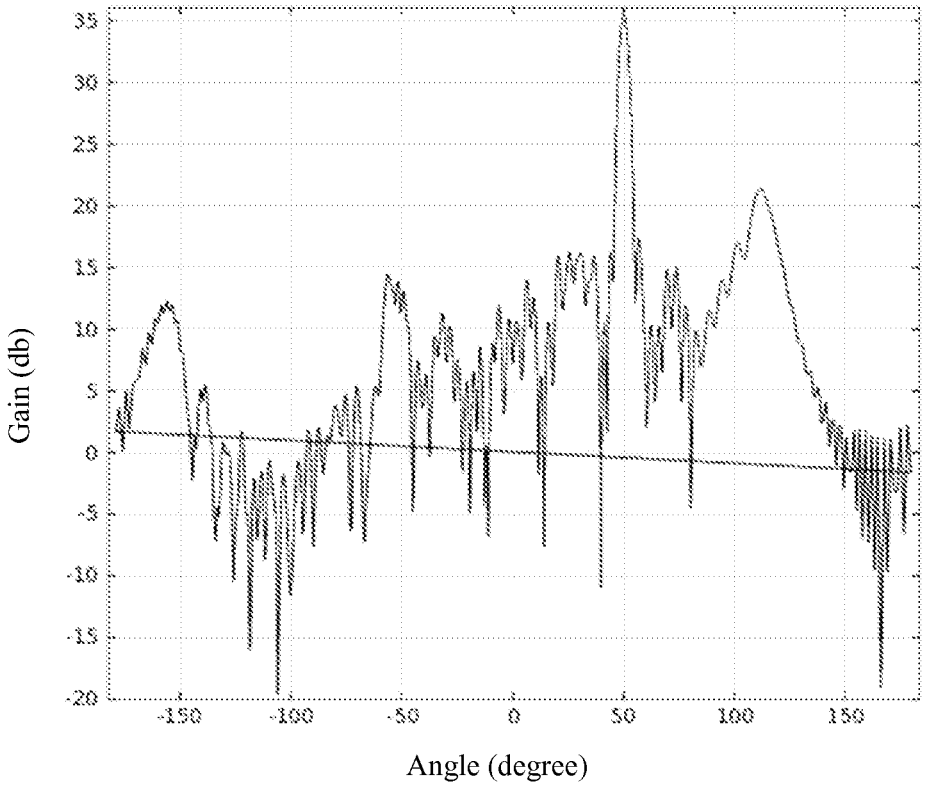
FIG. 19 is a far field pattern of using a reflective array antenna with an offset angle of 50 degrees as a transmit antenna.

An offset angle α of an antenna is 50 degrees. A reflective array surface is a circular thin plate with a diameter of 500 mm. An artificial structure unit shown in FIG. 5 is arranged on the reflective array surface. FIG. 19 is a far field pattern of using a reflective array antenna with an offset angle of 50 degrees as a transmit antenna. It may be seen that a main beam direction of the reflective array antenna is 50 degrees. According to a principle of antenna reversibility, an electromagnetic wave with an incident angle of 50 degrees can also be focused at a feed.

An actual test shows that, when the offset angle ranges from 35 to 55 degrees, performance of the antenna still keeps good; and when the offset angle is beyond the range, there is still a signal but signal quality is poor. That is, in the embodiment, the reflective array surface has a focusing capability for an incident electromagnetic wave within an angle range of 35 to 55 degrees, where the angle range is formed between the incident electromagnetic wave and a normal direction of the reflective array surface.

According to a different application occasion, the satellite receiving antenna in Embodiment 2 may have three types of working environments, that is, on a wall, on a ground tile, and on an inclined plane.

A satellite pointing manner and mounting manner of the antenna in the embodiment are the same as those in Embodiment 1.

ChinaSat-9 is used as an example. A wall-mounted satellite antenna in the embodiment is applied in a zone from the northern area of the Yellow River to the south of three Northeastern Provinces of China. The antenna may be mounted as long as an offset angle ranges from 35° to 55°.

A ground tile-mounted satellite receiving antenna in the embodiment is applied in south central China.

Embodiment 3

Figure 20:
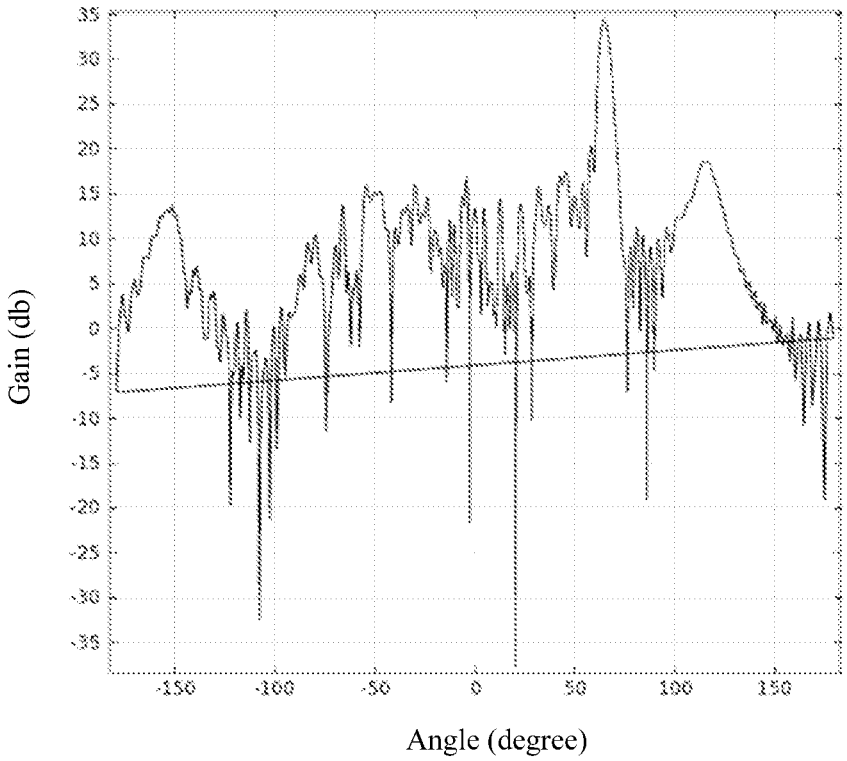
FIG. 20 is a far field pattern of using a reflective array antenna with an offset angle of 65 degrees as a transmit antenna.

An offset angle α of an antenna is 65 degrees. A reflective array surface is a circular thin plate with a diameter of 500 mm. An artificial structure unit shown in FIG. 5 is arranged on the reflective array surface. FIG. 20 is a far field pattern of using a reflective array antenna with an offset angle of 65 degrees as a transmit antenna. It may be seen that a main beam direction of the reflective array antenna is 65 degrees. According to a principle of antenna reversibility, an electromagnetic wave with an incident angle of 65 degrees can also be focused at a feed.

An actual test shows that, when the offset angle ranges from 50 to 70 degrees, performance of the antenna still keeps good; and when the offset angle is beyond the range, there is still a signal but signal quality is poor. That is, in the embodiment, the reflective array surface has a focusing capability for an incident electromagnetic wave within an angle range of 50 to 70 degrees, where the angle range is formed between the incident electromagnetic wave and a normal direction of the reflective array surface.

According to a different application occasion, the satellite receiving antenna in Embodiment 3 may have three types of working environments, that is, on a wall, on a ground tile, and on an inclined plane.

A satellite pointing manner and mounting manner of the antenna in the embodiment are the same as those in Embodiment 1.

ChinaSat-9 is used as an example. A wall-mounted satellite antenna in the embodiment is applied in a southern region of China. The antenna may be mounted as long as an offset angle ranges from 50 to 70 degrees.

A ground tile-mounted satellite receiving antenna in the embodiment is applied in the north of China.

With reference to the foregoing there embodiments, it may be obtained that a same reflective array surface in the present invention has a focusing capability for an incident electromagnetic wave within a relatively wide angle range. Therefore, most regions of China may be basically covered by using the three satellite receiving antennas in Embodiment 1 to Embodiment 3 of the present invention, with good universality and low production and processing costs. Certainly, a satellite receiving antenna that is also applicable to another region in the world may also be designed according to a requirement.

Certainly, likewise, the following types of reflective array surfaces may also be designed: a reflective array surface that has a focusing capability for an incident electromagnetic wave within an angle range of 0-20 degrees, where the angle range is formed between the incident electromagnetic wave and a normal direction of the reflective array surface; a reflective array surface that has a focusing capability for an incident electromagnetic wave within an angle range of 10-30 degrees, where the angle range is formed between the incident electromagnetic wave and a normal direction of the reflective array surface; and a reflective array surface that has a focusing capability for an incident electromagnetic wave within an angle range of 20-40 degrees, where the angle range is formed between the incident electromagnetic wave and a normal direction of the reflective array surface.

In addition, the present invention further provides a communication-in-motion antenna, where the communication-in-motion antenna includes a servo system and the foregoing reflective array antenna.

In one embodiment of the present invention, a reflective array surface is fixed, and the servo system controls a feed to three-dimensionally move relative to the reflective array surface, so as to perform beam scanning. It is assumed that the reflective array surface in the embodiment is applied to a satellite receiving antenna. A proper mechanical structure and a control system (a required control policy is implemented by means of software programming) are designed according to a parameter such as a longitude where a satellite is located, a longitude and latitude of a place where a mobile carrier is located, a current offset angle of the reflective array surface, a current azimuth (namely, an included angle between projection of a normal of an antenna mounting surface on a horizontal plane and the due south) of the antenna mounting surface, and a current included angle between the antenna mounting surface and the horizontal plane, which may implement real-time pointing of the antenna to the satellite.

In one exemplary embodiment of the present invention, both a symmetry axis of a reflective array surface and a central axis of a feed are within a first plane, the reflective array surface may rotate relative to an antenna mounting surface, and the servo system is configured to control the reflective array surface to rotate relative to the antenna mounting surface and is configured to control the feed to move within the first plane to perform beam scanning. The servo system is used to control the reflective array surface to rotate relative to the antenna mounting surface and control the feed to move within the first plane to perform beam scanning. The rotation of the reflective array surface and the movement of the feed may be considered as two controllable dimensionalities. It is assumed that the reflective array surface in the embodiment is applied to a satellite receiving antenna. A proper mechanical structure and a control system (a required control policy is implemented by means of software programming) are designed according to a parameter such as a longitude where a satellite is located, a longitude and latitude of a place where a mobile carrier is located, a current offset angle of the reflective array surface, a current azimuth (namely, an included angle between projection of a normal of an antenna mounting surface on a horizontal plane and the due south) of the antenna mounting surface, and a current included angle between the antenna mounting surface and the horizontal plane, which may implement real-time pointing of the antenna to the satellite.

In the embodiment, a mobile carrier of the communication-in-motion antenna is a car, a ship, an airplane, a train, or the like.

In the embodiment, the antenna mounting surface is a top surface of a car, a top surface of a front cabinet cover of a car, or another proper mounting surface on a car.

In the embodiment, the antenna mounting surface is a top surface of a control room of a ship, a hull side of a ship, or another proper mounting surface on a ship.

In the embodiment, the antenna mounting surface is a top surface of an airframe of an airplane, an airframe side of an airplane, a top surface of an airfoil of an airplane, or another proper mounting surface on an airplane.

In the embodiment, the antenna mounting surface is a top surface of a train, a side of a train, or another proper mounting surface on a train.

The foregoing describes the embodiments of the present invention with reference to the accompanying drawings. However, the present invention is not limited to the foregoing specific implementation manners. The foregoing specific implementation manners are only for exemplary description and are not restrictive. Under enlightenment of the present invention, a person of ordinary skill in the art may make various equivalent modifications or replacements without departing from the spirit of the present invention and the protection scope of the claims, and these modifications or replacements should fall within the protection scope of the present invention.

What is claimed is:

1. A reflective array surface, wherein the reflective array surface comprises a functional board that is configured to perform beam modulation on an incident electromagnetic wave and a reflection layer that is disposed on one side of the functional board and is configured to reflect an electromagnetic wave, wherein the functional board comprises two or more functional board units and the reflection layer comprises reflection units, wherein the number of reflection units corresponds to the number of functional board units, wherein the functional board unit and a reflection unit corresponding to the functional board unit constitute a phase-shifting unit that is used for phase shifting; the functional board unit comprises a substrate unit and an artificial structure unit that is disposed on one side of the substrate unit and is configured to generate an electromagnetic response to an incident electromagnetic wave, or the functional board unit is constituted by a substrate unit and a unit hole disposed on the substrate unit;

wherein the functional board comprises a substrate and an artificial structure layer that is disposed on one side of the substrate and has an electromagnetic response to an electromagnetic wave, wherein the reflection layer is disposed on the other side of the substrate; and at least one stress buffer layer is disposed between the substrate and the artificial structure layer and/or between the substrate and the reflection layer.

2. The reflective array surface according to claim 1, wherein the reflective array surface has a focusing capability for an incident electromagnetic wave within a predefined angle range, wherein the predefined angle range is formed between the incident electromagnetic wave and a normal direction of the reflective array surface.

3. The reflective array surface according to claim 1, wherein the reflective array surface has a focusing capability for an incident electromagnetic wave within an angle range of 0-70 degrees, wherein the angle range is formed between the incident electromagnetic wave and a normal direction of the reflective array surface.

4. The reflective array surface according to claim 1, wherein a difference value between a maximum phase-shifting amount and a minimum phase-shifting amount is less than 360 degrees for all phase-shifting units on the reflective array surface.

5. The reflective array surface according to claim 1, wherein a stress buffer layer is disposed between the substrate and the artificial structure layer, and the substrate is tightly laminated with the reflection layer; or the substrate is tightly laminated with the artificial structure layer, and a stress buffer layer is disposed between the substrate and the reflection layer; or a stress buffer layer is separately disposed between the substrate and the artificial structure layer and between the substrate and the reflection layer.

6. The reflective array surface according to claim 1, wherein the reflection layer is attached to a surface of the one side of the functional board, or the reflection layer and the functional board are disposed at a distance.

7. The reflective array surface according to claim 6, wherein the reflection layer is a metallic layer with an anti-warpage pattern, wherein the anti-warpage pattern can suppress warpage of the reflection layer relative to the functional board; or the reflection layer is a metallic grid reflection layer, and the metallic grid reflection layer is constituted by multiple pieces of mutually spaced sheet metal, wherein a shape of a single piece of sheet metal is a triangle or a polygon; or the reflection layer is a metallic grid reflection layer, and the metallic grid reflection layer is a mesh structure that is constituted by crisscrossing multiple metallic wires and has multiple mesh holes, wherein a shape of a single mesh hole is a triangle or a polygon.

8. The reflective array surface according to claim 4, wherein the reflective array surface is configured to modulate an electromagnetic wave having a wide-beam pattern to an electromagnetic wave having a narrow-beam pattern; or modulate an electromagnetic wave having a narrow-beam pattern to an electromagnetic wave having a wide-beam pattern; or change a main beam direction of an electromagnetic wave pattern.

9. A reflective array antenna, wherein the reflective array antenna comprises the reflective array surface according to claim 1.

10. The reflective array antenna according to claim 9, wherein the reflective array antenna further comprises a feed, wherein the feed can move relative to the reflective array surface, so as to perform beam scanning.

11. The reflective array antenna according to claim 9, wherein the reflective array antenna further comprises a feed, wherein both a symmetry axis of the reflective array surface and a central axis of the feed are within a first plane, wherein the reflective array surface may rotate relative to an antenna mounting surface, and the feed can perform beam scanning within the first plane to receive a focused electromagnetic wave.

12. The reflective array antenna according to claim 10, wherein the reflective array antenna further comprises a servo system, wherein the servo system is configured to control the feed to move relative to the reflective array surface, so as to perform beam scanning.

13. The reflective array antenna according to claim 11, wherein the reflective array antenna further comprises a servo system, wherein the servo system is configured to control the reflective array surface to rotate relative to the antenna mounting surface and is configured to control the feed to move within the first plane to perform beam scanning.

14. The reflective array surface according to claim 11, wherein the reflective array antenna further comprises a mounting rack that is configured to support the feed and the reflective array surface, wherein the mounting rack comprises a rotary mechanism that is configured to enable the reflective array surface to rotate relative to the antenna mounting surface and a beam scanning mechanism that is configured to enable the feed to perform beam scanning within the first plane.

15. The reflective array antenna according to claim 14, wherein the rotary mechanism comprises a through-hole disposed at a center of an antenna array surface and a rotation axis disposed in the through-hole, wherein one end of the rotation axis is inserted into the antenna mounting surface.

16. The reflective array antenna according to claim 14, wherein the beam scanning mechanism comprises a bearing rod, wherein one end of the bearing rod is fixedly connected to a rear side of the reflective array surface, a feed clamping part that is connected to the feed and is flexibly connected to the other end of the bearing rod, and a fastener that can fasten the bearing rod on the antenna mounting surface, wherein at least one sliding groove is disposed on one end of the bearing rod that is connected to the feed clamping part, along an axial direction, a regulating groove intersected with the sliding groove is disposed on the feed clamping part, and at least one adjusting bolt passes through the regulating groove and the sliding groove in sequence, so as to tightly lock and fix a relative location of the feed clamping part and the bearing rod.

17. The reflective array antenna according to claim 16, wherein the feed clamping part is a U-shaped spring plate, the feed is inserted into an arc-shaped region of the U-shaped spring plate, and a set screw passes through two extension arms of the U-shaped spring plate and squeezes the two extension arms to clamp and fix the feed.

18. The reflective array antenna according to claim 16, wherein the fastener comprises a presser disposed on an outer surface of the bearing rod and screws that respectively pass through two ends of the presser to enter the antenna mounting surface.

19. A communication-in-motion antenna, wherein the communication-in-motion antenna comprises a servo system and the reflective array antenna according to claim 9.

* * * * *